US007979952B2

(12) United States Patent
Beskow et al.

(10) Patent No.: US 7,979,952 B2
(45) Date of Patent: Jul. 19, 2011

(54) WET/DRY FLOOR CLEANING DEVICE

(75) Inventors: Jonas Beskow, Stockholm (SE); Anders Haegermarck, Trångsund (SE); Brian Vines, Birmingham, AL (US); Arnie Sepke, Hudson, IL (US)

(73) Assignee: AB Electrolux, Stockholm (SE)

( * ) Notice: Subject to any disclaimer, the term of this patent is extended or adjusted under 35 U.S.C. 154(b) by 781 days.

(21) Appl. No.: 11/956,178

(22) Filed: Dec. 13, 2007

(65) Prior Publication Data

US 2008/0148512 A1 Jun. 26, 2008

Related U.S. Application Data

(60) Provisional application No. 60/869,797, filed on Dec. 13, 2006.

(51) Int. Cl.
*A47L 7/00* (2006.01)
*A47L 9/02* (2006.01)

(52) U.S. Cl. ..... 15/322; 15/331; 15/383; 15/416; 15/419

(58) Field of Classification Search ..... 15/49.1, 15/98, 320, 322, 331, 369, 383, 416, 419; *A47L 7/00, 9/00*
See application file for complete search history.

(56) References Cited

U.S. PATENT DOCUMENTS

| | | | | |
|---|---|---|---|---|
| 853,525 | A | 5/1907 | Stewart | |
| 1,992,986 | A | 3/1935 | Bender | |
| 2,348,861 | A | 5/1944 | Smellie | |
| 3,079,626 | A | 3/1963 | Yonkers et al. | |
| 3,106,733 | A | 10/1963 | Counte et al. | |
| 4,498,214 | A | 2/1985 | Oxel | |
| 4,951,346 | A | 8/1990 | Salmon | |
| 5,168,599 | A | 12/1992 | Williams | |
| 5,189,757 | A | 3/1993 | Williams et al. | |
| 5,241,724 | A * | 9/1993 | Lim | 15/322 |
| 5,400,467 | A | 3/1995 | Hwang | |
| 6,514,356 | B2 | 2/2003 | Vystrcil et al. | |
| 6,662,402 | B2 * | 12/2003 | Giddings et al. | 15/320 |
| 6,681,442 | B2 | 1/2004 | Coates et al. | |
| 7,146,679 | B2 | 12/2006 | Coates et al. | |
| 7,725,984 | B2 * | 6/2010 | Jansen | 15/320 |
| 2001/0008036 | A1 | 7/2001 | Worwag | |
| 2005/0039296 | A1 * | 2/2005 | Yoshimura et al. | 15/334 |

(Continued)

FOREIGN PATENT DOCUMENTS

| | | |
|---|---|---|
| GB | 143690 | 4/1919 |

(Continued)

OTHER PUBLICATIONS

Tecnica product information, website date 2008; original date unknown, but admitted prior art (2 pages).

(Continued)

*Primary Examiner* — David A Redding
(74) *Attorney, Agent, or Firm* — Hunton & Williams

(57) ABSTRACT

A cleaning device with an elongated housing having a grip at one end and a cleaning head at another end, a dirt collection device and a vacuum source. The cleaning head has a rotary agitator, a first inlet opening having a first cross-sectional area, and a second inlet opening having a second cross-sectional area. The second cross-sectional area may be substantially less than the first cross-sectional area. The second inlet opening may be above the first inlet opening. There also may be a fluid supply tank and an associated pump, and the pump and agitator may be driven by the same motor.

13 Claims, 28 Drawing Sheets

U.S. PATENT DOCUMENTS

| | | | |
|---|---|---|---|
| 2005/0071948 | A1 | 4/2005 | Moshenrose |
| 2006/0123587 | A1 | 6/2006 | Parr et al. |
| 2006/0236494 | A1 | 10/2006 | Nelson et al. |

FOREIGN PATENT DOCUMENTS

| | | |
|---|---|---|
| WO | 01/41618 | 6/2001 |
| WO | 2005/018402 | 3/2005 |

OTHER PUBLICATIONS

Dirt Devil Mop Vac (1 page brochure).

"Royal Creates Mop Vac" Goldbogen article (1 page, oversized 11×17).

"Caddy Clean" brochure (4 pages).

* cited by examiner

FIG. 15A
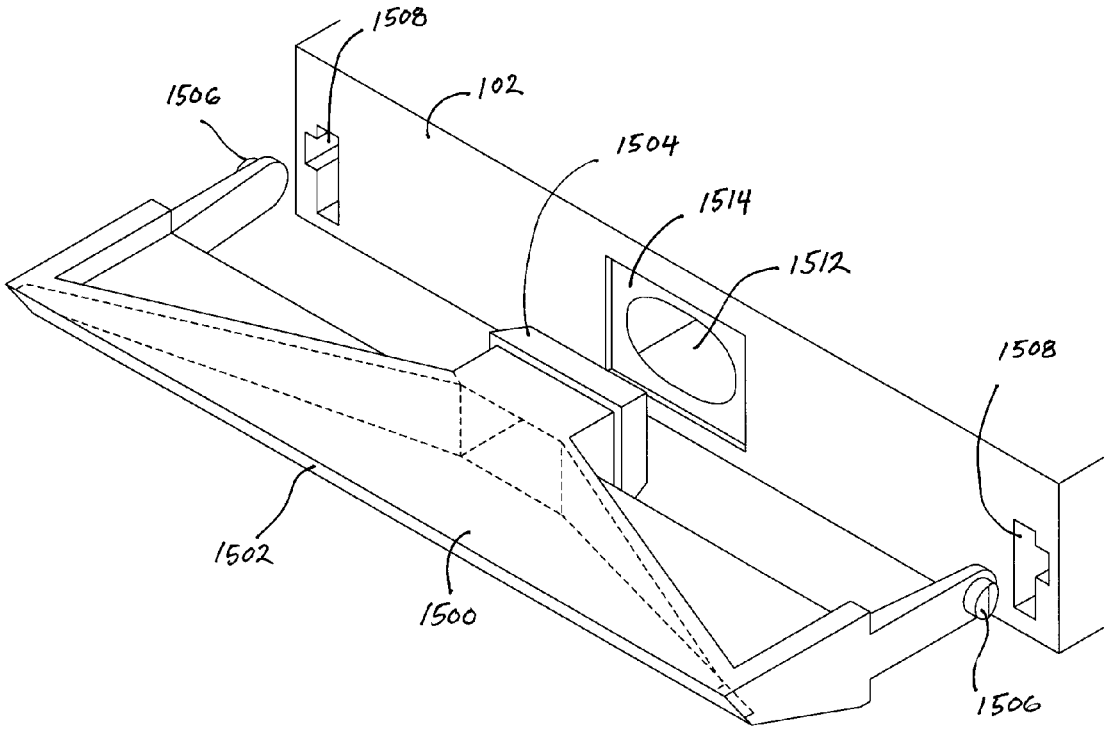
FIG. 15B
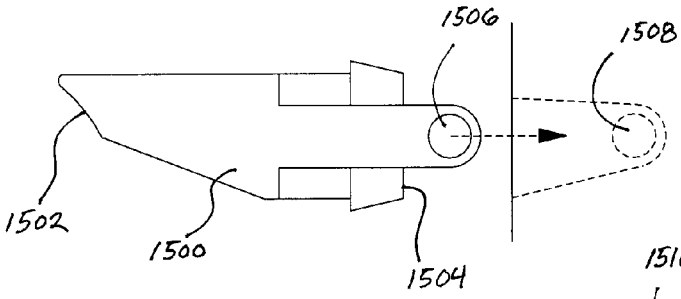
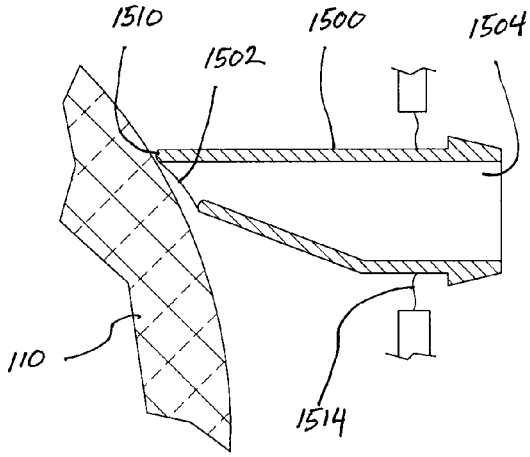
FIG. 15C

WET/DRY FLOOR CLEANING DEVICE

BENEFIT CLAIM

The present invention claims the benefit of U.S. Provisional Application No. 60/869,797, filed Dec. 13, 2006.

FIELD OF THE INVENTION

The present invention relates to floor cleaners and various features that may be used with vacuum cleaners. For example, the present invention relates to floor cleaners such as hand-operated devices including a cleaning head to scrub the floor and absorb moisture, vacuum sources to remove debris and fluid, water containment devices for vacuum cleaners, and so on.

BACKGROUND OF THE INVENTION

Various types of floor cleaning implements are known in the art. For example, vacuum cleaners are often used to clean dry debris, and wet extractors are often used to apply and remove a cleaning fluid to help clean floors and other surfaces. Vacuums and extractors typically use an electric vacuum source and some form of debris containment chamber. Extractors also have a fluid supply, and may be specially adapted to remove fluid from the surface being cleaned.

Other types of floor cleaners are also known. For example, mops and brooms are well-known in the art. In addition, such simple devices are sometimes provided with replaceable cleaning pads, vacuum sources, and other features to increase their functionality.

Various problems exist with conventional cleaning devices. For example, known wet extractors often require numerous back and forth passes to clean a surface. Additionally, known wet extractors often leave moisture on the surface, which may create a slipping hazard, promote mold growth, or cause other problems. Moreover, known wet extractors are often bulky, in many cases do not satisfactorily clean all flooring types, and are unable to satisfactorily pickup debris and fluid deposited in corners of a room. Other devices, such as mops or cleaning wands that use replaceable cleaning pads, are light and easy to manipulate, but place the burden on the user to apply repetitive motion to clean the surface. Such devices also typically do not have a vacuum source and can leave a substantial amount of debris on the floor after use.

The present invention provides unique alternatives to known cleaning devices, and various new and useful features that may be used with otherwise conventional cleaning devices.

SUMMARY OF THE INVENTION

In one exemplary aspect, there is provided a cleaning device having a housing, a cleaning head associated with the housing and adapted to be moved over a surface to be cleaned, a dirt collection device and a vacuum source. The cleaning head includes a rotary agitator that can rotate in a first rotational direction and contact the surface to be cleaned, a first inlet opening having a first cross-sectional area, and a second inlet opening having a second cross-sectional area. The second cross-sectional area is substantially less than the first cross-sectional area. The dirt collection device is associated with the housing. The vacuum source is adapted to generate a working airflow through the first inlet opening, the second inlet opening, and the dirt collection device. A valve may be provided to selectively obstruct the airflow through one or both of the inlet openings.

In another exemplary aspect, there is provided a cleaning device having a housing, a cleaning head, a dirt collection device, and a vacuum source. The cleaning head is associated with the housing, and can be moved over a surface to be cleaned. The cleaning head has an agitator chamber, a rotary agitator located at least partially within the agitator chamber and that can rotate in a first rotational direction and contact the surface to be cleaned, a first inlet opening having a first cross-sectional area and a second inlet opening having a second cross-sectional area. The first inlet opening is located at least partially within the agitator chamber, and the second inlet opening is located above the first inlet opening. The dirt collection device is associated with the housing. The vacuum source is in the housing and is adapted to generate a working airflow through the first inlet opening, the second inlet opening, and the dirt collection device.

In another exemplary aspect, there is provided a cleaning device having a housing, a cleaning head associated with the housing and able to move over a surface being cleaned, a supply tank that is associated with the housing and that can contain a fluid, a recovery tank associated with the housing, and a vacuum source in the housing. The cleaning head has a rotary agitator that can rotate in a first rotational direction and contact the surface to be cleaned, a first inlet opening having a first cross-sectional area and a second inlet opening having a second cross-sectional area. The device has a pump that can convey fluid from the supply tank to the surface to be cleaned, and a motor that can simultaneously drive the rotary agitator and the pump. The vacuum source can generate a working airflow through the first inlet opening, the second inlet opening, and the recovery tank. The motor may drive the pump and/or agitator through a speed reducing device.

BRIEF DESCRIPTION OF THE DRAWINGS

Purposes and advantages of the exemplary embodiments of the invention described herein will be apparent to those of ordinary skill in the art from the following detailed description in conjunction with the appended drawings in which like reference characters are used to indicate like elements.

FIG. 15A is an isometric view of an exemplary embodiment of a floating inlet nozzle shown prior to assembly into an exemplary embodiment of a cleaning head.

FIG. 15B is a side view of the floating inlet nozzle of FIG. 15A, shown prior to assembly.

FIG. 15C is a cutaway side view of the floating inlet nozzle of FIG. 15A, shown in relation to an exemplary embodiment of an agitator.

DETAILED DESCRIPTION OF EXEMPLARY EMBODIMENTS

The following description is intended to convey an understanding of the inventions disclosed herein by describing a number of exemplary embodiments of floor cleaner components and systems. It should be appreciated, however, that the present invention is not limited to these exemplary embodiments and details, the appended figures, the summary of the invention, the abstract, or to the other specific disclosures herein. It is further understood that one possessing ordinary skill in the art, in light of known systems and methods taken in conjunction with the teachings herein, would appreciate the use of the invention for its intended purposes and benefits in any number of alternative embodiments, depending upon specific design needs and other considerations.

The terminology used herein is for the purpose of describing particular embodiments only, and is not intended to limit the scope of the present invention. As used throughout this disclosure, the singular forms "a," "an," and "the" include the plural unless the context clearly dictates otherwise. Thus, for example, a reference to "an agitator" includes a plurality of such agitators, as well as a single agitator and equivalents or variations thereof known to those skilled in the art. Unless defined otherwise, all technical and scientific terms used herein have the same meanings as commonly understood by one of ordinary skill in the art to which this invention belongs.

Figure 1B:
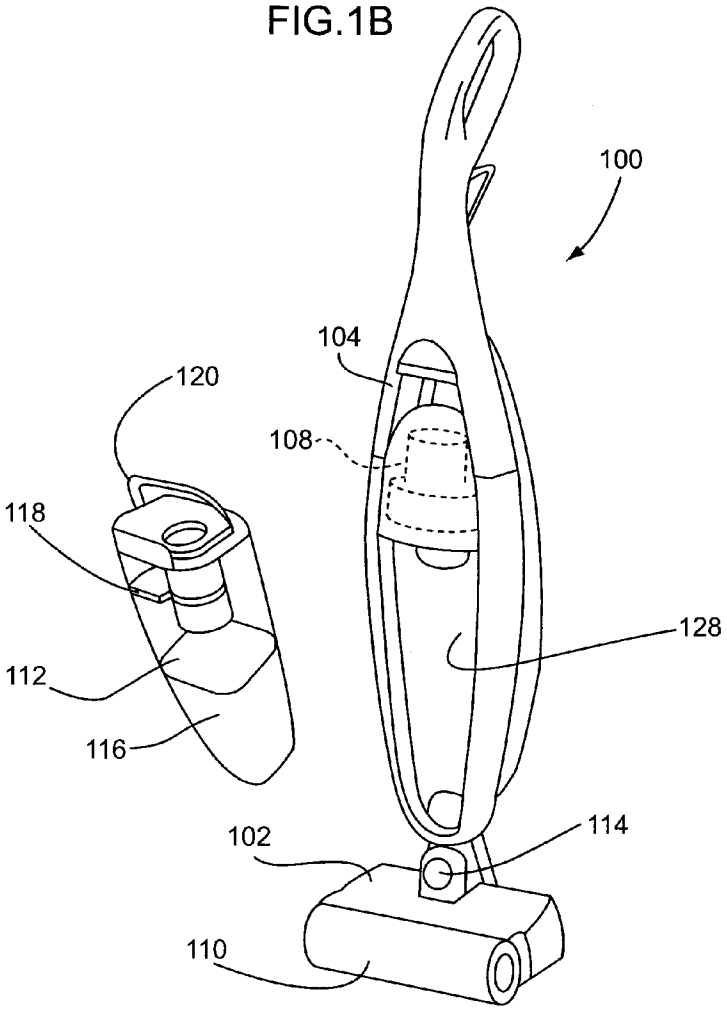
FIGS. 1A and 1B illustrate an exemplary embodiment of a cleaning device shown assembled in FIG. 1A, and partially disassembled in FIG. 1B.
Figure 1A:
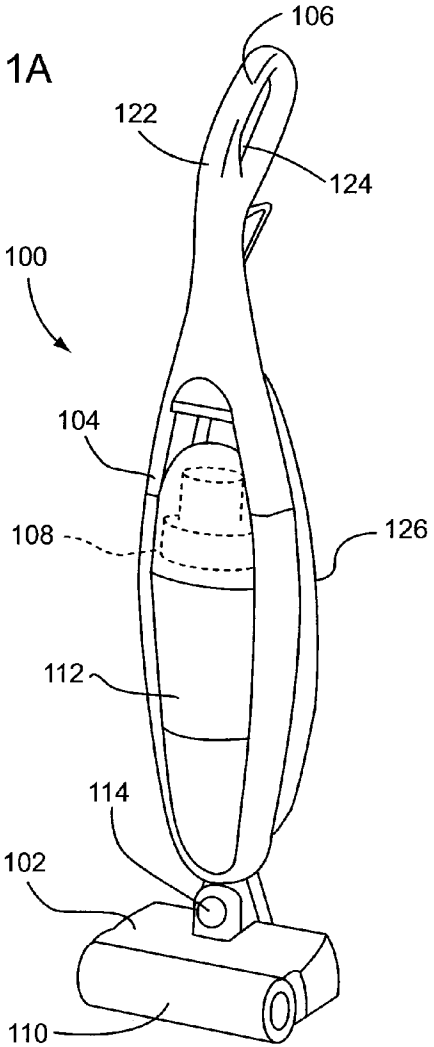

FIGS. 1A and 1B illustrate an exemplary embodiment of a cleaning device 100 that may embody or incorporate one or more inventions or features of the inventions described herein. The cleaning device 100 may be useable to clean and remove liquid and/or debris from smooth and/or hard surfaces, such as linoleum, tile, hardwood, and other flooring that may be found inside and outside a house, building, or elsewhere. The cleaning device 100 may be used, for example, to clean dried-on spots, fluid spills, dust, lint, hair, combinations thereof, and/or other types of dirt and grime found on floor surfaces. The cleaning device 100 optionally may be equipped to apply a cleaning fluid to the surface, scrub the surface, and extract fluid and/or pick-up debris from the surface, thereby leaving the surface substantially clean and dry after one or more back and forth strokes. The cleaning device 100 also may permit the operator to clean corners of a room and along wall edges.

In the exemplary embodiment depicted in FIG. 1A, the cleaning device 100 includes a cleaning head 102, a handle 104, a grip 106, a vacuum source 108, an agitator 110, and a tank assembly 112. The device is configured as an upright device, but may be reconfigured as a so-called canister device or to have other shapes. For example, the cleaning head 102 may be adapted to be a powerhead for a canister or central vacuum.

In the shown exemplary embodiment, the handle 104 comprises a housing that is attached to the cleaning head 102 by a pivot 114. An example of a pivot 114 is shown and described elsewhere herein, but other pivot constructions, such as a simple pivot pin arrangement as known in the art, may be used instead. The cleaning head 102 is supported for movement on a surface to be cleaned by one or more wheels, skids, plates, a bed of pressurized air, or the like, as known in the art. For example, as shown in more detail herein, the cleaning head 102 may be supported at the back by a pair of wheels, and at the front by the agitator 110. Where a skid or skid plate is used, it may be formed as a separate part, or formed as part of the lower surface of the cleaning head 102.

Height adjustment mechanisms also may be provided to change the height of all or portions of the head 102 relative to the ground. It is also known to provide features to deactivate or disengage vacuum cleaner brushrolls when the device's handle is in the upright position, which can be useful to prevent the rotating brushroll from damaging the floor. Such devices can be provided, for example, as an electric switch that deactivates the brushroll motor when the handle is upright, or as a "kick-up" mechanism that raises the still-rotating brushroll off of the floor when the handle is upright. Such height adjustment mechanisms, kick-up features and motor cutoff control circuits are well-known in the art, and any suitable feature of this kind may be adapted for use with embodiments of the cleaning devices disclosed herein, if desired, as will be understood by persons of ordinary skill in the art in view of the present disclosure.

The grip 106 and the handle 104 are provided to maneuver the cleaning head 102 over a surface for cleaning, and may have any shape useful for doing so. For example, the handle may comprise an elongated housing, and the grip may comprise an ovate loop into which the user can insert a hand. A power cord 126 may be provided on the handle 104 or the head 102, or the device may include batteries.

One or more controls may be provided on the grip or elsewhere on the device. These controls may operate the vacuum source 108, agitator 110, and/or fluid deposition system in any suitable manner. For example, a simple single-throw switch may be provided to activate all of the device's systems simultaneously, after which the systems may operate continuously or intermittently, and such systems may be operated by an automatic control circuit. As another example, a three-position switch 122 may be provided having a first position in which the device 100 is off, a second position in which the agitator 110 is activated, and a third position in which the vacuum source 108 is activated. In the third position, the vacuum source 108 may be operated either instead of the agitator 110, or in addition to the agitator 110.

The use of three power positions may be desirable to provide additional usefulness to the device. For example, the user can apply cleaning fluid to the floor, then place the switch 122 in the second position to scrub the surface without picking up the fluid or debris. This may be helpful when the surface has dried-in dirt, spills, and/or other grime that is difficult clean. Once the user has completed lifting the dirt from the surface, he can place the switch 122 in the third position to remove the fluid and dirt from the floor by suction, and, if the agitator 110 is operated in the third position, by mechanical lifting provided by the agitator 110.

The use of three power positions (or various combinations of power positions) also may permit better power management, which may be particularly useful where the device is battery operated. For example, less power is consumed by the cleaning device 100 when only rotating the agitator 110, as compared with both rotating the agitator 110 and operating a vacuum source 108. Thus, providing a setting that operates only the agitator 110 or only the vacuum fan 108 can increase the operational life of the device's batteries. Where a battery is provided to operate the device, any kind of battery, control circuit and recharging arrangement may be used. Of course, disposable batteries also may be used. Examples of useful batteries include a nickel-cadmium (NiCD) batteries, nickel metal hydride (NiMH) batteries, lithium-ion (Li-ion) batteries, lithium-polymer (Li-pol) batteries, and/or other suitable rechargeable or non-rechargeable batteries. Even if batteries are used, a power cord may be provided to replace the battery 206 or operate as an alternative power source and/or charging cord.

The following describes the approximate power consumption statistics of one exemplary embodiment of the present invention. To generate suction, an exemplary vacuum motor 108 requires about 100 W of power at an efficiency of about 36% to provide an airflow of about 15 1/s with about 2.7 kPA average negative pressure. To rotate an exemplary agitator 110 without any suction (i.e., when the vacuum source 108 is off), an exemplary agitator motor requires about 40 W of power. An exemplary battery pack comprises 12 NiMH (Nickel Metal Hydride) batteries, each rated at 1.2 volts and 2600 mAh (milliAmp-hours), that are wired in series to provide a power source having a 14.4 volt potential and 37.4 Wh/pack (Watt hours per battery pack). In this embodiment, the control 122 allows the user to operate only the agitator motor to rotate the agitator 110 in a first position, and operate both the agitator motor and the vacuum source 108 simultaneously in a second position. Using this configuration, it has been found that the device can be used with various combinations of rotating the agitator 110 alone and rotating the agitator 110 and applying suction, for about 12 minutes to about one hour. This battery usage time dictates the amount of floor area that can be cleaned before the battery must be recharged or replaced. This information also may be used to determine suitable sizes for the supply tank 116 and/or the recovery tank 118 (described below), which may be sized such that they do not require refilling or emptying between battery replacement or recharging.

Of course, different battery configurations may be used, as desired or required. For example, the foregoing exemplary battery pack may be replaced by another exemplary battery pack having 15 NiMH batteries, each rated at 1.2 volts and 2000 mAh, that are wired in series to provide a power source having an 18.0 volt potential and 36 Wh/pack. Such alternative configurations may be selected to vary the weight or volume of the device, increase or decrease the operating cycle and/or recharge time, and so on.

Where the device 100 includes a fluid supply tank or other fluid deposition system, the fluid deposition system may be operated automatically or manually. For example, a finger- or thumb-operated trigger 124 may be provided to manually operate the fluid deposition system to apply cleaning fluid to the floor. Such a trigger 124 may be a momentary on switch that operates only as long as the user depresses it, or it may be a throw switch or push on/push off switch that operates until the user turns it off. The trigger 124 may electrically or mechanically activate one or more pumps, valves, or other flow control devices. For example, the trigger may electrically activate a supply pump to draw fluid from a supply tank and apply it to the floor. As another example, the trigger 124 may open a valve to allow fluid to flow, by gravity and/or under pressure, to the floor or to a pump. Pressure may be applied to the fluid by a pump, by the vacuum source's exhaust, manually by the user, or by other devices or means. As yet another example, the trigger 124 may comprise or actuate a pumping mechanism that the user operates to pressurize and/or deliver fluid to the surface being cleaned.

The trigger 124 also may activate an automated system that, for example, applies fluid constantly or periodically whenever the agitator 110 and/or vacuum source 108 is being operated, applies fluid when it detects dirt on the surface, or applies fluid during particular movements of the device, such as during the forward stroke and/or the rearward stroke. In such a case, the user would activate the trigger and leave it on to automatically control fluid deposition. Furthermore, if an automatic fluid deposition system is provided, the trigger may be omitted, and the system may operate automatically whenever the device (or parts of the device, such as the agitator 110 or suction source 108) is on.

The foregoing examples describe only some of the many possible control configurations for the device 100. It will be understood that other control arrangements may be used and that it is not required to apply cleaning fluid to the floor before or during operation. Indeed, the device may be operated on dry floors or where the fluid on the floor constitutes a spill that is being removed by the device. As shown in FIG. 1, the controls 122, 124 may be located at the grip 106 or at some location where they can be easily manipulated by the user, but some or all of the controls 122, 124 may be located elsewhere on the device, such as on the cleaning head 102, or on a remote control. In addition, the various controls may comprise mechanical linkages, electrical switches, solid state devices and/or control circuits of any suitable kind.

In the shown embodiment, the tank assembly 112 comprises a fluid supply tank 116 that is mounted below a fluid recovery tank 118. Both tanks 116, 118 may be temporarily or permanently joined together to allow them to be removed as a unit. The tank assembly 112 may be mounted in a recess 128 located in the handle 104, or at any other location. A handle 120 may be provided at the top of the tank assembly 112 for removing and/or carrying the tank assembly 112. The handle 120 also may be adapted to include a structure that locks the tank assembly 112 in place when it is mounted to the handle 104. One or both of the supply and recovery tanks may be opaque or transparent, and may include a window or windows to view the contents thereof. Other useful features, such as ultraviolet sterilization lamps, heaters, and the like, may be used in conjunction with tanks or elsewhere in the fluid system to obtain their known benefits. It will also be understood that the recovery tank 118 may be replaced by or supplemented with any other suitable dirt collection device, such as a cyclone chamber or a vacuum cleaner bag, particularly where the device is not intended to clean liquid spills or wet surfaces.

Figure 2:
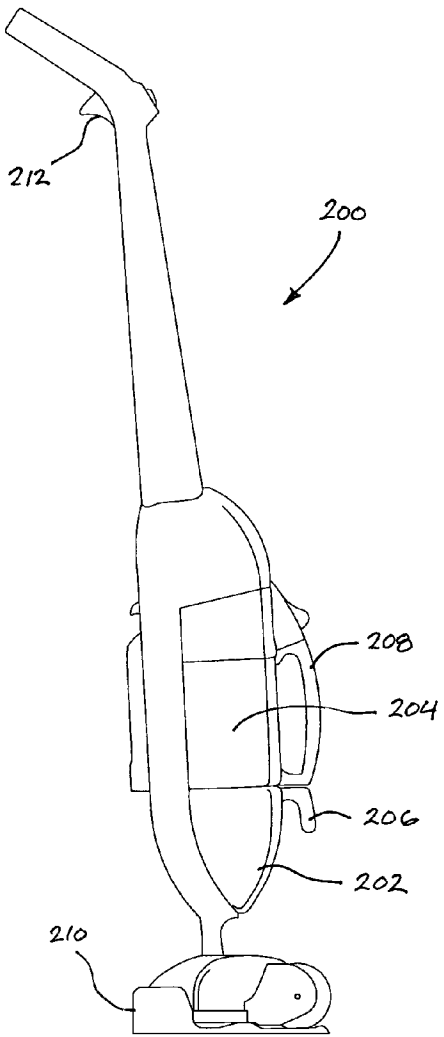
FIG. 2 is a side elevation view of another exemplary embodiment of a cleaning device.

It will be understood that it is not strictly required to have a supply tank or a recovery tank, and where such tanks are used, they may be mounted in any suitable manner to the handle 104 and/or head 102. For example, as shown in FIG. 2, a cleaning device 200 is provided having a supply tank 202 and a recovery tank 204 that are separately removable from the device 200, and each tank has a respective handle 206, 208. A trigger 212 is provided on the device to open a valve to allow fluid from the supply tank 202 to flow onto the surface being cleaned. Also shown in the embodiment of FIG. 2 is a charging and/or mounting stand 210 for storing the device 200.

Figure 3:
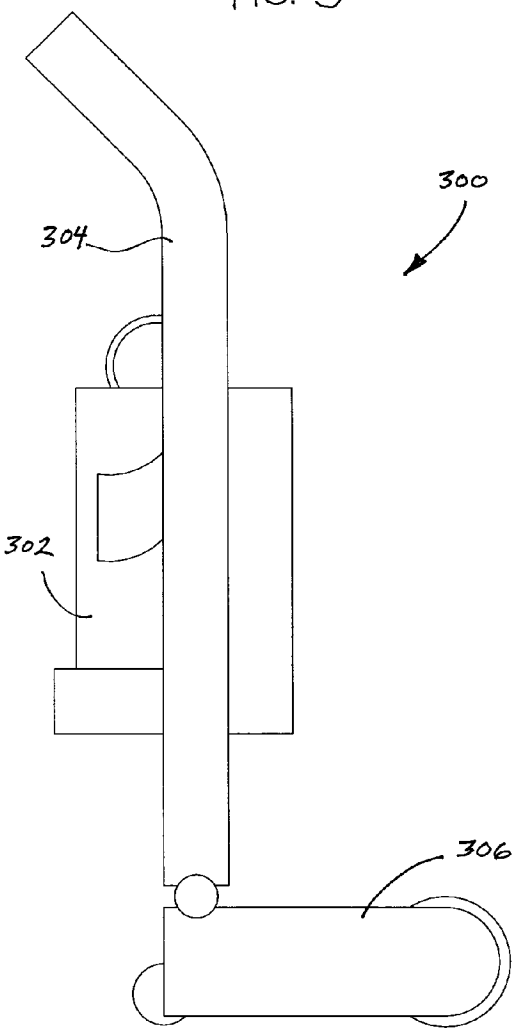
FIG. 3 is a side elevation view of another exemplary embodiment of a cleaning device.

As shown in FIG. 3, another exemplary embodiment of a cleaning device 300 includes a cleaning supply tank 302 that is fixed or removably attached to the back of the handle 304 at a height substantially raised from the base 306 to provide more head pressure to force the fluid in the tank 302 down to the head 306. While this may have advantages, it is not required, and the cleaning tank may instead be mounted low on the handle 304 or even on the base 306, which may provide the benefit of lowering the device's center of gravity. In another embodiment (not shown), one or both tanks may be mounted such that they are not intended to be removed from the handle 104.

The supply and/or recovery tanks may be attached to the device in any suitable manner. For example, they may rest on platforms, may be held by mechanical latches or interference ("snap") fit, may be retained by magnets, and so on. Such variations are within the knowledge of persons of ordinary skill in the art, and this disclosure will be understood to cover all such attachment mechanisms.

In still another embodiment (not shown), the supply and/or recovery tanks may be mounted to a removable cleaning unit that includes the motor 108, which unit may be dismounted from the device and used separately. Such removable units are shown, for example, in U.S. Publication No. 2007/0271724, which reference is incorporated herein. The foregoing reference shows a separable handheld cleaning device that mounts to the upper housing of an upright vacuum cleaner frame, but the removable unit may alternatively mount to the cleaner base.

In embodiments of the invention that use a fluid supply tank, any liquid detergent, water, or other fluid may be used in the supply tank as a cleaning fluid. In an exemplary embodiment, the detergent concentration may be 1.5%-5% of the cleaning fluid. If desired, the supply tank may be bifurcated, or two or more separate tanks may be provided. A multiple supply tank arrangement may be used, for example, when it is desired to have a clean water tank and a separate detergent concentrate tank (in which case the two may be mixed by a suitable metering or mixing device before or during deposit onto the floor), or to have two or more different kinds of cleaning, polishing or rinsing solutions available to the user (in which case a suitable valve may be provided to select which fluid(s) are to be deposited at any given time). Such variations will be readily understood by persons of ordinary skill in the art.

Figure 4:
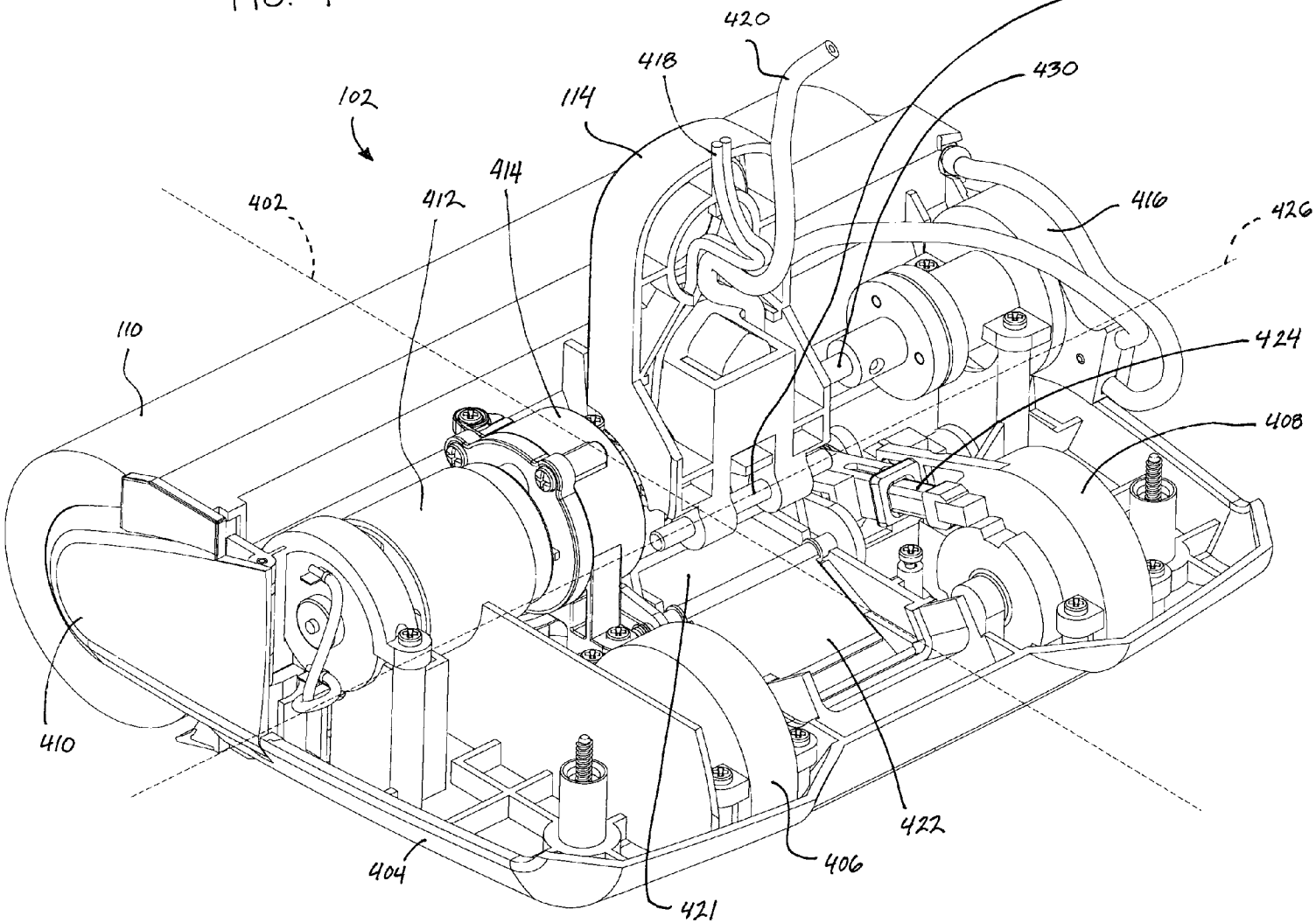
FIG. 4 is a rear isometric view of an exemplary embodiment of a cleaning head, shown with its top cover removed to reveal parts located therein.

Turning to FIG. 4, the cleaning head 102 of the exemplary embodiment of FIG. 1 is shown with its upper cover removed to reveal the internal working components. The cleaning head 102 may be shaped generally symmetrically with respect to a center line 402 passing through the middle of the head 102. The pivot 114 may be located at or near the centerline 402. Any arrangement of housing members, panels, molded parts, and the like may be used for form the cleaning head 102. In the exemplary embodiment, the cleaning head 102 comprises a lower base housing 404 to which the working components are attached either directly by screws, adhesives, or other devices or means, or by being captured in place between the lower base housing 404 and one or more covers, panels or other parts (not shown). Such constructions and variations thereof are known in the art.

As shown, the cleaning head 102 may be supported at the front by the agitator 110, and at the rear by one or more wheels or other rolling or sliding devices. In the exemplary embodiment, there are two wheels: a first wheel located in a first wheel well 406 located on the left side of the device, and a second wheel located in a second wheel well 408 on the right side of the device. The wheels are mounted on respective axles (not shown), as known in the art. As previously noted, a height adjustment mechanism may also be provided to alter the orientation of the cleaning head (or portions thereof, such as the agitator 110) with respect to the surface upon which it operates. As used herein the terms "left" and "right" refer to the sides of the device with respect to its centerline 402, as viewed from behind the device. These designations, and other terms identifying relative positions (such as "front" and "rear") are used for convenience in describing the structure, and are purely exemplary. It will be understood that features described as being at one location on the device may be moved to other locations in alternative embodiments.

The agitator 110 is mounted at the front of the cleaning head 102 such that it can rotate about its centerline. Any suitable arrangement of bearings, bushings, or the like may be used to mount the agitator 110. In the shown arrangement, a movable agitator door 410 is provided to allow the agitator 110 to be removed and replaced. Exemplary embodiments of agitator mounting arrangements are described in more detail subsequently herein.

Located in the exemplary cleaning head 102 are a motor 412, a gearbox 414 and a pump 416. Electricity may be provided to the motor 412 by wires 418 that pass through the pivot. Similarly, a supply hose 420 may pass through the pivot 114 to provide fluid to the pump 416. An air passage 421 having a suction valve 422 may be located approximately along the head centerline 402, and a valve actuator 424 may be provided to operate the valve 422. Embodiments of the foregoing devices are described in more detail subsequently herein.

The various components in the cleaning head 102 may be adjusted or positioned to control how the weight of the cleaning device 100, and forces applied by the user, are applied to the agitator 110. Doing so may improve cleaning performance or agitator wear characteristics, or provide other benefits, by pressing evenly across the entire agitator 110. In the embodiment of FIG. 4, weight is distributed generally equally across the cleaning head 102 by locating the motor 412 and gearbox 414 on the left side of the head 102, and the pump 416 and valve actuator 424 on the right side of the cleaning head 102. A drive shaft 430 is provided to connect the gearbox output to the pump input. In addition, the motor 412, gearbox 414 and pump 416 may be located longitudinally between the agitator 110 and the wheels, but forward in the head 102 to place more weight on the agitator 110.

It has also been found that moving the laterally-extending pivot axis 426 of the pivot 114 forward towards the agitator 110 and/or moving the wheels further behind the pivot can allow greater downward pressure to be exerted on the agitator 110 when the device is operated. Such added pressure can improve cleaning, improve the penetration of the agitator 110 into deep grouts and cracks, and provide more even cleaning fluid distribution. For example, in the embodiment of FIG. 4, the pivot axis 426 comprises a pin 428 about which the pivot 114 rotates, which pin 428 is also located forward in the head 102 to place it closer to the agitator 110.

Figure 5:
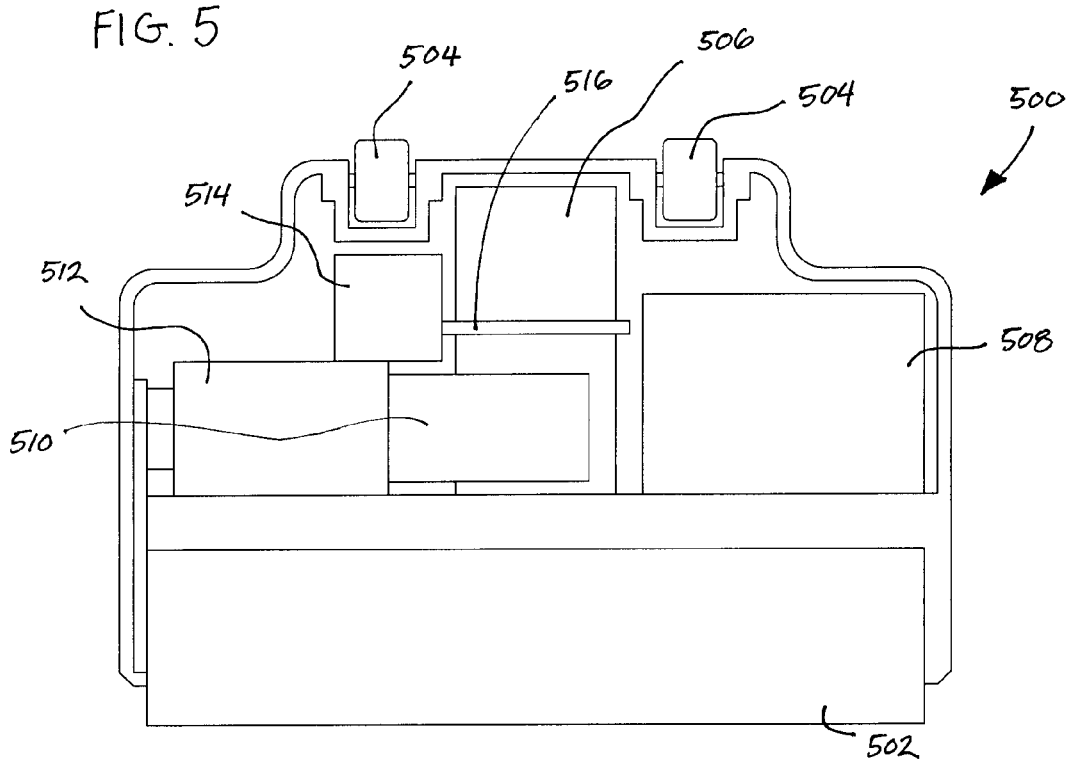
FIG. 5 is a top plan schematic showing another exemplary embodiment of a cleaning head showing an alternative part configuration.
Figure 6:
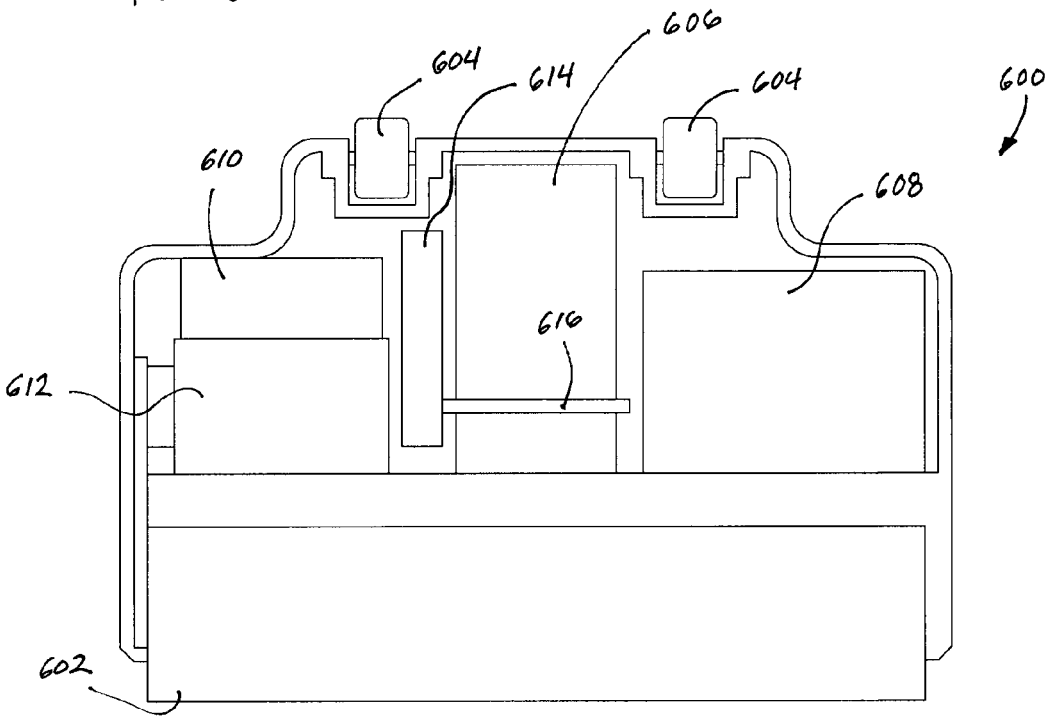
FIG. 6 is a top plan schematic showing still another exemplary embodiment of a cleaning head showing another alternative part configuration.

FIGS. 5 and 6 are schematic plan views of exemplary alternative cleaning head configurations, showing other arrangements for distributing the weight of the device across the agitator. FIG. 5 illustrates a cleaning head 500 that is supported at the front by an agitator 502, and at the rear by a pair of wheels 504. An air passage 506, in which a flow control valve may be located, extends along the centerline of the cleaning head 500. In this embodiment, the cleaning head includes a battery pack 508 on one side of the cleaning head 500, and a gearbox and/or pump 512 and valve actuator 514 on the other side of the head 500. A motor 510 is provided along the centerline of the head 500 above the air passage 506, and the handle pivot 516 is located behind the motor 510. In the embodiment of FIG. 6, the cleaning head 600 is supported by an agitator 602 at the front and wheels 604 at the back, and includes an air passage 606 in which a valve may be placed. A battery pack 608 is located on one side of the head 600, and a motor 610, gearbox and/or pump 612 and valve actuator 614 are located on the other side of the head. Here, the motor is offset relative to the gearbox to allow it to be moved to the side of the head, which also allows the handle pivot pin 616 to be moved closer to the front of the head 600. Depending on the weights of the various parts, the illustrated exemplary configurations, or other configurations, can provide a well-balanced arrangement to evenly distribute the weight of the device across the agitator 502, 602.

An equal (i.e., 50/50) weight distribution over the cleaning head's longitudinal centerline is preferred, but significant variation—up to about 65/35 or even to about 75/25—may still give suitable weight distribution and performance. Furthermore, while such weight distribution may be desirable, it is not necessary, and the effects of an uneven weight distribution may be negligible in some circumstances. In addition, the device may be constructed to be less susceptible or immune to any ill effects caused by uneven weight distribution. For example, in an alternative embodiment, one or more front wheels or skids (not shown) are provided near the front of the cleaning head (e.g., in front of, behind, or beside the agitator). The front wheels allow the agitator to contact the floor, but prevent either side of the agitator from pressing too hard into the floor. Such front wheels may also include individually-operated or simultaneously-operated height adjustment mechanisms.

In any of the foregoing embodiments, if it is desirable to obtain better weight balance than can be achieved by rearranging or relocating the parts (or if such rearrangement leads to technical or cost issues), the weight distribution can be adjusted by adding one or more counterweights to the lighter side of the cleaning head. Similarly, if it is desired to apply more or less overall pressure to the agitator, counterweights may be added to the front or rear of the cleaning head. Other methods for applying pressure to the front of the head include using a spring that is operated by reclining the handle relative to the head. Such devices are described, for example, in U.S. Pat. Nos. 6,591,447 and 6,957,473, which references are incorporated herein.

Referring back to FIG. 4, in an exemplary embodiment, the motor 412 drives the agitator 110 through an optional gearbox 414. The gearbox 414 may use planetary gears, offset gears, an arrangement of one or more pulleys, or any other kind of speed reduction device or speed increasing device for altering the output speed of a motor. The gearbox 414 may reduce the drive speed of the pump 416, the agitator 110, or both, depending on how the various parts are connected together.

While a gearbox 414 is not required, it has been found that typical electric motors 412 operate at too high a speed for ideal cleaning operations using some kinds of agitator. In an exemplary embodiment, the motor 412 operates at several thousand revolutions per minute (rpm), and the gearbox 414 reduces this speed to drive the agitator 110 at about 500 rpm. This speed reduction also has the benefit of increasing the torque applied to the agitator 110. Of course, any useful gear reduction ratio may be used to obtain the desired agitator speed and/or torque, and such values may change depending on the nature of the surface intended to be cleaned and the type of material or structure used for the agitator 110. For example, the gearbox 414 may be selected to operate the agitator 110 at higher speeds or lower speeds, or may be controlled to operate across a range of speeds. Such control may be manual, or by an automatic control system that detects surface conditions, cleaning efficiency, or other operational parameters, as known in the art. The speed may be adjusted by directly controlling the operating speed of the motor 412, or adjusting the gear ratio of the gearbox 414 using discrete shifting gear positions, infinitely variable pulley arrangements, and other devices and means known in the power transfer arts.

It has been unexpectedly discovered that examples of suitable gearboxes are found in commercially-available power tools, such as power screwdrivers and drills. While such devices may operate properly with the motor 412, they may require modification to handle the motor's power output. One example of a suitable gearbox is provided in U.S. Pat. No. RE 37,905 which reference is incorporated herein. This gearbox uses planetary reduction gears, and includes an overrunning clutch that allows the driven device to stop rotating when the driving torque exceeds a certain value. This kind of clutch also may be useful with the present gearbox 414 to stop the agitator 110 in the event it encounters an unmoving obstacle or becomes entangled in fabric or hair. Of course, other types of gears and/or clutches may be used in the gearbox 414 or elsewhere in the drive system, if desired.

Figure 7A:
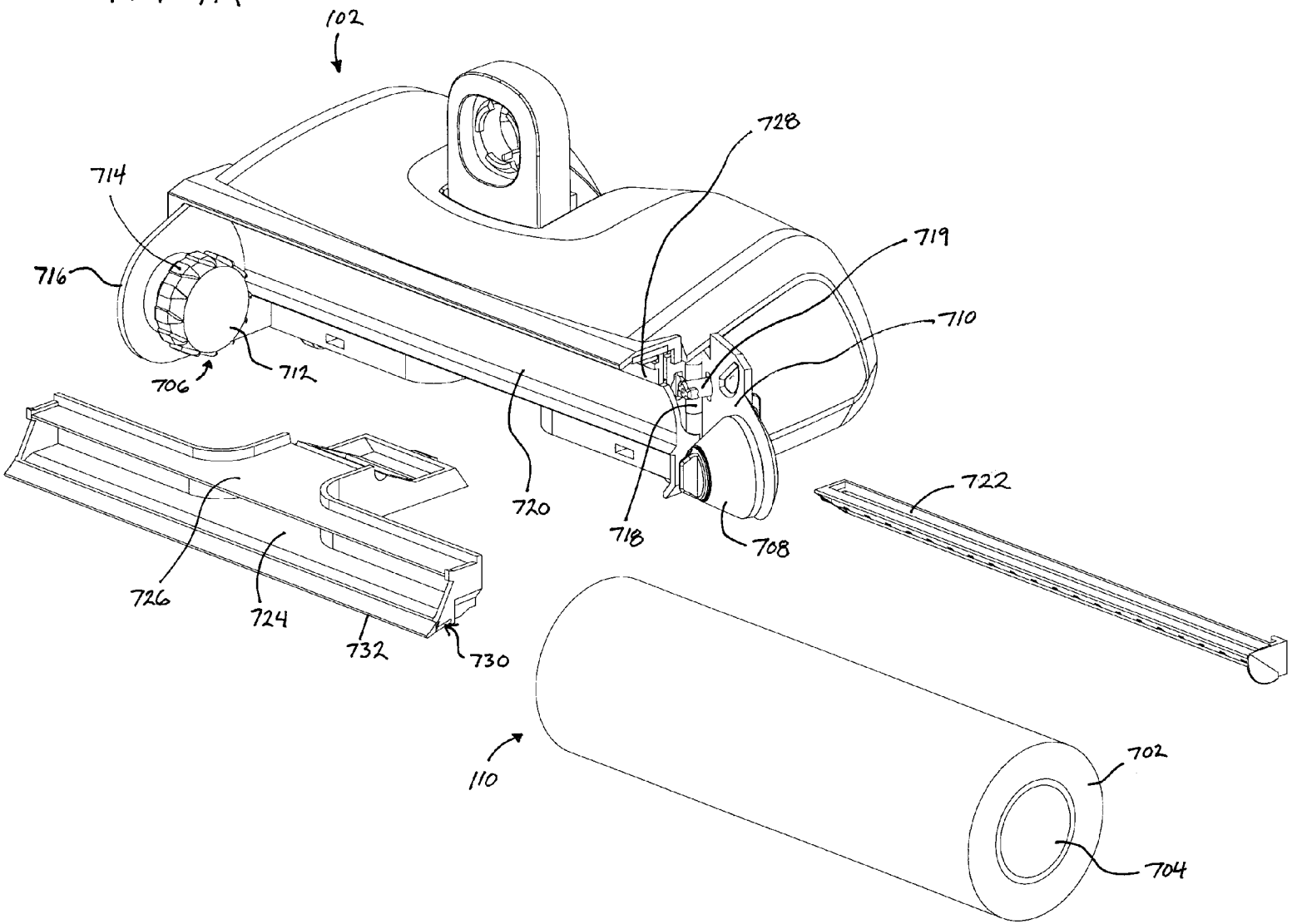
FIG. 7A is a partially exploded front isometric view of an exemplary embodiment of a cleaning head showing the agitator, fluid distribution device and inlet tray removed therefrom.

Referring now to FIG. 7A, the agitator 110 may be a generally cylindrical device that is rotatably attached to the front of the cleaning head 102. The agitator 110 is rotated by the motor 412, and engages a surface for cleaning and/or removing fluid and/or debris therefrom. The agitator 110 preferably is rotated such that the upper surface moves away from the device, and the lower surface moves towards the device. But the motor 412 or gearbox 414 may be adapted to operate in the reverse direction either intermittently or permanently. An electric circuit, clutch (not shown) or other suitable mechanism may be provided to cease operation of the agitator 110 when it is desired by the user, or to prevent potentially dangerous or damaging situations. For example, a clutch may be provided within the agitator 110 to allow it to slip when a user's fingers or hair become entangled in the agitator 110. As another example, an electric circuit may be provided to measure the motor current and stop the motor if a predetermined current threshold is crossed, as can happen when an electric motor is locked. Other agitator 110 cutoff mechanisms and means will be apparent to persons of ordinary skill in the art in view of the present disclosure.

In an exemplary embodiment, the agitator 110 may comprise a foam cylinder 702 that is attached to a relatively rigid inner tube 704 or bar that provides the foam cylinder 702 with strength and rigidity. In use, the foam cylinder 702 may absorb fluid from the surface and may sweep debris and unabsorbed fluid into the cleaning head 102 for removal. The foam layer also may be compressed by the weight of the cleaning head 102 or forces generated by the user, which may increase the area of contact and improve the likelihood of capturing and/or absorbing debris and fluid. In other embodiments, the agitator 110 may comprise a hollow or solid spindle having one or more bristles, flaps, bumps, fingers or other devices adapted to help clean surfaces such as carpets, floors and the like. The device 100 also may be provided with multiple interchangeable agitators that are suited for particular cleaning tasks. Further, while the illustrated agitator 110 is adapted to rotate about a horizontal axis, this configuration may be replaced by an arrangement in which one or more brushes or rollers rotate about axes other than horizontal, such as a vertical axis.

Where the agitator 110 is provided as a foam cylinder 702, the outer surface of the agitator 110 may be smooth, or may have ridges, bumps or other surface features. The agitator 110 also may be provided with regions along its longitudinal axis having different properties. For example, the ends of the foam cylinder 702 may comprise a more rigid material that is better-suited for cleaning in corners or in grout lines. As another example, the foam cylinder 702 may have regions having different materials, and these regions can be interspersed along the length of the cylinder 702, around the cylinder's circumference, or in other patterns. The different materials may have different rigidities, different porosities, different chemical compositions, or other variations that distinguish them. The agitator 110 also may be formed with radial regions having different properties, such as by being formed of dissimilar concentric foam cylinders. For example, the agitator 110 may have an outer, open-cell foam layer that is provided over an inner, closed-cell foam layer. The outer, open-cell layer absorbs fluids from the surface being cleaned, and the inner, closed-cell foam layer adds compliance and compressibility to the agitator 110 but does not absorb a significant amount of fluid. This arrangement prevents the agitator 110 from becoming deeply saturated with fluids.

Other features that may be used with a foam cylinder 702 include pre-impregnated detergent, wax, shampoo, and the like, which may be applied to the foam by the user or by the manufacturer before use. A foam cylinder 702 or other agitator 110 also may include a visual wear indicator, such as an inner layer having a different color than the outer layer to indicate when the outer layer is worn away, or a pigment that wears off with after a number of use cycles. The agitator 110 also may include a combination of foam regions, bristles, flaps, bumps, or other cleaning implements or structures. Other variations on agitators 110 will be appreciated by those of ordinary skill in the art in view of the present disclosure.

As suggested above, a foam cylinder 702 used with the device may comprise one or more of various materials. For example, the foam may comprise one or more of: microfiber, polyurethane, polyester, Bulpren and/or Filtren (polymeric foam materials), and/or or other hydrophilic or hydrophobic materials. An exemplary Bulpren agitator 110 may have 60, 75, or 90 pores per inch (PPI), and other porosities within or outside the range of 60-90 PPI also may be used. An exemplary Filtren agitator 110 may have a PPI of 60, but again, other porosities also may be used. Hydrophobic materials, such as Filtren, may permit easier removal of fluids absorbed therein due to their hydrophobic characteristics. Hydrophilic materials, such as Bulpren, may be more absorbent to provide better fluid pick-up. A foam cylinder 702 also may comprise a tear resistant material, or have reinforcement inserts or layers comprising tear resistant materials, to reduce wear and the likelihood of catastrophic destruction during normal use.

Figure 8:
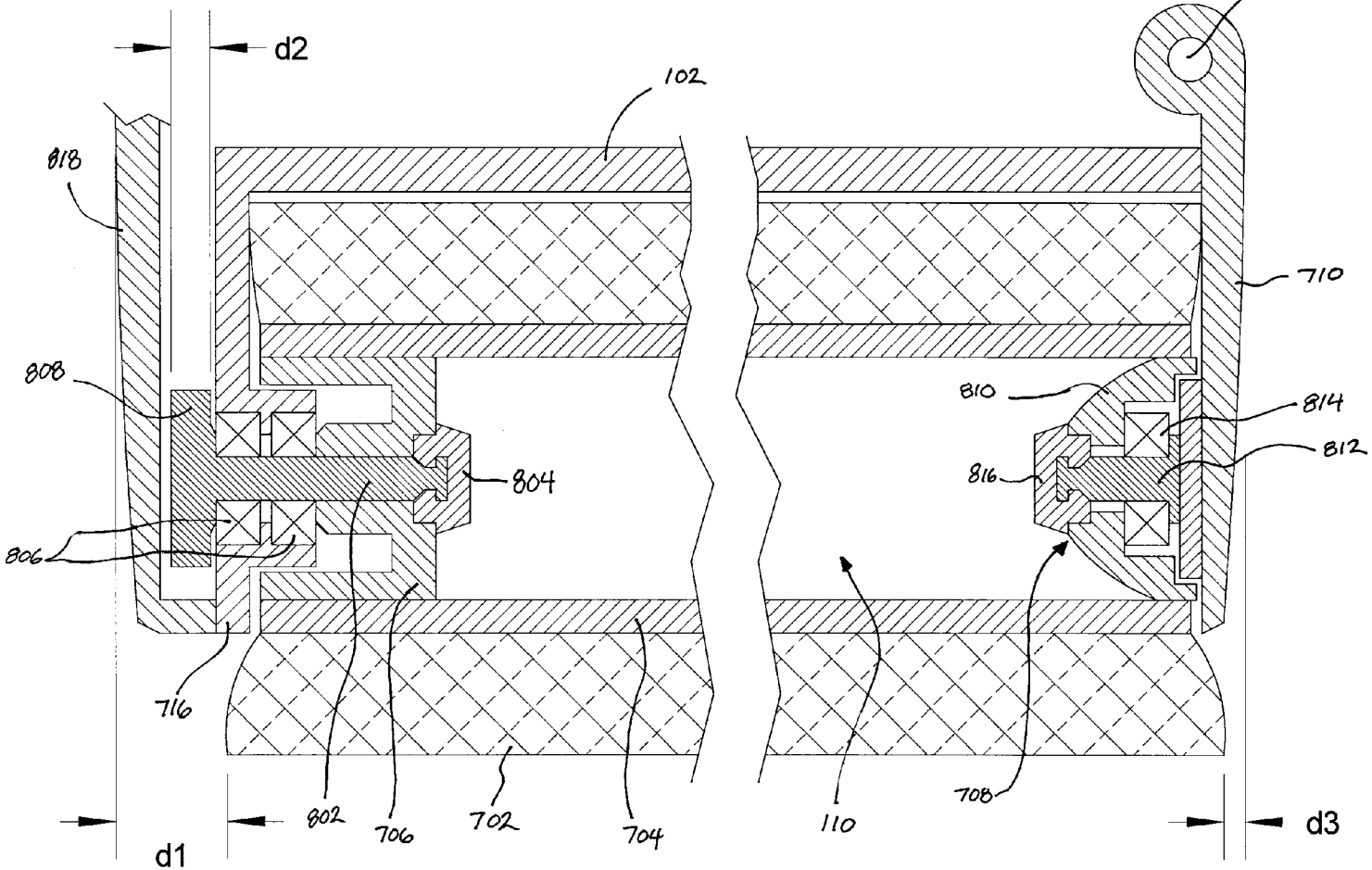
FIG. 8 is a cutaway plan view of an embodiment of a cleaning head showing an exemplary agitator mounting system thereof.

The agitator 110 may be mounted to the cleaning head 102 by any suitable rotating mounting devices or means. For example, as shown in FIGS. 7A and 8, the cleaning head 102 may include a drive gear 706 over which one end of the agitator's tube 704 fits, and a rotating mount 708 over which the other end of the tube 704 fits. The rotating mount 704 may be mounted on an agitator door 710 that rotates on a pivot 718 or otherwise can be manipulated or moved to allow the agitator 110 to be installed or removed.

Figure 9:
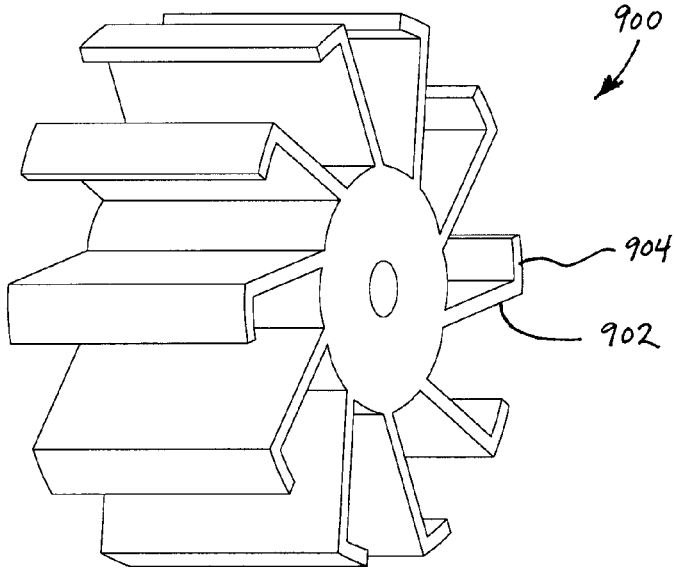
FIG. 9 is an isometric view of an exemplary embodiment of an agitator drive gear.

The drive gear 706 may comprise any device that forms a driving interface with the agitator 110. As shown, the exemplary drive gear 706 may be a rotatably mounted cylinder 712 having splines 714 that engage corresponding splines that may be formed on the inside of the agitator tube 704. FIG. 9 illustrates another exemplary embodiment of an agitator drive gear 900 in which the splines are replaced by multiple flexible arms 902 over which the agitator tube 704 is slid. The flexible arms 902 hold and drive the agitator 110. Each arm 902 may terminate at a contact pad 904 that engages the inner surface of the agitator tube 704. The flexible arms 902 extend radially, or they may be canted towards the direction of rotation (as shown by the arrow) or away from the direction of rotation. When used with an agitator tube 704 having a smooth inner wall, the arms 902 may be configured to slip on the inner wall when the drive torque exceeds a predetermined value, which may be useful to act as a safety device. This function may be particularly available where the flexible arms 902 are canted away from the direction of rotation. The size of the contact pads 904 may be varied to increase or decrease the friction available to drive the agitator 110.

In other exemplary embodiments, the drive gear may comprise a simple cylinder that fits within the agitator tube 704, or the drive gear may comprise other suitable shapes or devices. The agitator drive gear also may include a mechanical fastener, such as, a screw, that attaches the agitator 110 to the agitator drive gear. Other drive gear-to-agitator interfaces may be used, as will be appreciated by those of ordinary skill in the art. In addition, in any of the foregoing embodiments, one or both of the agitator tube 704 and the drive gear may be made with a smooth surface to provide the possibility of slipping if the driving torque becomes too great.

As noted above, the agitator 110 is held at a second end by a rotating mount 708. The rotating mount may comprise a bearing, a bushing, a pin, or any other device that can rotatably hold the second end of the agitator 110. In the shown exemplary embodiment, the rotating mount 708 may comprise a mount body 810 that is rotatably mounted on a fixed pin 812, which, in turn, is rigidly attached to the agitator door 710. One or more bearings 814, bushings or other rotating mounts may be used to provide a rotating attachment between the mount body 810 and the fixed pin 812. The mount body 810 may be retained on the fixed pin 812 by any suitable attachment, such as a clip 816 that fits into a corresponding groove on the pin 812. Of course other mechanisms may be used to retain the mount body 810. For example, the fixed pin 812 may be replaced by a screw that passes through the mount body 810 and engages threads on the agitator door 710. Other embodiments of rotating mounting devices for both the rotating mount 708 and the drive gear 706 will be readily appreciated by persons of ordinary skill in the art in view of the present disclosure.

The mount body 810 may have any suitable shape to hold the end of the agitator 110, and may be splined or otherwise configured to engage the agitator 110. In the exemplary embodiment, the mount body 810 has a conical or slightly bulged conical shape that helps the mount body 810 clear the agitator tube 704 when the agitator door 710 is swung open or closed on its pivot 718. Holes or slots (not shown) may be formed in the mount body 810 to reduce weight or the total contact area between the mount body 810 and the agitator 110. Where the agitator door 710 is not used, or where the door 710 is constructed to be pulled in a linear direction from the cleaning head 102, the mount body 810 may be cylindrical or have other shapes.

Figure 7B:
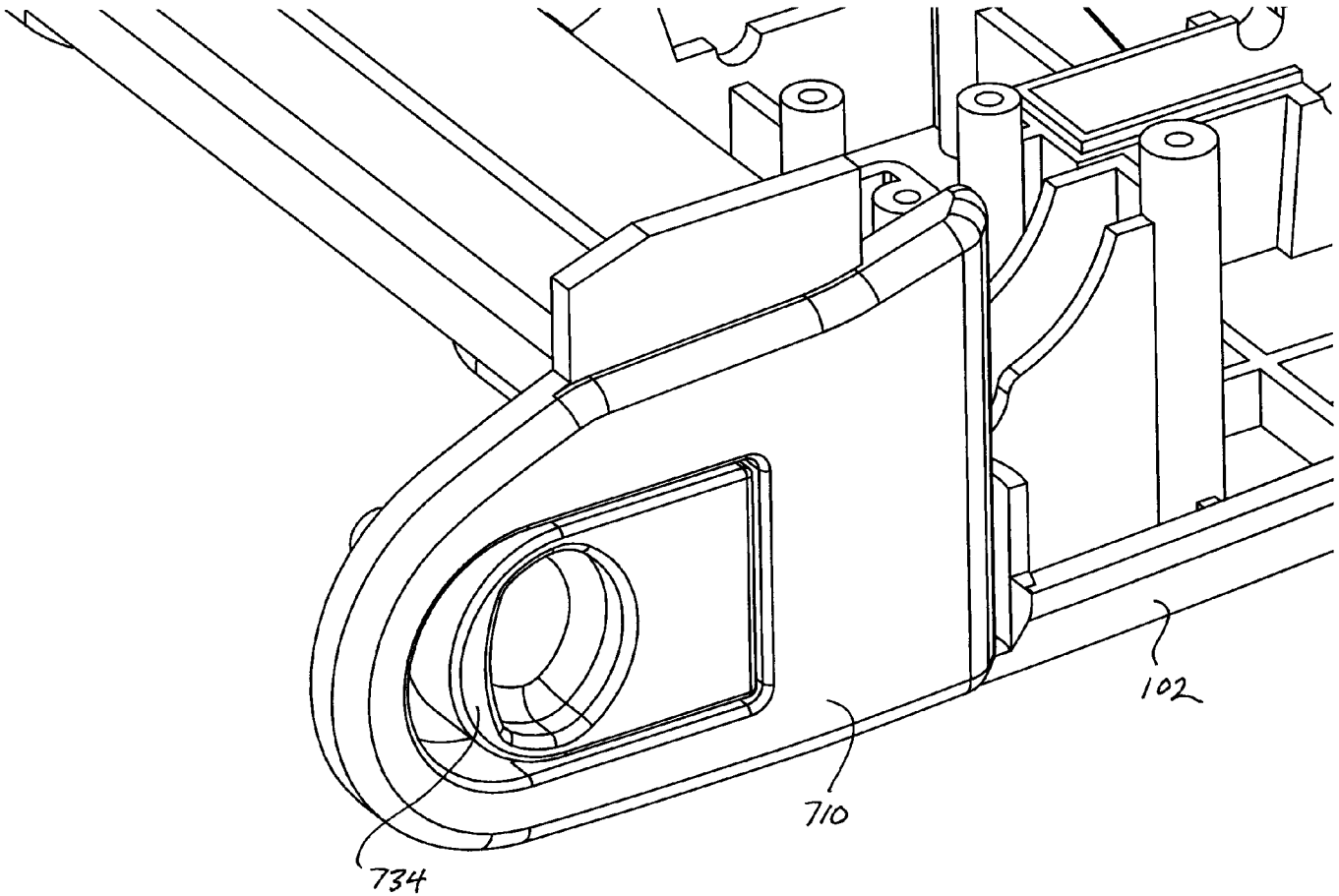
FIG. 7B is a fragmented front isometric view of an exemplary embodiment of an agitator door mechanism shown in the closed position.
Figure 7C:
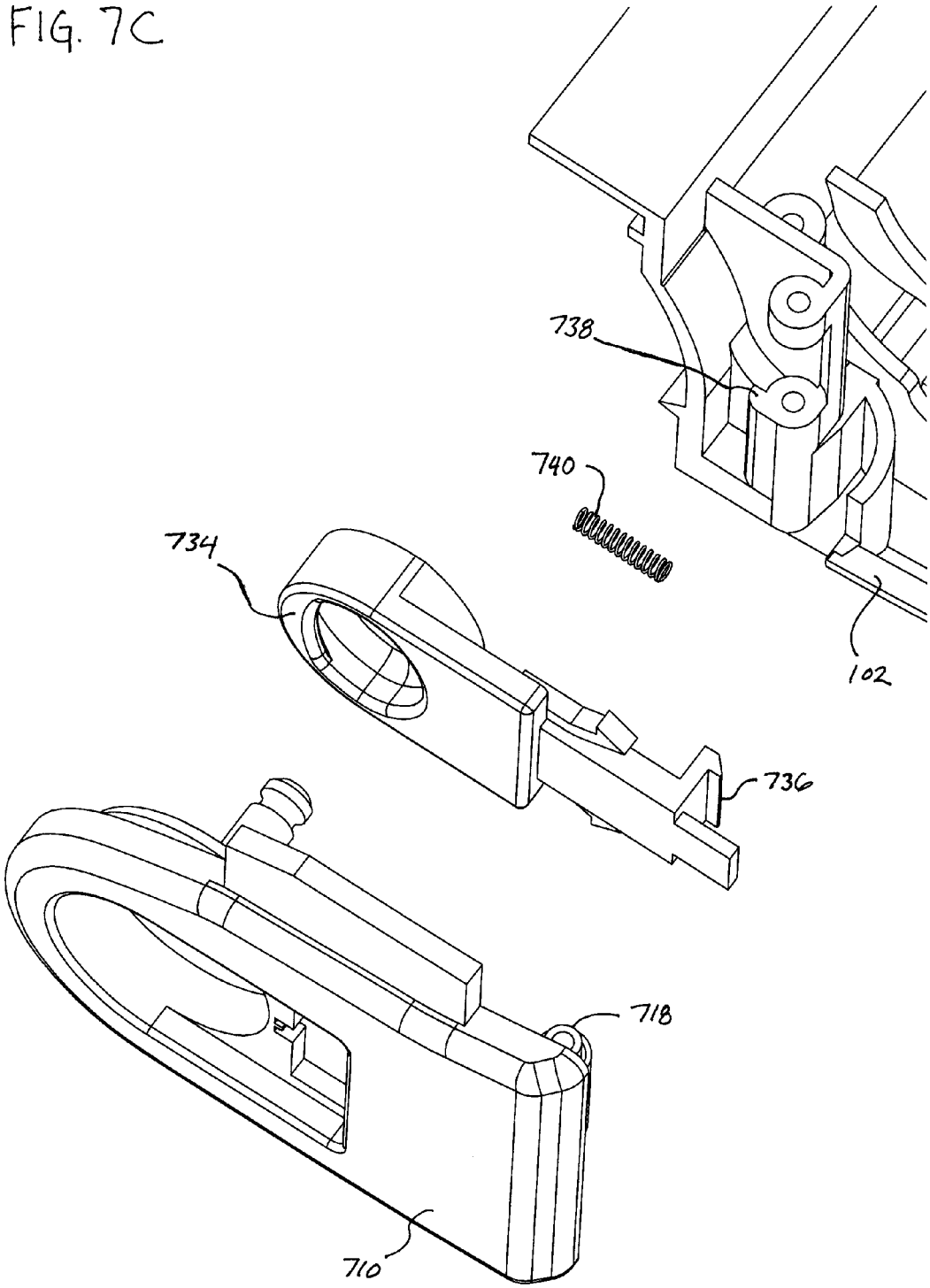
FIG. 7C is a fragmented and exploded rear isometric view of the agitator door mechanism of FIG. 7B.

As noted above, the exemplary agitator door 710 is pivotally mounted to the cleaning head 102 by a pivot 718. The agitator door 710 may include one or more coupling devices that secure the agitator door 710 to the cleaning head 102. As shown in FIG. 7A, the coupling device may be a quarter-turn fastener 719 that engages a slotted hole upon being turned about 90 degrees, and snaps into place in the engaged position. In another exemplary embodiment, shown in FIGS. 7B and 7C, the agitator door 710 may have a latch 734 that is mounted to the inside of the agitator door 710 such that it can slide along the door to engage a hook 736 with a corresponding tab 738 on the cleaning head 102, and thereby lock the agitator door 710 closed. A spring 740 or other resilient device may be provided between the latch 734 and the agitator door 710 to bias the hook 736 into engagement with the tab 738. The hook 736 and tab 738 may be provided with ramp-like shapes to automatically move the hook 736 against the spring 740 to allow the agitator door 710 to be closed without having to operate the latch 734.

It will be understood that any other suitable device may be used to lock the agitator door 710. Examples of such devices include: magnets provided on the agitator door 710 and/or the cleaning head 102 to attract to one another or to a metal plate; clips (such as a spring-operated clip or a flexible tab); adhesive materials; hook and loop fasteners (such as Velcro™); threaded fasteners and/or other suitable attaching materials or devices. The agitator door 710 may also include a lockout device that prevents the agitator motor 412 or the entire device from operating when the agitator door 710 is not closed. For example, the agitator door 710 may, when it is fully closed and latched shut, close the contacts on a microswitch that electrically connects the motor 412 to the power source. Such a lockout device may also be provided to prevent operation when an agitator 110 is not mounted to the cleaning head 102.

Other mounting arrangements may be used instead of the illustrated embodiments to retain the agitator 110 to the cleaning head 102. For example, the drive gear 706 and/or the rotating mount 708 may be axially movable on a spring-biased shaft such that the user can push or pull them out of the way to insert the agitator 110, and, once released, they will snap back into place to capture the agitator 110. As another example, the agitator 110 may be configured like a conventional brushroll having bearings mounted into each end, in which case it may be mounted by sliding the bearings into corresponding mounts on the cleaning head 102. In this embodiment, the agitator 110 may be driven by a belt that wraps around a pulley formed or mounted on the agitator 110. Other embodiments will be apparent to persons of ordinary skill in the art in view of the present disclosure. Despite the usefulness of such alternative embodiments, it may be preferred to provide the agitator 110 without its own bearings and without relatively expensive features that would unduly increase the cost of replacement agitators.

Figure 10:
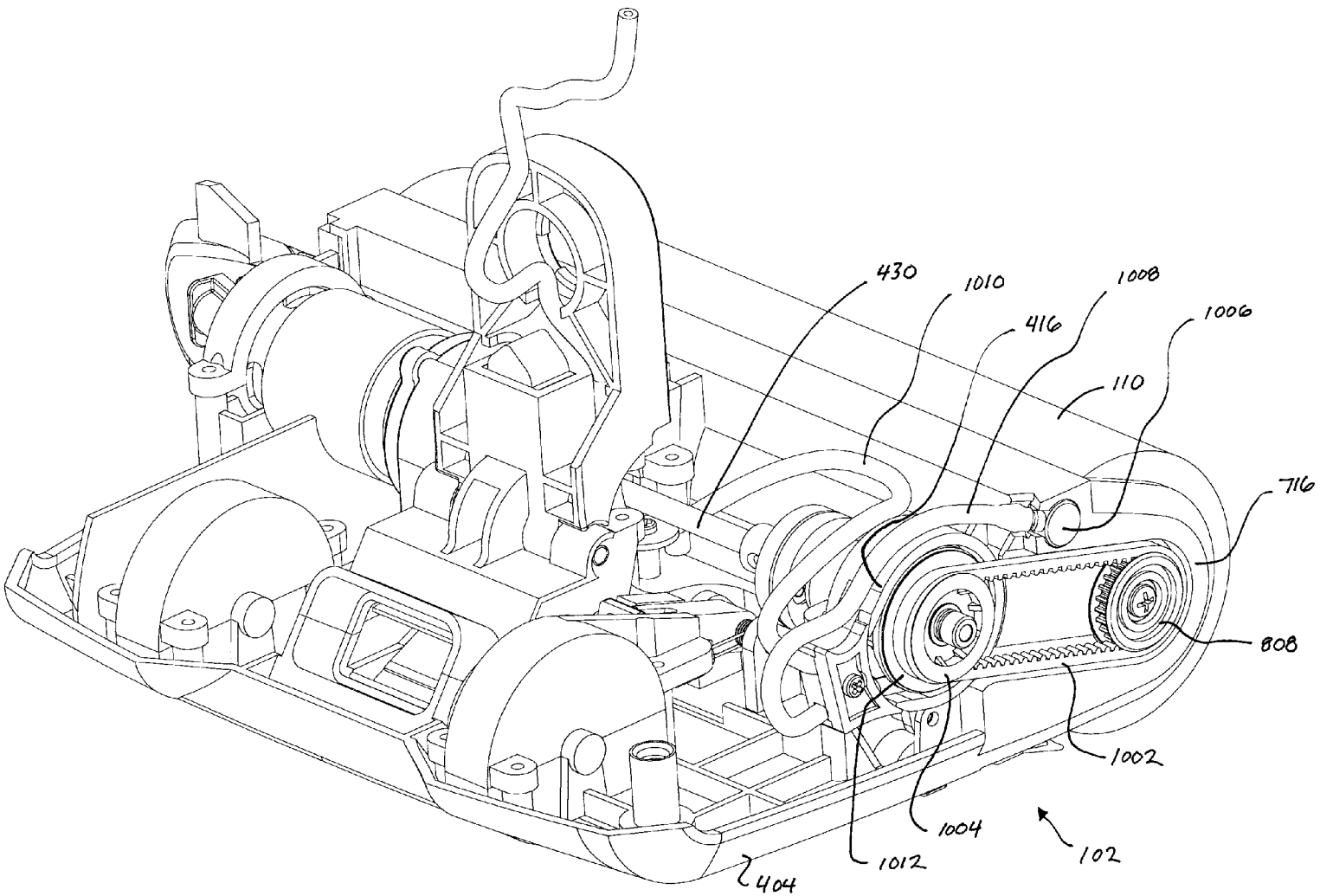
FIG. 10 is a rear isometric view of an exemplary embodiment of a cleaning head, shown with its top cover removed to reveal exemplary pump and drive features located therein.

Referring now to FIGS. 7, 8 and 10, the drive gear 706 may be rotatably mounted and driven by any suitable mechanism or mechanisms. In the illustrated exemplary embodiment, the drive gear 706 is affixed to a drive pin 802, and the drive pin 802 is mounted to a flange 716 that extends forward from the cleaning head 102. Any suitable fastener may be used to attach the drive gear 706 to the drive pin 802. For example, it may be mounted by a clip 804 that holds a corresponding annular groove on the drive pin 802, by press-fitment, by a screw, or by molding the drive gear 706 over the drive pin 802 or integrally with the drive pin 802. Where the drive gear 706 and the drive pin 802 are separate parts, they may be shaped to prevent relative rotation, such as by forming a keyway on the drive pin 802 and a corresponding protrusion or flat portion on the drive gear 706 to engage the keyway.

The drive pin 802 is mounted to the flange 716 such that it can rotate about the axis of the agitator 110. For example, the drive pin 802 may be mounted by passing it through one or more bearings 806, bushings, or the like. The drive pin 802 may be driven by a belt-driven gear 808 located at the end opposite the drive gear 706, or by other driving mechanisms. As shown in FIG. 10, the belt-driven gear 808 may be rotated by a belt 1002 that is driven by a driving gear 1004. The driving gear 1004 may be driven by a dedicated motor, but in the shown exemplary embodiment it is driven by a drive shaft 430 that also operates the pump 416. The driving gear 1004 and the belt-driven gear 808 may be sized to rotate the agitator faster or slower than the driving gear 1004, and intermediate gears or other speed-changing devices may be used between the drive shaft 430 and the agitator 110. If separate operation of the pump 416 and agitator 110 are desired, a clutch (not shown) may be provided to selectively operate one or both of the pump 416 and the agitator 110 off the drive shaft 430, or separate drive arrangements may be provided.

Referring specifically to FIG. 8, it has been found that the dimensions of the cleaning head 102, agitator 110, and the agitator mounting and driving features can be sized to improve the ability of the cleaning head 102 to operate in tight corners between the floor and the wall and between adjoining walls. One way of improving such performance is to minimize the distance d1 between the agitator 110 and the outer surface of the drive gear cover 818 that encloses the agitator driving gears 808, 1004. To reduce distance d1, the width d2 of the drive belt 1002 and the associated gears 808, 1004 can be minimized, and the cover 818 can be made as thin as possible without risking undue fragility. In an exemplary embodiment, the distance d1 may be 8 millimeters (mm), and the width d2 of the belt 1002 and drive gears 808, 1004 may be 4 mm. Of course, in other embodiments, the widths d1 and d2 may be smaller or larger, as desired, or as limited by the torque-transmitting characteristics of the drive equipment.

Similarly, the corner-cleaning performance of the end of the agitator opposite the drive gear can be improved by reducing the distance d1 between the end of the agitator 110 and the outer surface of the agitator door 710, or whatever alternative structure is used to hold the end of the agitator 110. Distance d1 can be reduced by making the agitator door 710 or its replacement structure as thin as possible, and by extending the foam cylinder 702 beyond the edge of the agitator tube 704. In the latter case, the end of the foam cylinder 702 may contact and be compressed by the agitator door 710 during each rotation, but spring back to extend beyond its compressed position once it reaches the floor. In the foregoing embodiment, the engagement of the agitator 110 against the agitator door 710 permits the agitator 110 to be positioned very close to an obstacle during operation, which can help remove debris and/or fluid near the intersection of the floor surface with a wall and/or piece of furniture. In an exemplary embodiment, the distance d3 may be less than 1 mm. Of course, in alternative embodiments, the distance d3 may be larger or smaller, as desired or necessitated by other factors. While the foregoing practice may increase wear on the edge of the agitator 110 that contacts the agitator door 710, the door 710 may be constructed with a smooth surface to minimize friction, and the wear may be negligible.

Figure 11:
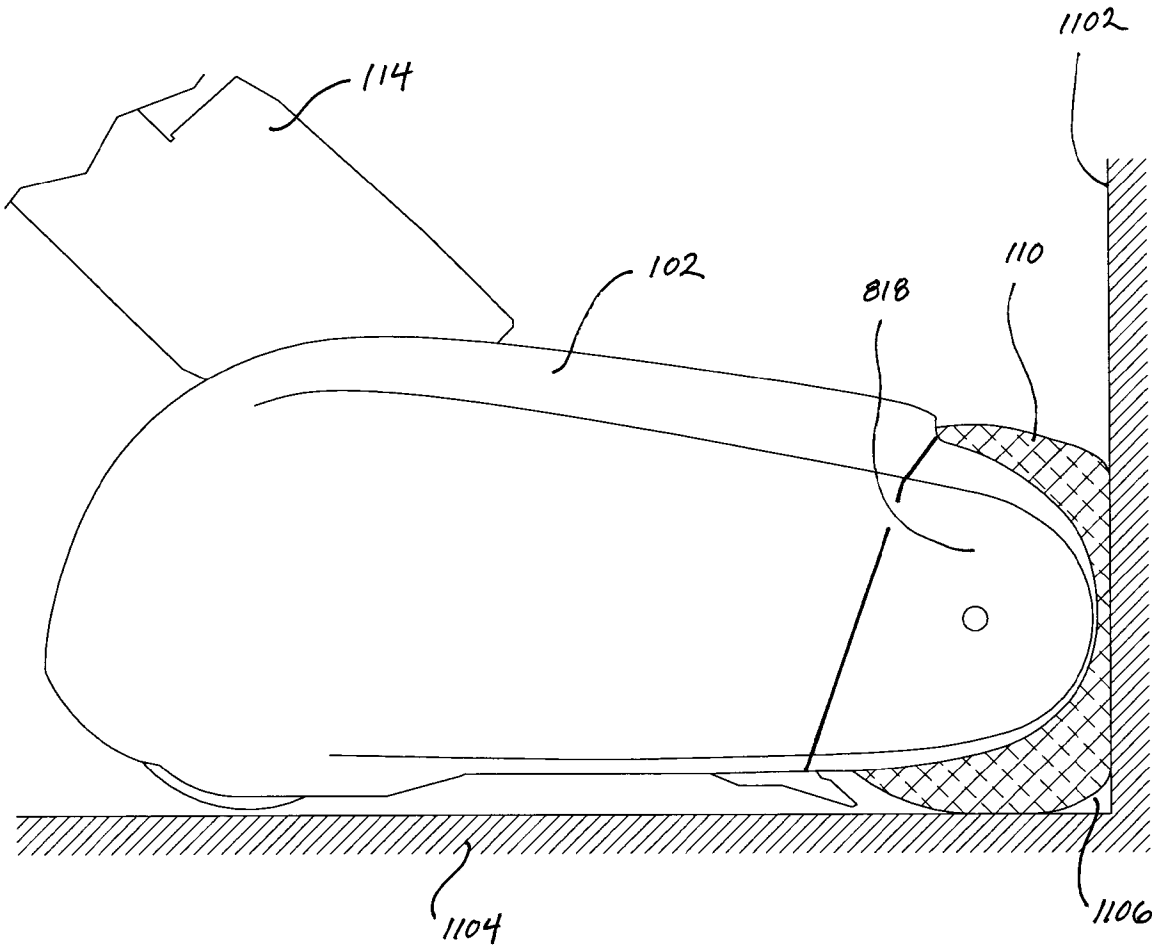
FIG. 11 is a side view of an exemplary embodiment of a cleaning head, shown in one mode of operation.

Turning to FIG. 11, another dimension to consider for improving corner-cleaning performance is the forward reach of the drive gear cover 818 and, on the other side of the cleaning head 102, the agitator door 710. As shown, an embodiment of a cleaning head 102 may be pressed directly into a wall 1102, in which case the agitator 110 will conform to the wall 1102, thereby allowing the agitator 110 to clean more of the floor 1104. Depending on the conformability of the agitator 110 and the size of the drive gear cover 818 and agitator door 710, operating the cleaning head 102 in this manner may allow the agitator 110 to clean the floor 1104 up to the wall 1102, or to leave only a small portion 1106 uncleaned. To enhance this kind of cleaning, the forward reach of the drive gear cover 818 and agitator door 710 may be reduced, to allow as much of the agitator 110 as possible to abut the wall 1102. Of course, if the amount of uncleaned space 1106 is too great, the cleaning head 102 may be rotated 90 degrees to operate parallel to the wall 1102, which may allow cleaning closer to the corner. While the foregoing method of operation may be useful to clean the floor 1104, and even part of the wall 1102, it may be desirable to place a cover (not shown) over the top and/or front of the agitator 110 to prevent direct contact between the agitator and walls 1102 or other upright objects.

To further enhance the agitator's corner-cleaning characteristics, the cleaning head 102 may be provided with furniture guards comprising rubber or other suitable non-marking material to reduce impacts and damage that may occur if the cleaning head 102 strikes a wall, furniture, or other objects near the surface being cleaned. Such furniture guards may be attached to the cleaning head housing, or formed as part of the housing by overmolding or by forming the housing itself from an impact-reducing and/or non-marking material.

Turning back to FIG. 7A, the agitator 110 may be mounted in a concave portion of the cleaning head 102 that forms an agitator chamber 720. The agitator chamber 720 may be relatively shallow, as shown, or it may more fully encase the agitator 110. As shown, the agitator chamber 720 also may include other devices, such as a fluid distributor 722, a debris inlet 724, and a fluid inlet 726.

An exemplary fluid distributor 722 may be positioned to dispense cleaning fluid onto an outer surface of the agitator 110. In other embodiments, however, the fluid distributor 722 instead may apply the fluid directly to the surface in front of or behind the agitator 110. In the embodiment of FIG. 7A, the fluid distributor 722 is located above an behind the agitator's centerline, and in close proximity to or lightly touching the agitator surface. In this embodiment, the cleaning fluid may be applied to the agitator 110 as it rotates, and the agitator 110 conveys the fluid to the surface being cleaned. Such indirect application of the cleaning fluid may provide several advantages. For instance, indirect application applies the cleaning fluid within the confines of the cleaning head 102, in contrast with a spray pump that may spray an area in front of, behind, or to the sides of the cleaning head 102 and could undesirably overspray onto surfaces not being cleaned. Applying fluid to the agitator 110 before depositing it on the surface also may give the fluid an opportunity to distribute itself more evenly across the width of the agitator 110, particularly where the agitator 110 comprises a foam cylinder 702 that can promote such distribution by capillary action. While benefits such as these may be obtainable using indirect application of cleaning fluid, it will be understood that other embodiments may simply deposit the fluid directly on the surface being cleaned, as known in the art.

Figure 12:
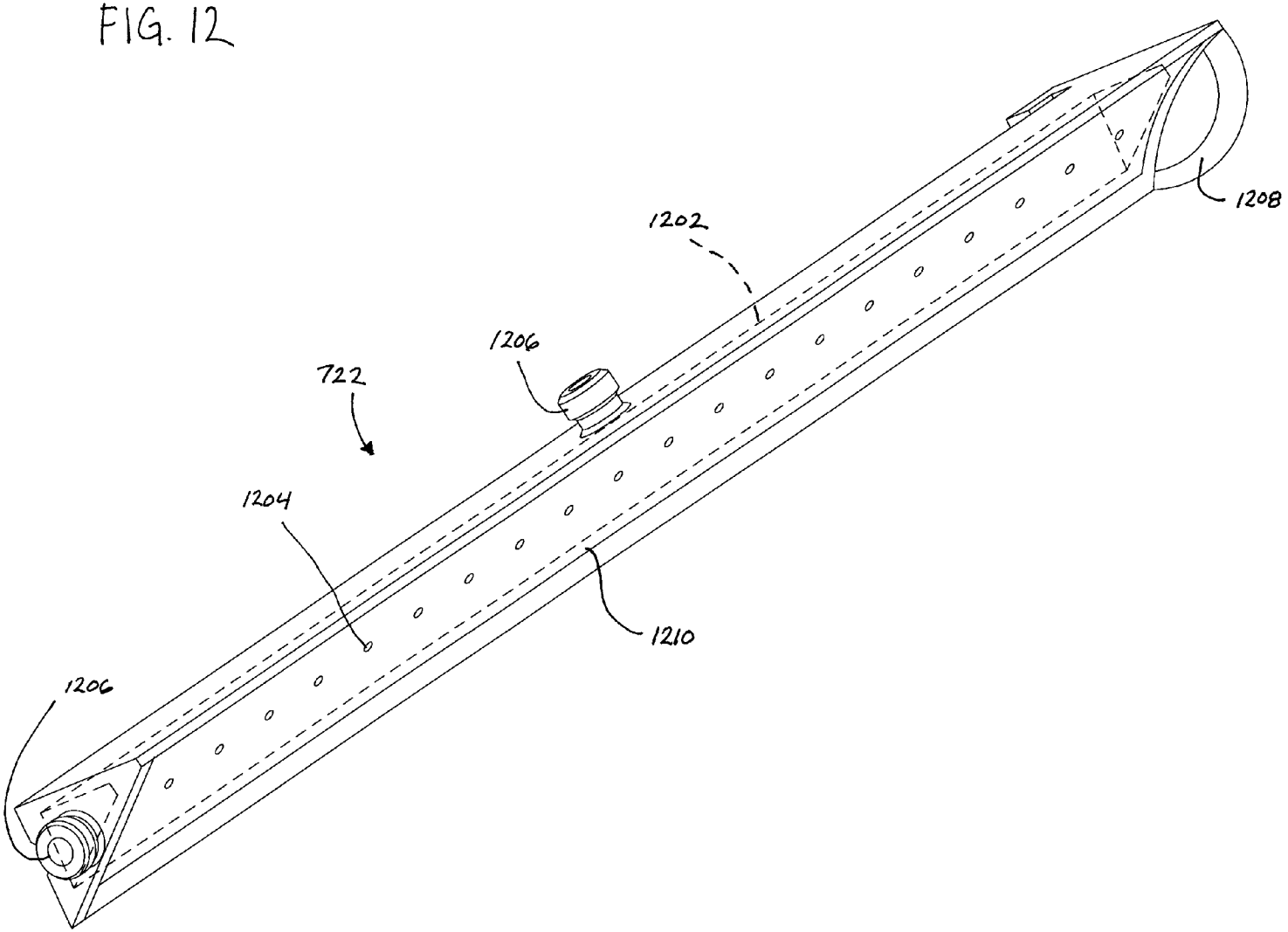
FIG. 12 is an isometric view of an exemplary embodiment of a fluid distributor.

In an exemplary embodiment shown in FIG. 12, the fluid distributor 722 may comprise a removable manifold having an internal channel 1202 that extends partially or entirely across the width of the agitator 110. The internal channel 1202 receives a fluid supply, and passes the fluid through multiple holes 1204 to the agitator 110. The fluid distributor 722 is installed into a slot 728, into which it slides from the side of the cleaning head 102. Referring also to FIG. 10, when the fluid distributor is fully seated in its slot 728, one or more distributor inlets 1206 engage corresponding fittings 1006 (FIG. 10) in the cleaning head 102 to place the fluid distributor 722 into fluid communication with a pump outlet hose 1008, or any other suitable fluid supply device. A finger tab 1208 may be provided at the end of the fluid distributor 722 to facilitate its removal and/or installation, and one or more latches or other securing devices may be provided to hold the fluid distributor 722 in its installed position. For example, the fluid distributor 722 may optionally be covered by the agitator door 710 when the door 710 is closed. In addition, a lockout mechanism may be provided to prevent the device (or portions of the device, such as the pump 416) from operating if the fluid distributor 722 is not properly installed.

Other embodiments may use different constructions, locations or arrangements for the fluid distributor and/or provide multiple fluid distributors. For example, in one embodiment, the fluid distributor may comprise a flexible or rigid hose or tube that extends along part or all of the width of the agitator 110. Such a hose or tube may be inserted into a corresponding slot in the cleaning head 102, or simply may be located in or near the agitator chamber 720 or above the agitator 110. In such an embodiment, it has been found that a plastic hose having about 150-160 holes is suitable for delivering fluid to the agitator 110. The hose may be positioned to lightly contact the agitator 110, which may help keep the holes clear of debris and draw fluid out of the hose by capillary action. Such a tube or hose also may simply be an extension of the pump outlet hose 1008. In another exemplary embodiment, the holes in the fluid distributor 722 may be replaced by or supplemented with a layer of porous material, such as Porex™ porous plastic, available from HLTH Corporation of Elmwood Park, N.J.

In still another exemplary embodiment, the fluid distributor may be formed integrally with the cleaning head. However, doing so may require relatively complex manufacturing steps to produce a distributor having the desired quality, and it may be less expensive to produce a separate fluid distributor, such as the embodiment of FIG. 12 or a separate hose or tube, with a relatively high degree of precision, then install it into the cleaning head 102 as a separate removable or non-removable part. Furthermore, providing the fluid distributor as a separate part allows the user to replace the distributor if it becomes clogged or otherwise fails. In yet another exemplary embodiment, one or more conventional spray nozzles may be used to distribute the cleaning fluid, as known in the art.

A number of the fluid distributor's 722 features may be adjusted in these and other embodiments to help provide relatively even fluid distribution across the agitator 110. For example, while the holes 1204 may be distanced from the agitator 110, they also may be positioned to slightly touch the agitator 110, which may be helpful to help draw cleaning fluid through the holes using capillary action. The use of capillary action in this manner may provide more even fluid distribution, and may help feed fluid when a relatively low-pressure pump or gravity is used to supply the fluid. Where it is desired for the holes 1204 to contact the agitator surface, the surface 1210 of the fluid distributor 722 through which the holes 1204 pass may contact the agitator surface over a large area, or the holes may be positioned on smaller projections that contact the agitator surface over a relatively small area. Also, as shown in FIG. 12, the channel 1202 may be supplied by one or more inlets 1206, and the channel 1202 may be divided into multiple discrete parts to help control the fluid distribution. Other non-limiting examples of variables that may be adjusted and experimented with include: the fluid pressure; the size and shape of the channel 1202; the number, locations, and size of the holes 1202; the positions of the holes 1204; the distance of the holes 1204 from the agitator 110; and so on. In addition, valves or other controls optionally may be provided to allow the user to control where the fluid is distributed across the agitator 110, which may be useful when cleaning along corners and the like.

Figure 13:
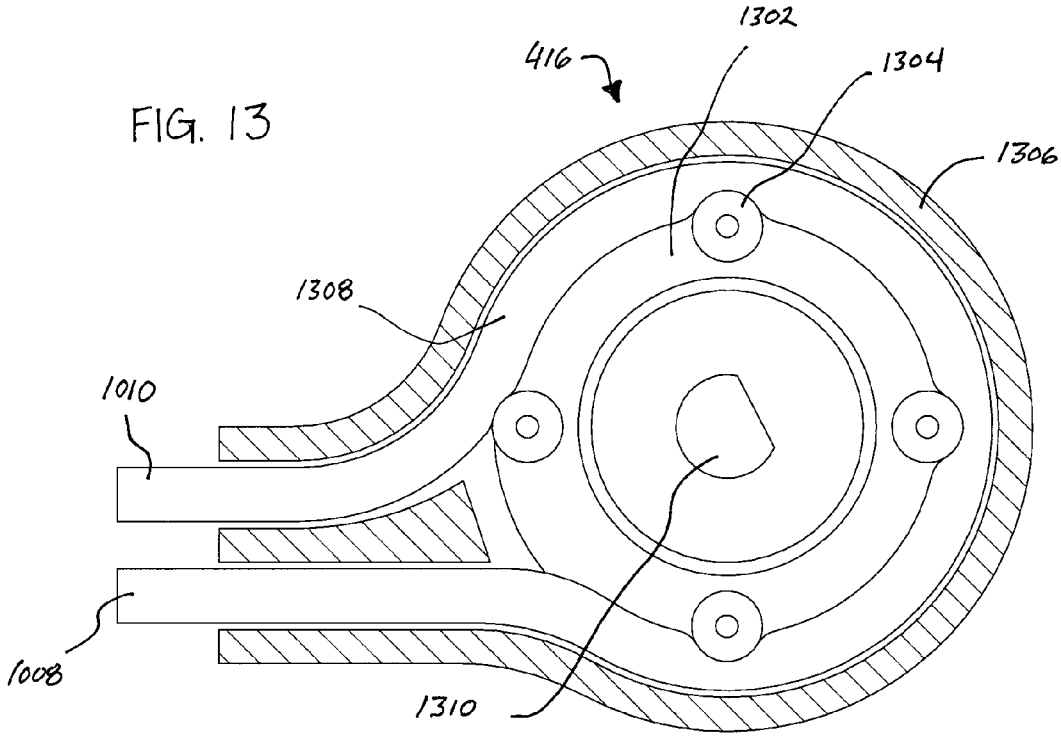
FIG. 13 is a cutaway side view of an exemplary embodiment of a pump.

Turning to FIGS. 10 and 13, any suitable device or technique may be used to convey fluid to the fluid distributor 722. For example, in one embodiment, the device may connect the fluid supply tank 116 to the fluid distributor 722 through a simple tube, and a user-operated valve may be provided to control when fluid is conveyed by gravity to the fluid distributor 722. In another exemplary embodiment the cleaning device may include a pump 416 mounted in the cleaning head 102 or elsewhere on the device. Any suitable kind of pump may be used. For example peristaltic, vane and gear pumps are all suitable. The pump also may include a priming feature or be a self-priming pump. The pump may be operated by an electric motor, a mechanical linkage (such as a linkage driven off of the agitator 110 or a surface-contacting wheel), by hand, or by any other device or means, and such driving mechanism may drive only the pump, or it may drive other devices, such as the agitator 110. In other embodiments, the motor may be removed and fluid can be supplied to the fluid distributor 722 by gravity, under pressure, or by other devices or means. It will also be understood that in other exemplary embodiments, the device may not include any kind of fluid deposition system, and in these embodiments if the user desires to operate the device in conjunction with fluid, the user can deposit such fluids by hand on the surface being cleaned.

The fluid pump 416 is adapted to extract fluid from the fluid supply tank 116 and deliver it to the fluid distributor 722. To do so, the pump 416 may be connected to the supply tank 116 by a pump inlet hose 1010, or located within or adjacent the supply tank 116 to possibly eliminate the need for an inlet hose. In the shown exemplary embodiment, the pump 416 is a peristaltic pump that is driven by the same motor 412 that drives the agitator 110, and is also driven at a reduced speed provided by the gearbox 414.

A peristaltic pump may be preferred because such devices typically provide relatively accurate fluid flow, are compact and inexpensive, and are relatively powerful. As shown in FIGS. 4 and 10, the pump 416 may be remote from the motor 412 and/or gearbox 414, but is may be mounted directly to one or the other device. As shown in FIG. 13, the pump 416 may be a conventional peristaltic pump having a gear 1302 having one or more lobes or pins 1304 extending radially therefrom. The pins 1304 rotate with the gear 1302, and may be mounted on separate pivots to allow them to rotate about their own axes. The gear 1302 and pins 1304 rotate within a chamber 1306 in which a flexible hose 1308 is located. The inlet to the hose 1308 is, or is attached to, the pump inlet hose 1010, and the outlet to the hose 1308 is, or is attached to, the pump outlet hose 1008. As the gear 1302 rotates, the pins 1304 press against the hose 1308 and deform it, causing it to convey any fluid in the hose ahead of the deformations. A chamber cover 1012 may be provided to hold the hose 1308 in place. The gear 1302 is mounted on the drive shaft 430, which passes through a keyed, splined or flattened opening in the gear 1302 to prevent the gear 1302 from rotating independently of the shaft 430. As shown in FIG. 10, the agitator driving pulley 1004 and drive belt 1002 may be mounted to the end of the pump 416, providing a compact pumping and driving arrangement.

One or more valves (not shown) may be provided for the user to control the flow of fluid to the peristaltic pump. For example, a valve may be provided to cut off flow through the pump inlet hose 1010 to stop fluid deposition. As another example, one or more valves may be provided to cut off flow from the fluid outlet hose 1008 to the fluid distributor 722, and redirect such flow back into the pump inlet hose 1010 or into the supply tank. Other control arrangements will be apparent to persons of ordinary skill in the art in view of the present disclosure.

Figure 14A:
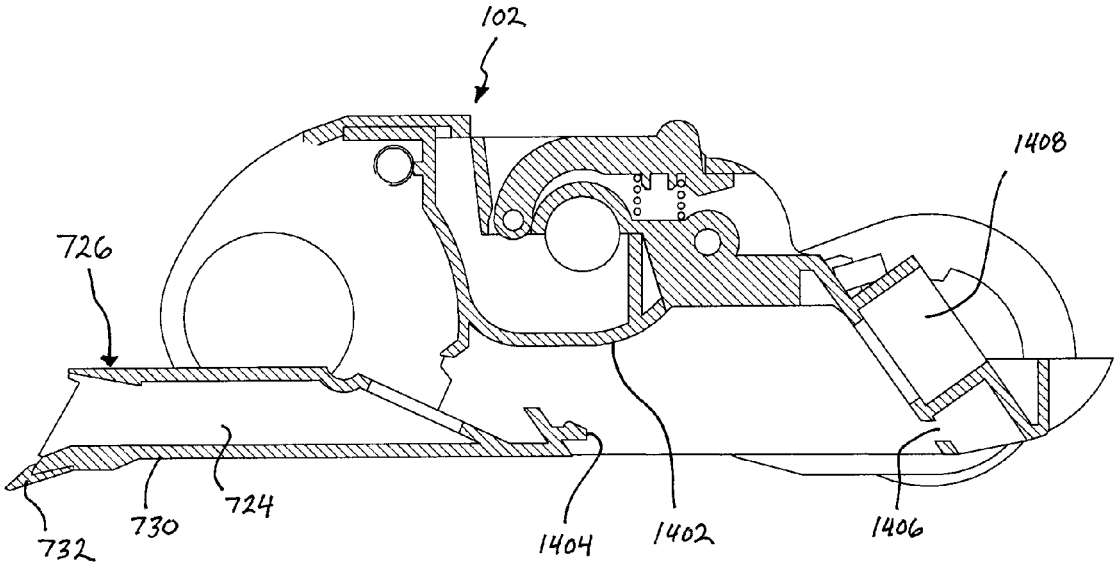
FIGS. 14A and 14B are cutaway side views illustrating the installation of en exemplary embodiment of a removable inlet tray from a cleaning head.
Figure 14B:
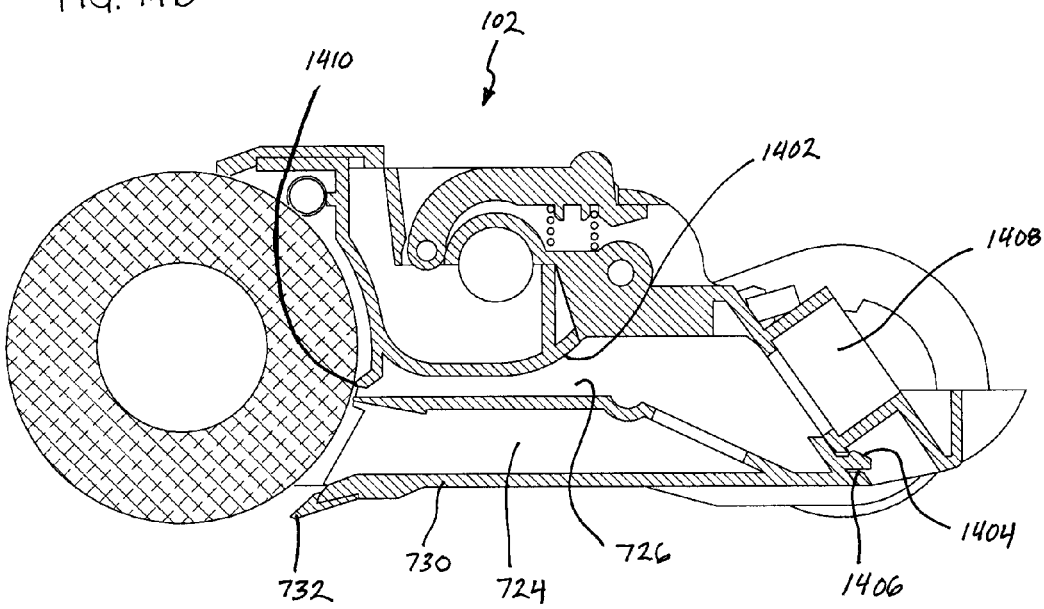

As noted above, the cleaning head 102 may include a debris inlet 724 and a fluid inlet 726. The illustrated fluid inlet 726 is located adjacent and above the debris inlet 724, but this is not required. For example, the fluid inlet 726 may be located on the opposite side of the agitator 110 as the debris inlet 724, or the debris inlet may be moved further back along the cleaning head 102 and generally outside the agitator chamber 720. As best shown in FIGS. 7, 14A and 14B, the debris inlet 724 and fluid inlet 726 comprise air passages through the cleaning head 102 that lead from the area adjacent the agitator 110 to a cleaning head outlet 1408. The cleaning head outlet 1408 is connected by a hose (not shown) to the vacuum source 108, and the recovery tank 118 (or other devices that remove dirt and fluid from the airflow) may be interposed in the air flow path between the cleaning head outlet 1408 and the vacuum source 108. Such a system is often referred to as a "clean air" system. Alternatively, the vacuum source 108 may be located upstream of the recovery tank 118 to provide the working air to the recovery tank under pressure. Such systems are often referred to as "dirty air" systems. Any suitable hose or pipe may be used to join the cleaning head outlet 1408 to the rest of the device, and one or more check valves or other structures (such as a fluid-trapping loop) may be provided to prevent fluid and debris from falling down into the debris and fluid inlets 724, 726 when the vacuum source 108 is deactivated.

The debris inlet 724 has a relatively large area, and the fluid inlet 726 is formed as a narrow slot having a relatively small area. Both inlets 724, 726 may have a funnel-like shape, such as shown in FIG. 7A, as they progress towards the back of the cleaning head 102. The debris inlet 724 allows a larger volume of air, some fluid, and larger objects to pass through it. The lower lip 732 of the debris inlet 724 is spaced from the agitator surface to allow suction and the movement of the agitator to pass larger objects into the debris inlet 724. The fluid inlet 726 is located further along the agitator's rotation (which may be counterclockwise in FIG. 14B), and is provided to remove fluid and smaller debris from the surface of the agitator 110. During operation, the agitator 110 is rotated to scrub and absorb fluids from the surface. As the agitator 110 passes by the debris inlet 724, larger objects and some fluid are removed by the relatively high volume airflow created in the debris inlet 724 by the vacuum source 108. Then, as the agitator 110 passes by the fluid inlet, fluid and smaller debris are removed by the lower pressure airflow created in the fluid inlet 726 by the vacuum source 108.

To improve fluid removal from the agitator 110, the fluid inlet 726 may be located close to the agitator surface, and one or both edges of the fluid inlet 726 may lightly touch the agitator 110. For example, in the embodiment of FIG. 14B, the trailing edge 1410 of the fluid inlet 726 lightly touches the agitator 110. It has been discovered that providing light contact between the fluid inlet's trailing edge 1410 and the agitator 110 can result in significantly higher fluid removal from an agitator 110 formed as a foam cylinder 702. It is believed that this improved fluid removal is a result of the trailing edge 1410 forming an air seal against the agitator surface that concentrates the airflow into the fluid inlet 726. In an alternative embodiment, the trailing edge 1410 of the fluid inlet 726 may be moved a significant distance around the circumference of the agitator 110, rather than being close to the fluid inlet's opening into the cleaning head 102. In another alternative embodiment, the debris inlet 724 and/or fluid inlet 726 may be spaced from the agitator, and include a moveable device, such a flap formed near the fluid inlet's trailing edge 1410, that periodically contacts the agitator 110 when it is desired to enhance fluid removal from the agitator 110. Such a movable device may be operated manually or automatically, and may operate in conjunction with the valve mechanisms described subsequently herein.

In a preferred embodiment, as little contact pressure as possible is created between the trailing edge 1410 and the agitator 110. There are several reasons for this. First, very light pressure does not press water out from the foam and does not create significant drag or wear on the agitator and housing. It is particularly desirable to avoid such drag when the device is battery operated, because additional drag will cause an undesirable increase in power consumption. In addition, using lighter pressure causes little or no deformation of the agitator during storage. Nevertheless, in other embodiments, the trailing edge 1410 or another surface or object may be provided to apply significant pressure to the agitator 110 to force fluid out of it, and such a device may operate at all times, or intermittently.

The debris and fluid inlets 724, 726 may be formed entirely or partially as a removable inlet tray 730. In the exemplary embodiment, the inlet tray 730 forms an enclosed passageway that forms the debris inlet 724, and an open passageway that forms the lower half of the fluid inlet 726. The remainder of the fluid inlet 726 may be formed by walls 1402 of the cleaning head 102. The inlet tray 730 may include tabs 1404 that engage openings 1406 in the cleaning head 102, or other attachment mechanisms or means, such as threaded fasteners, sliding tabs or other latches, and the like. One or more seals (not shown), such as o-rings, gaskets, or resilient overmolded materials, may be provided around the edges of the inlet tray 730 that abut corresponding surfaces of the cleaning head 102 to help seal the debris inlet 724 and fluid inlet 726. In addition, the debris and fluid inlets 724, 726 may include overmolded or soft rubber edges to prevent wear or damages that might be caused by contact with other surfaces or objects. For example, the lower lip 732 of the debris inlet 724 may be formed as an overmolded resilient lip.

A removable inlet tray 730, such as the illustrated embodiment, may be useful to allow the user to remove and clean debris from the debris and fluid inlets 724, 726, but it is not required of all embodiments. Furthermore, the debris and fluid inlets 724, 726 may be separately removable from the cleaning head 102, integral to or not removable from the cleaning head 102, or they may have alternative cleanout features, such as access panels that allow periodic cleanout. Also, the fluid inlet 726 may be formed by an enclosed passageway. If it is expected that the fluid inlet 726 will require cleanout, a sliding knife feature may be provided to slide through the fluid inlet 726 to clear it. Such a feature may be a sliding member that is mounted to the cleaning head 102, or may comprise a separate tool.

In another alternative embodiment, the fluid inlet may be automatically or manually adjustable to accommodate for wear in the agitator 110 or different size agitators 110. In such a case, the fluid inlet preferably can move such that its trailing edge remains in contact with the agitator 110. An example of such an embodiment is illustrated in FIGS. 15A-15C. In this embodiment, a fluid inlet 1500 is provided as an enclosed passage that begins at a narrow inlet slot 1502, and terminates at an outlet 1504. The fluid inlet 1500 is mounted to the cleaning head 102 on one or more pivots 1506 that fit into corresponding openings 1508 in the cleaning head 102. The pivots 1506 and openings 1508 are arranged to allow the fluid inlet 1500 to pivot up and down to allow the inlet's trailing edge 1510 to remain in contact with the agitator 110, even after the agitator 110 has worn down due to use. Once installed, the fluid inlet 1500 may be permanently affixed or removable by the user for cleaning. The outlet 1504 is installed into a passage 1512 that can be connected to the vacuum source 108, and a flexible seal 1514, such as a latex seal, may be provided in the passage 1512 to surround and seal against the fluid inlet 1500. In another embodiment, a wear-accommodating fluid inlet may simply comprise a movable flap that forms the trailing edge of the fluid inlet and rides on the agitator 110. Such a flap may comprise a hinged rigid part, a cantilevered resilient part, or any other suitable device. Such a flap also may be user-replaceable in the event it becomes worn or damaged. Other variations and embodiments of wear-accommodating fluid inlets will be apparent to persons of ordinary skill in the art in view of the present disclosure.

As shown in FIGS. 14A and 14B, the debris inlet 724 and fluid inlet 726 are open to one another at the cleaning head outlet 1408, and therefore the pressure drop and airflow characteristics created by vacuum source 108 are distributed between the debris inlet 724 and fluid inlet 726 at all times. Despite the open communication between the debris and fluid inlets 724, 726, it has been found that a device using this configuration provides satisfactory debris and fluid removal characteristics. This is particularly the case where the device is operated from an electric outlet and the vacuum source 108 can have a relatively high power rating. It is also believed that the device may operate satisfactorily if the fluid inlet 726 is omitted. In such a case, the trailing edge of the debris inlet 724 or some other fixed or movable surface may be adapted to lightly touch the agitator 110 to help improve fluid removal.

While satisfactory performance may be obtained with the debris and fluid inlets 724, 726 in constant fluid communication with one another, in another embodiment of the invention a valve or other device may be provided to periodically or alternately close one or both of the inlets to separate and potentially enhance their performance. An example of such an embodiment is illustrated in FIGS. 16-18B. In this embodiment, the cleaning head 102 includes a debris inlet 1602 and a fluid inlet 1604 that are covered by a valve cover 1606. A portion 1608 of the valve cover 1606 cooperates with a portion 1610 of the lower base housing 1612 to form the cleaning head outlet. The valve cover 1606 also cooperates with the lower base housing 1612 to capture a valve 1614 between them. When so captured, the valve 1614 is mounted by a pivot shaft 1616, which is held between cooperating semicircular surfaces 1618 on the lower base housing 1612 and the valve cover 1606.

The valve 1614 can pivot between a first position in which it covers the debris inlet 1602, and a second position in which it covers the fluid inlet 1604. Alternatively, the valve 1614 may simply uncover and cover one inlet 1602, 1604, while leaving the other inlet open or partially open at all times. For example, where the valve 1614 is adapted to cover and uncover the debris inlet 1602, but not to cover the fluid inlet 1604, little air passes through the fluid inlet 1614 when the debris inlet 1602 is opened because it has a higher resistance to the incoming airflow. It has been found that this arrangement may reduce the complexity of the valve system, while still offering similar or identical suction performance through the debris inlet 1602.

A spring 1620 may be provided to bias the valve 1614 in one direction, such as downwards to cover the debris inlet 1602 to help prevent debris and fluid from descending into the debris inlet 1602 when the device is not in use. While the valve 1614 is shown as a simple flap valve, it may instead be a rotary drum valve, a sliding door, or any other suitable type of valve. The valve may also comprise a flexible wall of one or both inlets 1602, 1604 that is pinched closed when it is desired to cease flow through that inlet. The shown flap valve is expected to provide good performance even if it becomes partially obstructed. In addition, multiple valves may be used instead of a single valve.

The valve 1614 may be operated in any fashion, and by any suitable mechanism or means. In the exemplary embodiment of FIGS. 16-18B, the valve 1614 is operated by a lever 1622, which may be operated by a rear wheel 1624. The lever 1622 is pivotally mounted to the cleaning head 102 by a pin 1626, which arrangement allows the lever 1622 to move between a first position and a second position, such as described below with reference to FIGS. 17A-18B. The lever 1622 may comprise an outer sheath 1628 in which a plunger 1630 is telescopically mounted. As shown in FIG. 17B, a spring 1702 may be provided within the sheath 1628 to bias the plunger 1630 away from the pivot pin 1626, and thereby telescopically extend the lever 1622. A locking pin 1704 may be inserted into the plunger 1630 by way of a slot 1706 through the sheath's sidewall in order to retain the plunger 1630 in the sheath 1628. The plunger 1630 may also include a contact surface 1631 located at its distal end, which surface 1631 may comprise a piece of tactile material, such as a thermoplastic elastomer or polyurethane, that is molded onto, imbedded in, or otherwise attached to the end of the plunger 1630. Variations on the foregoing embodiment will be readily apparent to persons of ordinary skill in the art in view of the present disclosure. For example, alternative telescoping structures may be used for the lever 1622, or the lever may be formed as a flexible beam that can bend, when necessary, to allow it to move between various position.

The end of the plunger 1630 is located adjacent the rear wheel 1624, which is adapted to rotate as the device rolls on the floor. The wheel 1624 may comprise one of the device's support wheels, and it may be movable into and out of engagement with the floor. The wheel 1624 is adapted to move the lever 1622 between its first and second positions depending on the direction in which the wheel 1624 is rotating. Any suitable mechanism may be used for this purpose. For example, in the shown exemplary embodiment, a reversing mechanism, such as a reversing wheel 1632, is mounted to or formed with the rear wheel 1624. The reversing wheel 1632 may comprise a generally circular disk having a number of notches 1634 located around its circumference. As the reversing wheel 1632 rotates, the notches 1634 can catch the end of the lever 1622 and move it up and down, depending on the direction in which the reversing wheel 1632 is rotating. The use of a tactile contact surface 1631 on the end of the plunger 1630 can ensure that the plunger 1630 engages with the notches 1634, and can help prevent damage caused by impact between these parts. A tactile contact surface also (or alternatively) may be located on the surfaces of the notches 1634. The lever's telescoping sheath/plunger arrangement allow the lever to compress slightly as it is being moved between positions. Once the lever 1622 is moved, it will remain in position until the reversing wheel 1632 is rotated in the opposite direction. One or more springs 1636 may be provided to bias the lever 1622 into an upward or downward direction, as desired. For example, the spring 1636 may bias the lever upwards to ensure that the end of the plunger 1630 remains in contact with the reversing wheel 1632 when it is in the lowered position (see FIG. 17B).

The lever 1622 may operate the valve 1614 through any suitable mechanism or means. For example, the lever 1622 may be integrally formed with or rigidly attached to the valve 1616, and the lever 1622 and valve 1616 may pivot about a common axis. In the exemplary embodiment of FIG. 16, the lever 1622 is formed separately from the valve 1614. In this embodiment, a drive pin 1642 is attached to the valve 1614 such that it is offset from the valve's pivot shaft 1616. The drive pin 1642 fits into a drive cup located on the side of the lever 1622. As the lever 1622 is pivoted by the reversing wheel 1632, the drive cup 1644 acts on the drive pin 1642 to rotate the valve 1614. In the shown embodiment, the drive pin 1642 is located on the opposite side of the valve pivot 1616 as the valve 1614, so moving the lever 1622 downwards will move the valve 1614 upwards, and vice versa.

Figure 16:
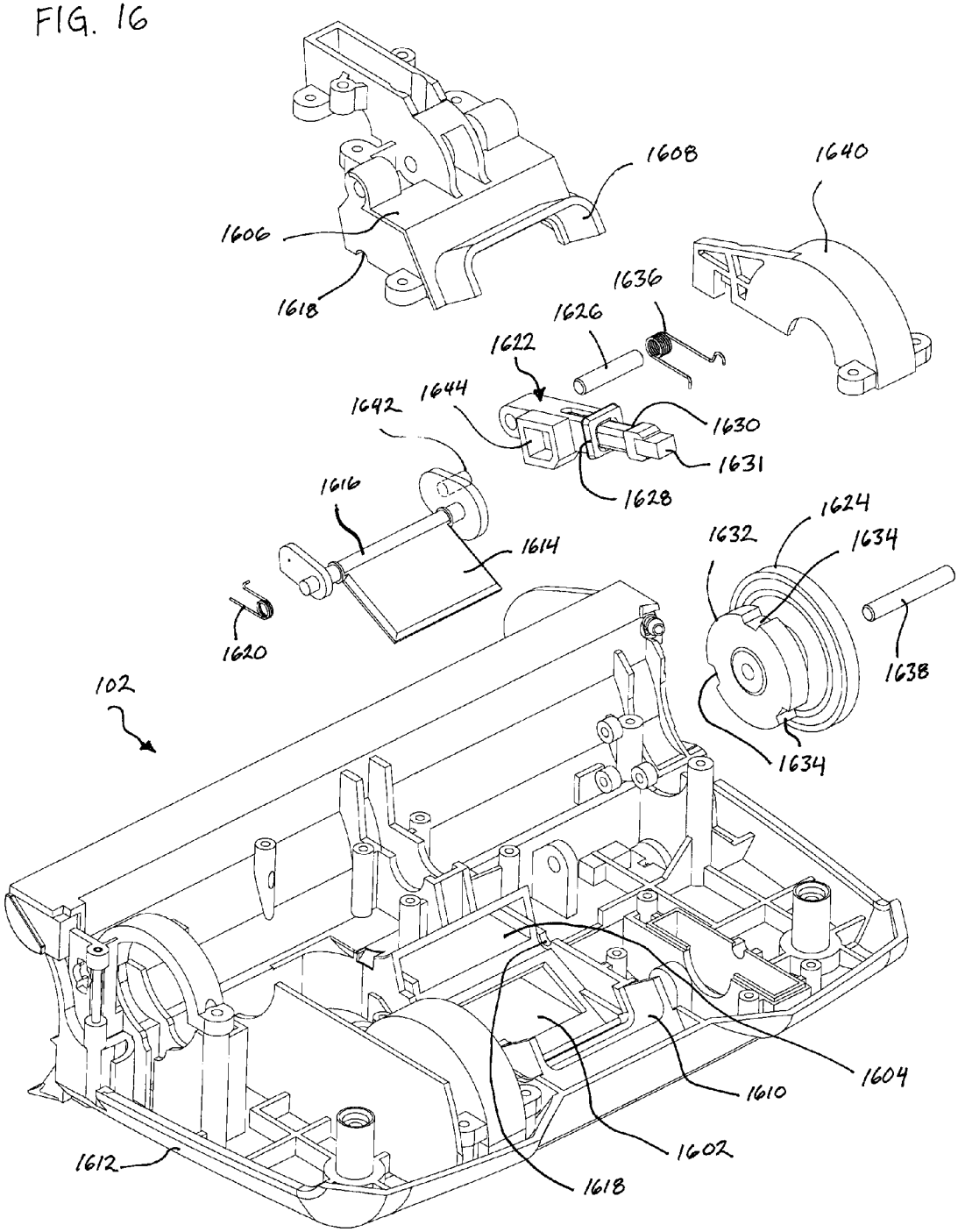
FIG. 16 is a rear isometric exploded view of an exemplary embodiment of a cleaning head, showing exemplary valve features located therein.

As shown in FIG. 16, the rear wheel 1624 is mounted to the lower base housing 1612 by an axle pin 1638, which allows the wheel to freely rotate as the cleaning head 102 is moved back and forth on the floor. To help ensure that the wheel 1624 rotates and operates the valve 1614, the wheel 1624 may include an overmolded or otherwise provided tactile outer surface. Also, the wheel 1624 may be enclosed in a wheel well 1640 that helps isolate the wheel 1624 from the reversing wheel 1632 to inhibit air, dust, fluid, or other debris from entering the cleaning head 102.

Figure 17A:
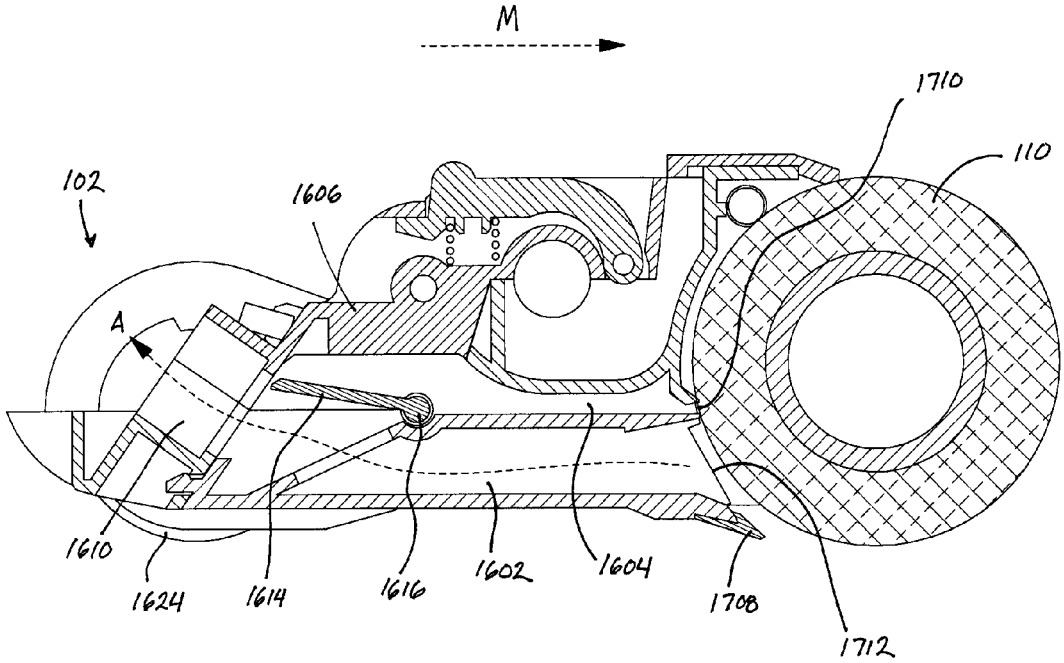
FIG. 17A is a cutaway side elevation view of the cleaning head of FIG. 16, showing the a valve in a first position.
Figure 17B:
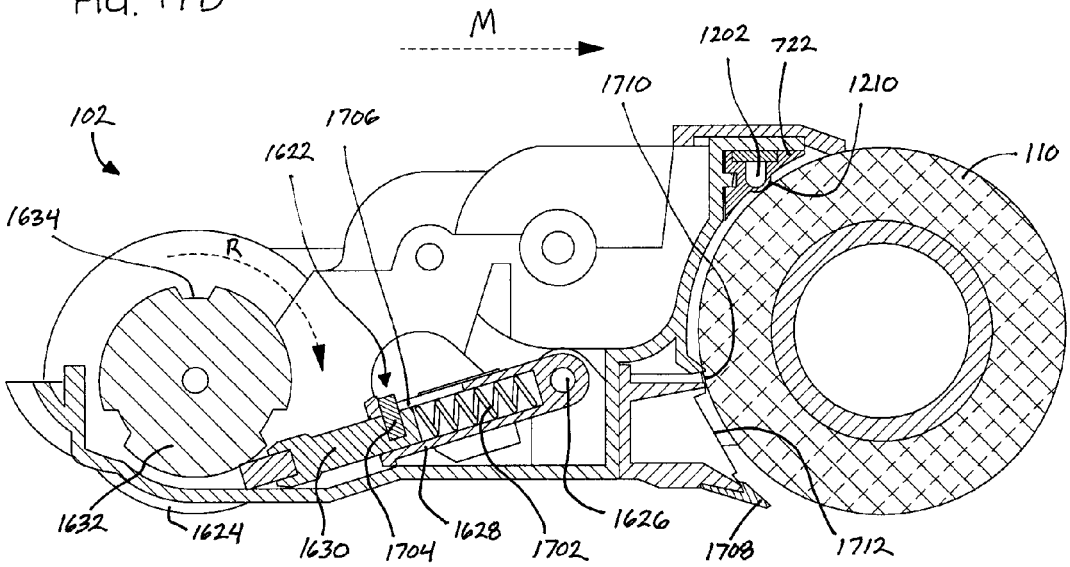
FIG. 17B is a cutaway side elevation view of the cleaning head of FIG. 16, showing the valve lever in a first position.
Figure 18A:
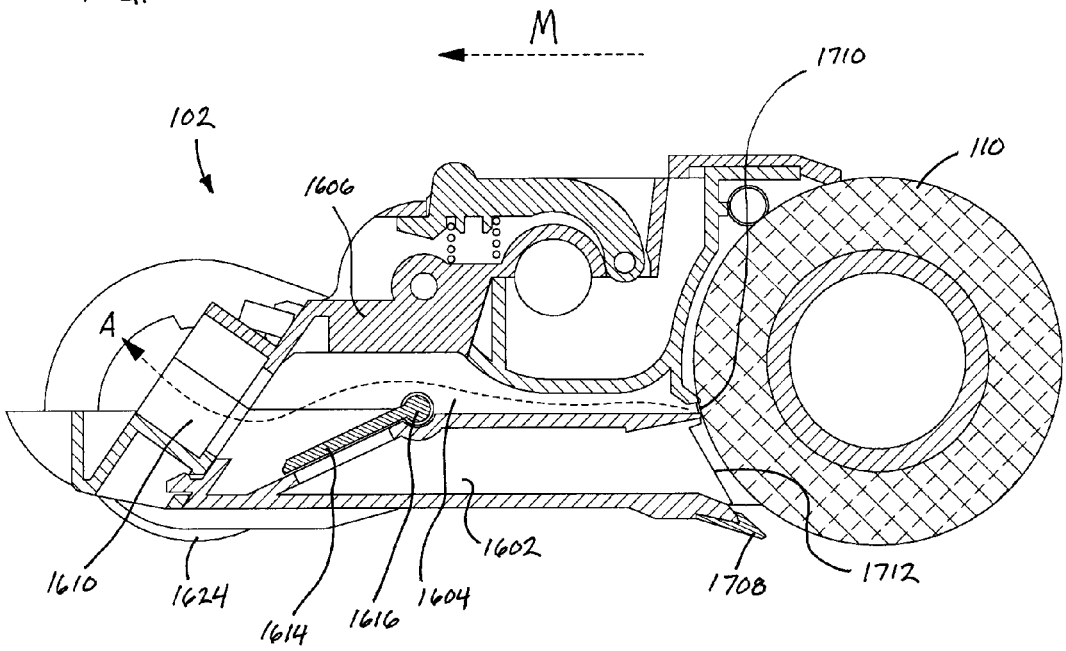
FIG. 18A is a cutaway side elevation view of the cleaning head of FIG. 16, showing the a valve in a second position.
Figure 18B:
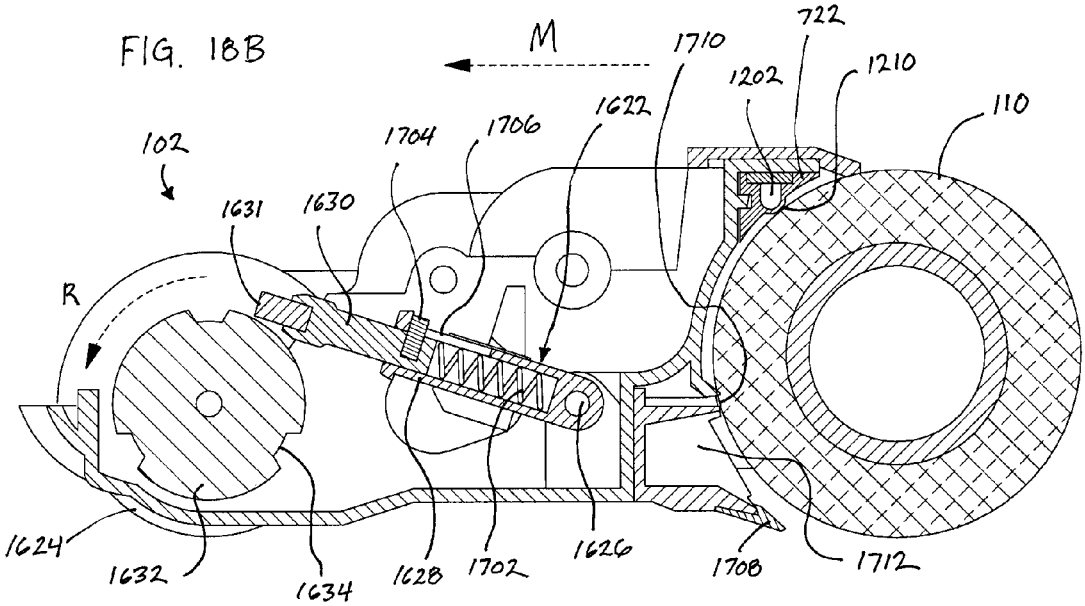
FIG. 18B is a cutaway side elevation view of the cleaning head of FIG. 16, showing the valve lever in a second position.

The operation of the foregoing exemplary embodiment is illustrated in FIGS. 17A-18B. FIGS. 17A and 18A illustrate the cleaning head 102 of FIG. 16 shown along its centerline, and FIGS. 17B and 18B illustrate the cleaning head 102 adjacent the lever 1622 and reversing wheel 1634. As shown, the fluid inlet 1602 terminates at a relatively narrow fluid slit 1710, and the debris inlet 1602 terminates at a relatively large debris slot 1712. The fluid slit 1710 has a smaller cross-sectional area than the debris slot 1712. FIGS. 17A-18B include arrows M showing the direction in which the cleaning head 102 is being moved, arrows R showing the direction in which the rear wheel 1624 and reversing wheel 1632 are rotating, and arrows A representing the airflow through the cleaning head 102. FIGS. 17A and 17B illustrate the device being moved forward (the "forward stroke"), and FIGS. 18A and 18B illustrate the device being moved backwards (the "reverse stroke" or "backward stroke"). In all instances, the agitator 110 may be rotated clockwise, as viewed in FIGS. 17A-18B, but this rotation may be reversed.

As will be apparent from FIGS. 17A-18B, as the agitator 110 rotates, it directs fluid and/or debris from the surface toward the front edge 1708 of the debris inlet 1602. The front edge 1708 may be located above the floor surface, and may include rollers or other supports to keep it from the surface. A gap between the front edge 1708 and the floor may help prevent the front edge 1708 from pushing debris or fluid away from the inlets 1602, 1604 during reverse movement. However, providing a narrower gap or contact between the front edge 1708 and the floor during forward movement may help collect dirt and fluid into the inlets 1602, 1604. Thus, while a gap is provided in the exemplary embodiment, in other embodiments this gap may be removed, or the cleaning head 102 may include a squeegee or other movable members that contact the floor near the agitator 110 to block dirt and debris from passing under the cleaning head 102. Such a squeegee or other device may be lowered during the forward stroke and raised during the backward stroke, if desired, and may be operated by the reversing wheel 1634 or any other suitable mechanism.

During the forward stroke, depicted in FIGS. 17A and 17B, the reversing wheel 1634 moves the lever 1622 downward, which causes the valve 1614 to pivot upwards, as explained above. In this position, the valve 1614 uncovers the debris inlet 1602, and may cover or partially cover the fluid inlet 1604. If desired, the valve 1614 (or other parts) may include one or more sealing surfaces, such as an overmolded resilient material, to help seal the fluid inlet 1604 when it is in this position. Opening the debris inlet 1602 reduces the amount of restriction to the suction source 108 and generates a relatively high volume of air that passes at a relatively high velocity into the debris slot 1712. This high volume, high velocity air can help remove of debris and fluid from the surface being cleaned. Particle removal is assisted by the agitator 110, which mechanically drives debris and fluid towards the debris inlet 1602. Of course, some fluid may also be removed by this airflow. The higher velocity of this air also helps convey debris removed from the surface through the internal passages of the device and into the recovery tank.

During the reverse stroke, depicted in FIGS. 18A and 18B, the reversing wheel 1634 moves the lever 1622 upward, which causes the valve 1614 to pivot downwards, as explained above. In this position, the valve 1614 uncovers the fluid inlet 1604, and may cover or partially cover the debris inlet 1602. If desired, the valve 1614 (or other parts) may include one or more sealing surfaces, such as an overmolded resilient material, to help seal the debris inlet 1602 when it is in this position. In this position, the airflow generated by the suction source 108 becomes concentrated in the fluid slit 1710. One or both edges of the slit 1710 may contact the agitator surface to help concentrate the suction. This focused airflow causes a relatively large pressure drop in the slit 1710, which, when applied at or near the agitator surface, extracts some or all of the fluid or smaller debris that the agitator may pick up from the floor. As noted above, cleaning fluid may be deposited on the agitator 110, which rotates to engage the floor and apply the cleaning fluid thereto. Such fluid deposition may be performed during the forward and/or backward stroke.

While any suitable sizes may be selected for the fluid slit 1710 and the debris slot 1712, in an exemplary embodiment, the fluid slit 1710 has a width of about 1.5 mm. In this embodiment the vacuum source 108 is selected to create a negative pressure of about 3.7 kPa, and an airflow rate of about 6 liters/second (0.21 cu. ft./second). Also in this embodiment, the cross-sectional area of the debris slot 1712 is larger than that of the fluid slit 1710, and is selected such that the vacuum source 108 creates a negative pressure of about 2.3 kPa and a fluid flow rate of about 15 liters/second (0.53 cu. ft./second) in the debris slot 1712. Using this arrangement, the same vacuum source 108 can remove relatively large debris from the surface when the valve 1614 is in one position, and can dry and clean the agitator surface when the valve 1614 is in a second position. Not only does this provide efficient cleaning operations, but it also may be particularly useful to conserve power, which may be useful when the device is battery-operated.

It will be understood that other ratios between the cross-sectional areas of the fluid slit 1710 and debris slot 1712 may be used. For example, the two may have the same area. In other embodiments, it may be more preferred for the debris slot 1712 to have a substantially larger area than the fluid slit 1710 so that they create measurably different airflow characteristics that can provide two different kinds of cleaning functions, such as large debris pickup versus concentrated fluid removal from the agitator. For example, the fluid slit 1710 may be anywhere from about 80% to about 2% of the size of the debris slot 1712. Furthermore, where the debris slot 1712 and/or fluid slit 1710 are bounded by irregular surfaces that make precise measurement of their cross-sectional areas difficult to determine, the ratios of their areas may be evaluated by comparing the vacuum level and/or airflow through them for a given vacuum source, or by simply observing their relative abilities to perform various cleaning functions, such as cleaning larger debris from a floor, or removing fluid from an agitator.

It will be understood that other suitable devices for operating the valve 1614 may be used, and the valve 1614 may be operated to open and close according to other methods. For example, the reversing wheel 1632 may be replaced by one or more pins that protrude from the rear wheel 1624 to move the lever 1622, and the lever 1622 may not include a telescoping feature if sufficient clearance is provided to prevent it from locking against the reversing mechanism. In other exemplary embodiments, the valve 1614 may be operated by solenoids or other electrically controlled actuators, mechanical linkages (such as a wheel-driven linkage that constantly cycles the valve 1614), manual operation, or any other suitable device. The valve 1614 also may be operated to periodically cycle between its positions regardless of the direction of travel, or at the direction of the user. For example, in another exemplary embodiment, a control device, such as a knob or a switch, may be provided to permit an operator to select which inlet to open at any given time. Such a control device may be anywhere on the device, such as on the cleaning head 102 to be foot-operated, or on the grip 106 to allow easy operation without stopping the device.

Figure 19B:
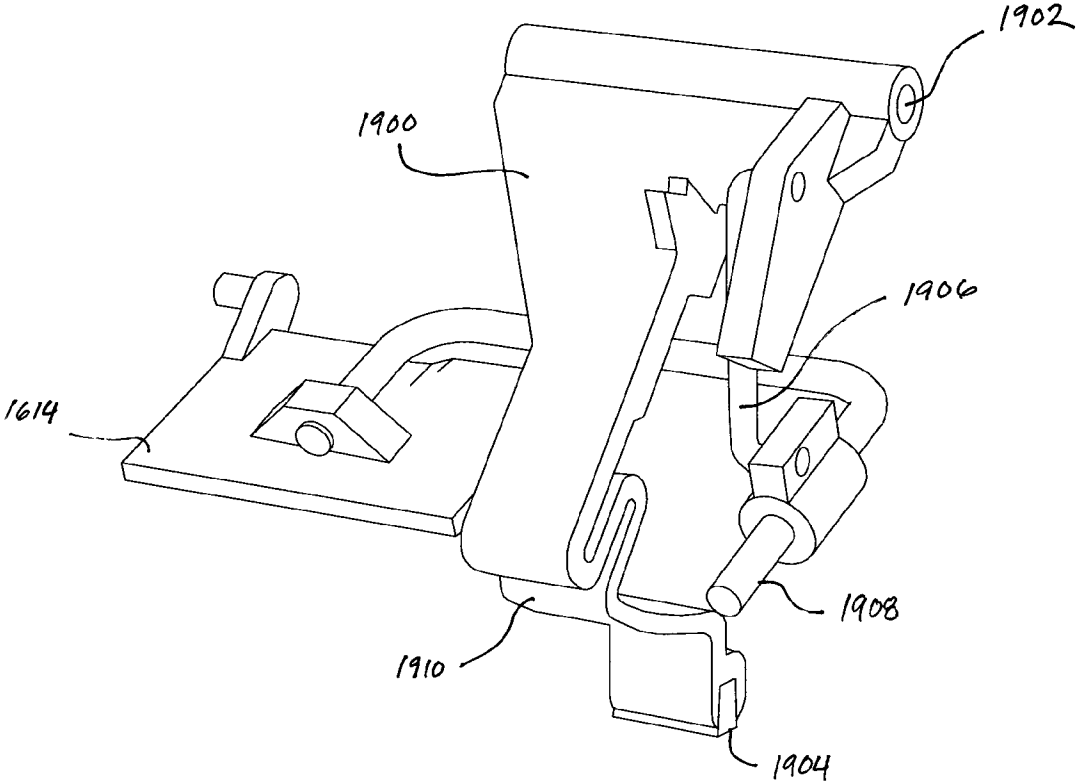
FIG. 19B is an isometric view of an exemplary embodiment of a valve lever shown with an exemplary valve door and door operating linkage.
Figure 19A:
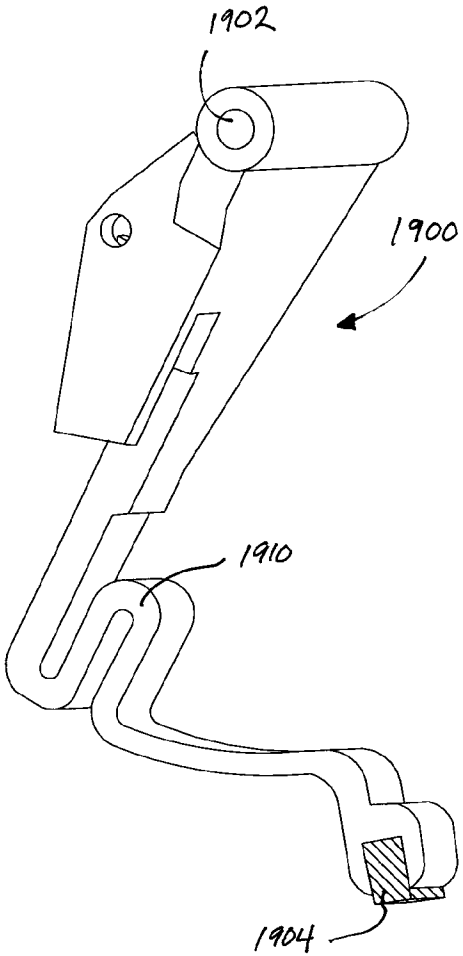
FIG. 19A is an isometric view of an exemplary embodiment of a valve lever.
Figure 20:
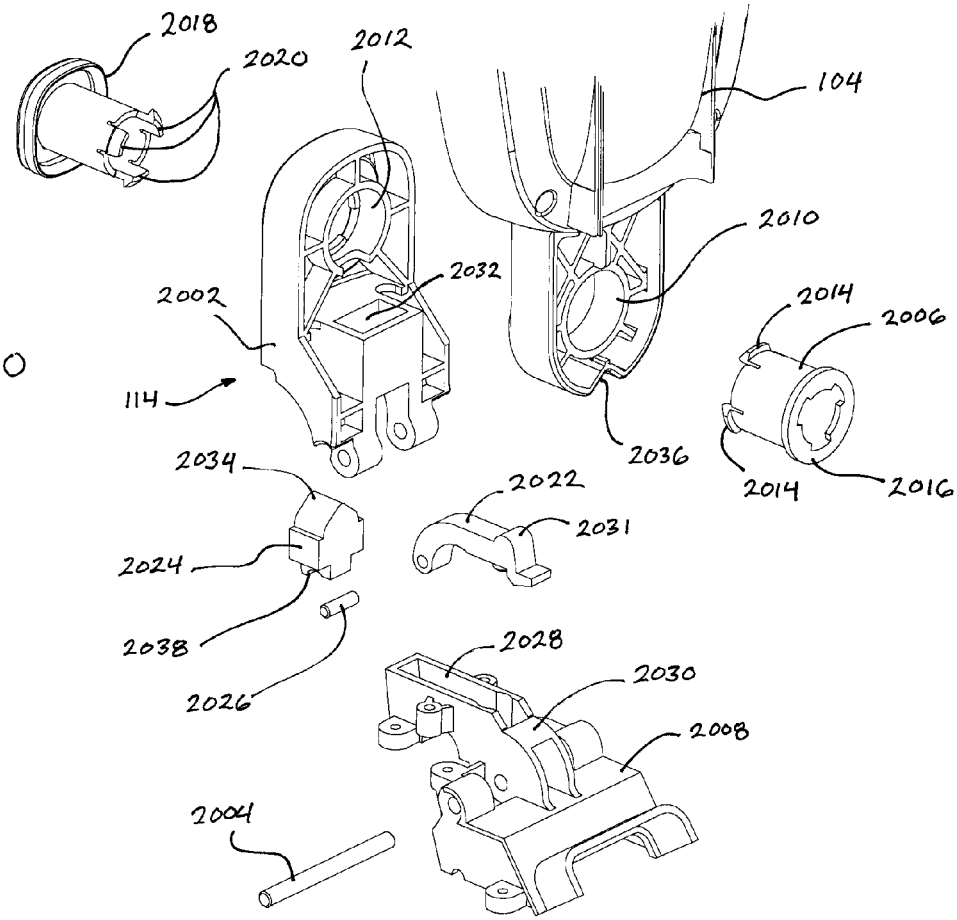
FIG. 20 is a rear isometric exploded view of an exemplary embodiment of a cleaning head, showing exemplary handle pivot features located therein.
Figure 20:
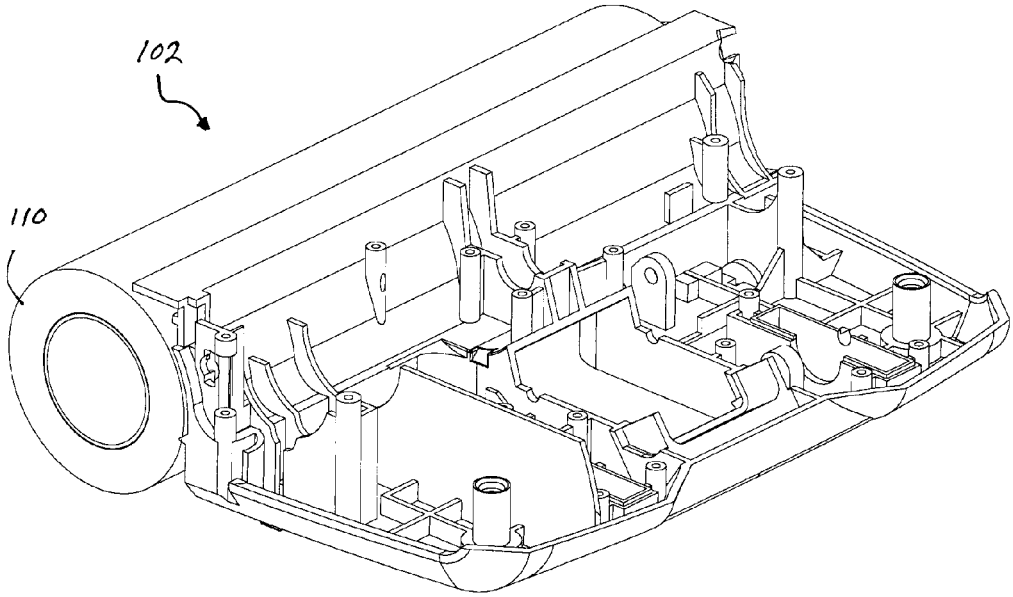

In another exemplary embodiment, shown in FIGS. 19A and 19B, the reversing mechanism may be omitted, and the valve lever 1900 may be driven directly by contact with the floor. In this embodiment the valve lever 1900 comprises an opening 1902 to receive the pivot pin 1626 at one end, and a contact surface 1904 at the other end. The lever 1900 is pivotally mounted on the pivot pin 1626 such that the contact surface 1904 extends through a slot through the lower base housing 1612 to contact the surface being cleaned. In use, the contact surface 1904 engages the floor, and friction between the contact surface 1904 and the floor moves the lever 1900 back and forth between a first position and a second position. The contact surface 1904 preferably comprises a piece of tactile material, such as a thermoplastic elastomer or polyurethane, that is imbedded in or attached to the end of the lever arm 1900. The contact surface 1904 also may have grooves, slots, or other features to help it grip the floor surface.

As with the previous exemplary embodiment, the lever 1900 may be adapted to move the valve 1614 in any way, such as by forming it integrally with or attaching it to the valve 1614 so that they rotate together, or by providing a linkage or other mechanism between the lever 1900 and the valve 1614. For example, as shown in FIG. 19B, the lever 1900 may be attached to the valve 1614 by a link 1906 that lifts and lowers a torsion bar 1908 attached between the link 1906 and the valve 1614. As the lever 1900 moves back and forth, it raises and lowers the link 1906, which rotates the torsion arm 1908 to raise and lower the valve 1614.

A pivoting lever arm 1900 that contacts the floor may include a telescoping or flexing feature that allows the contact surface 1904 to move linearly on the floor without lifting the cleaning head 102. For example, the lever arm 1900 may include a looped portion 1910 and/or a thinner section (not shown) that provides a flexural hinge to allow the contact surface 1904 to move radially with respect to the pivot pin. Such a looped portion may also help maintain firm contact against the floor. Other telescoping devices, such as the device described with reference to the lever 1622 of FIG. 16, may be used instead. Furthermore, such a telescoping device may not be provided at all, and the lever arm 1900 may be replaced by a sliding contact or a device that moves in some other fashion besides pivoting to operate the valve 1614.

Figure 21:
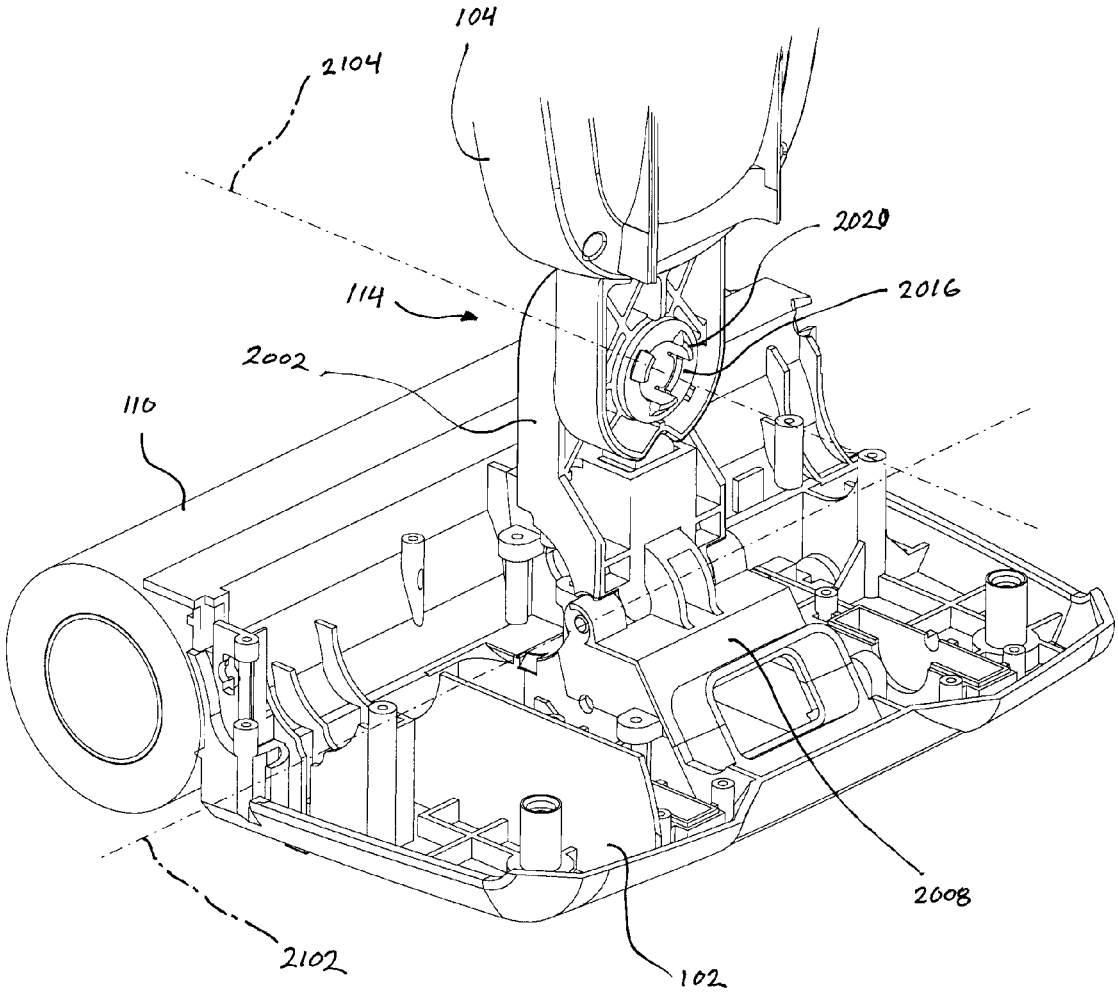
FIG. 21 is a rear isometric assembled view of the cleaning head of FIG. 20.

Referring now to FIGS. 20-22C, an exemplary embodiment of a pivot 114 joining the cleaning head 102 to the handle 104 is described in detail. The exemplary pivot 114 may comprise an intermediate link 2002 that joins to the cleaning head 102 and the handle 104. The link 2002 is pivotally connected to the cleaning head 102 by a lower pivot to the handle 104 by an upper pivot. The lower pivot is formed by a pivot pin 2004 that allows the link 2002 to pivot relative to the cleaning head 102 about a first axis 2102 that is transverse to the cleaning head 102, as shown in FIG. 21. In the shown embodiment, the pivot pin 2004 is mounted to an air passage cover 2008, but this is not required. The upper pivot is formed by a pivot bushing 2006 that allows the link 2002 to pivot relative to the handle 104 about a second axis 2104 that lies in a plane that is longitudinal to the cleaning head 102. The pivot bushing 2006 connects to the handle 104 to the link 2002 by passing though a first hole 2010 through the handle 104 and through a second hole 2012 through the link 2002. When fully installed, the handle 104 and link 2002 are held together on the bushing 2006 be one or more tabs 2014 projecting radially from the bushing 2006 at one end, and a flange 2016 projecting radially from the bushing 2006 at the other end. The pivot bushing 2006 may be hollow to allow wires, fluid hoses, and or vacuum hoses to pass therethrough. A pivot lock 2018 may also be passed through the center of the pivot bushing 2006 to prevent the tabs 2014 from detaching and provide a cosmetic cover over the upper pivot. The pivot lock 2018 has radial tabs 2020 to hook around the flange 2016 to hold the pivot lock 2018 in place. The pivot lock 2018 also may be hollow to allow wires and/or hoses to pass through it.

In the foregoing embodiment and other embodiments, the pivot 114 may include a pivot lock that holds the handle 104 upright relative to the cleaning head 102. Such a pivot lock may hold the handle about one or both of the pivot axes 2102, 2014. For example, an embodiment of a pivot lock that provides simultaneous two-axis locking may include a spring loaded latching arm 2022 that actuates and engages a key 2024 to simultaneously hold the upper and lower pivots. In this exemplary embodiment, the latching arm 2022 is pivotally mounted by a pin 2026 into a slot 2028 formed in the air passage cover 2008 or to any other suitable part of the cleaning head 102. A latch spring 2202 (FIGS. 22A-22C) is provided between the latching arm 2022 and the housing 2008 to bias the latching arm 2022 upwards towards the link 2002, and a wall 2030 or any other suitable structure may be provided to limit the distance that the latch spring 2202 can move the latching arm 2022.

Figure 22A:
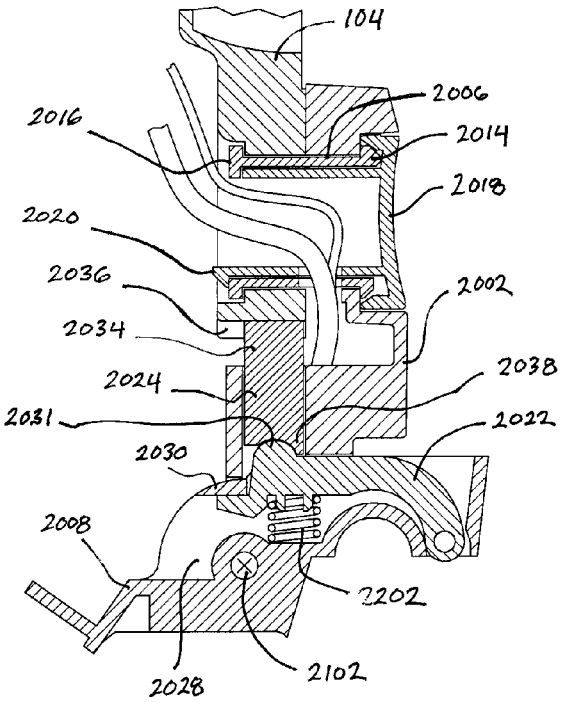
FIGS. 22A-22C are cutaway side views of the cleaning head of FIG. 20, showing the handle pivot upright in FIG. 22A, and in two reclined positions in FIGS. 22B and 22C.
Figure 22B:
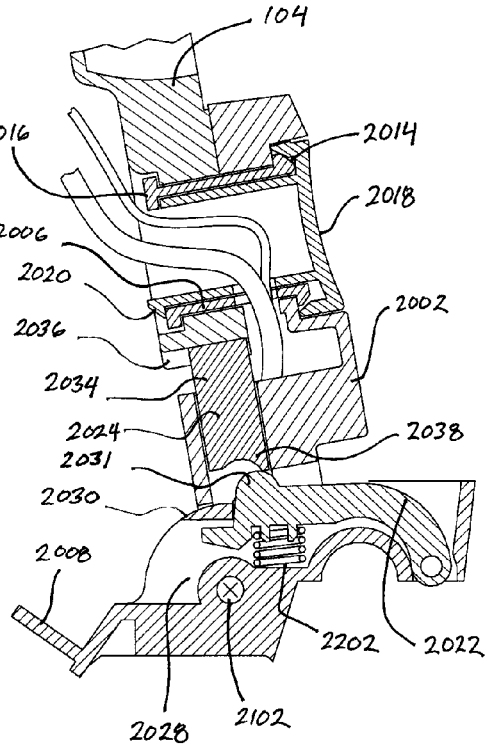
Figure 22C:
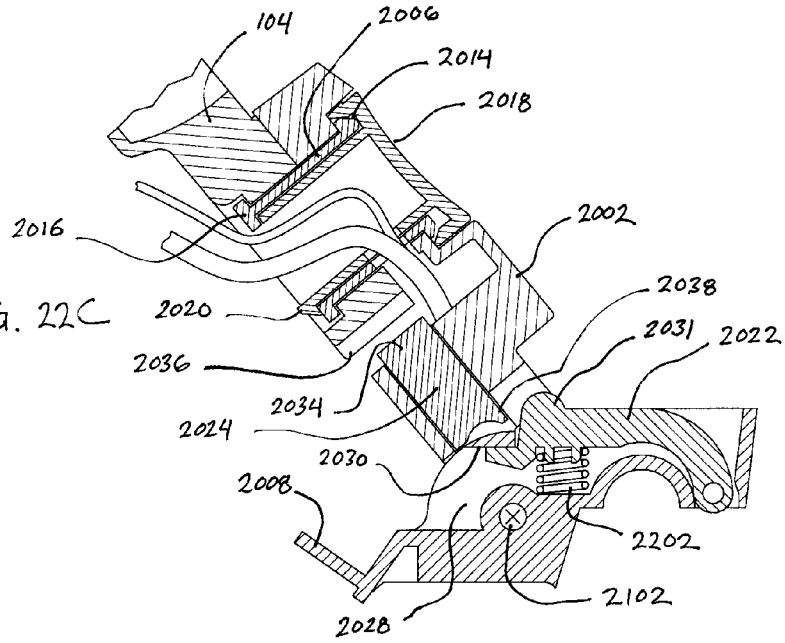

As best shown in FIGS. 22A-22C, the latching arm 2022 includes a protrusion 2031 that is positioned generally below a passage 2032 in the link 2022 when the link 2022 is positioned vertically on the lower pivot 2102. The key 2024 is located within the passage 2032 such that it can slide back and forth therein. When the link 2002 is vertical, as shown in FIG. 22A, the latching arm protrusion 2031 presses the key 2024 vertically within the passage 2032, which causes an upper protrusion 2034 formed on the top of the key 2024 to engage a corresponding detent 2036 formed in the handle 104. When the upper protrusion 2034 and the detent 2036 are engaged, the key 2024 holds the handle 104 relative to the link 2002 and prevents rotation about the top axis 2104. At the same time, a lower protrusion 2038 formed on the bottom of the key 2024 engages the front of the latching arm protrusion 2031, which prevents the link 2002 from pivoting about the lower axis 2102. The locking mechanism is disengaged by pulling backwards on the handle 104 with sufficient force to drive the latching arm 2022 downwards against the latch spring 2202, as shown in FIG. 22B. Once the handle 104 has pivoted backwards a predetermined distance about the lower pivot axis 2102, the key 2024 falls down the passage 2032 and releases the upper protrusion 2034 from the detent 2036 to allow rotation about the upper pivot axis 2104.

It will be understood that the length of the intermediate link 2002, the location and orientation of the pivot axes 2102, 2014, and other variables and structures of the foregoing embodiment or other embodiments may be modified to adjust the performance, functionality, and shape of the device. For example, as noted previously herein, the lower pivot axis 2102 may be moved forward towards the front of the cleaning head 102 to allow the user to apply more direct pressure to the agitator 110.

It will be understood that various modifications to the foregoing embodiment or other embodiments of handle pivots and one-axis and two-axis locking mechanisms may be used. For example, the two-axis pivoting handle may be replaced by a conventional single-axis pivoting handle, or other kinds of pivoting arrangements may be used. Also, the orientations of the pivot axes, as well as the structures that form the upper and lower pivots, may be reversed or otherwise modified, if desired. The various features of the latching arrangement also may be modified or varied. For example, the latch arm 2022 may be integrally formed as part of the housing 2008, and the latch spring 2202 may be integrally formed as part of the latch arm 2022. As another example, a two-axis pivot lock may be provided by providing using a conventional single-axis lock to hold the handle 104 vertically with respect to the lower pivot axis 2102, and providing vertical walls or other structures on the cleaning head that capture or otherwise engage the handle 104 when it is fully upright and prevent it from falling sideways around the upper pivot axis 2104.

Other variations and modification may also be made, as will be appreciated by persons of ordinary skill in the art in view of the present disclosure. It will also be understood that the linkage provided herein may be useful on any device having a pivoting head when it is desired to be able to store the device in an upright position, and it may be used on devices other than vacuum cleaners.

Figure 24:
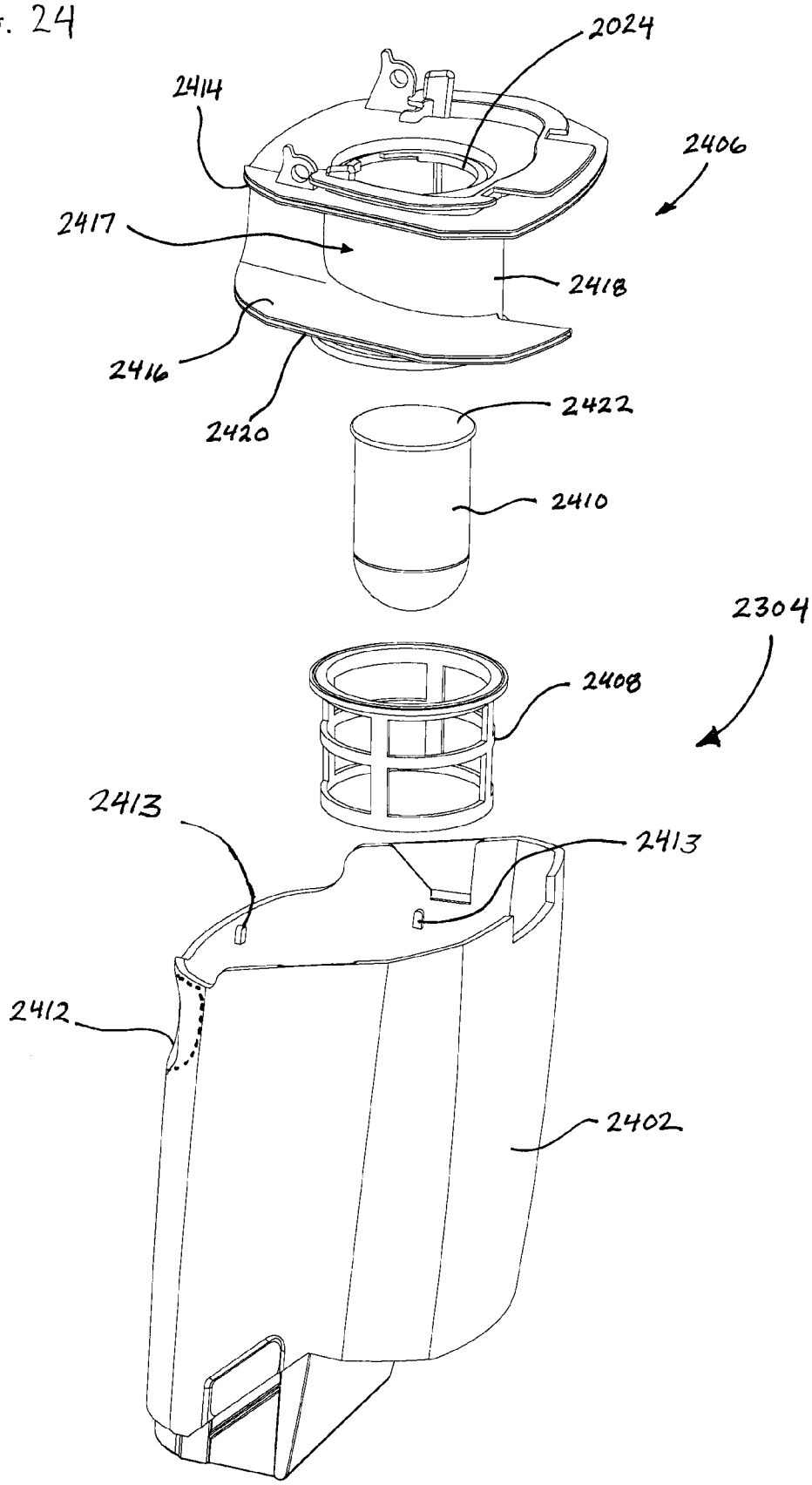
FIG. 24 is a rear isometric exploded view of the recovery tank of FIG. 23.
Figure 25:
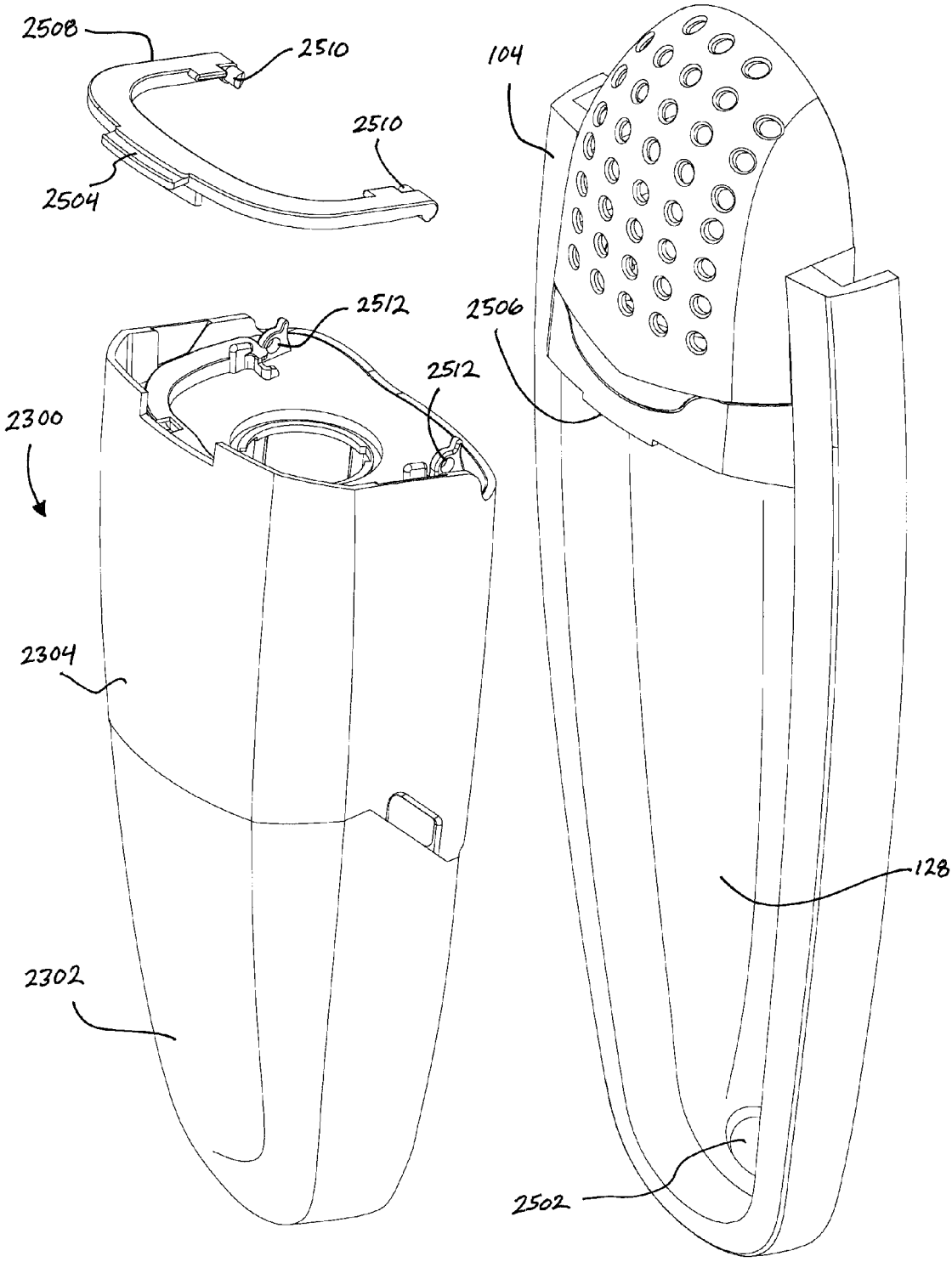
FIG. 25 is a front isometric partially-exploded view of the tank assembly of FIG. 23, shown adjacent an exemplary embodiment of a cleaning device housing.

As shown in FIGS. 1-3, a cleaning device as disclose herein may include a recovery tank 118 and/or a supply tank 116. In one exemplary embodiment, a supply tank 116 and recovery tank 118 are provided as an assembly that can be removed from the cleaning device 100 as a unit. Details of one exemplary embodiment of such a device are illustrated in FIGS. 23-25.

Figure 23:
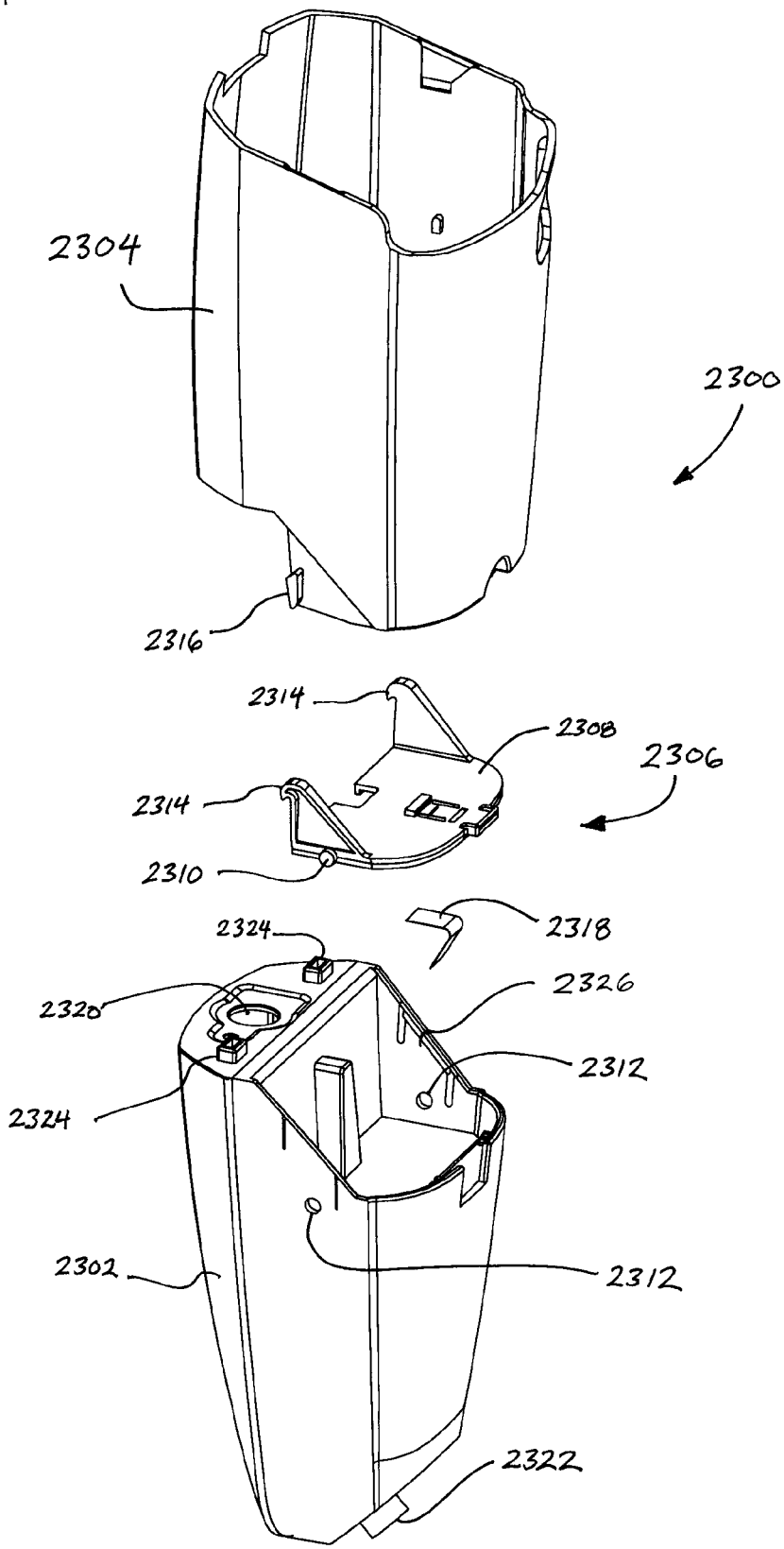
FIG. 23 is a rear isometric exploded view of an exemplary embodiment of a tank assembly.

FIG. 23 illustrates an embodiment of a tank assembly 2300 having a supply tank 2302 and a recovery tank 2304. The supply tank 2302 comprises a rigid chamber having a fluid inlet 2320 at its upper end, and an outlet 2303 at its bottom end. The supply tank 2302 may be opaque, transparent, or a combination of the two, and it may have windows or fluid height measuring gauges and the like. The supply tank 2302 also may be divided into multiple separate tanks. A lid (not shown) can be provided to fit over the inlet 2320 to seal it. Such a lid may be separate part, or formed as a portion of the recovery tank 2304 that seals the inlet 2320 when the tanks are assembled together. Alternatively, the inlet 2320 may be omitted, and fluid can be poured into the supply tank 2302 through the outlet 2322. A check valve, vent, or other device may also be provided with the supply tank 2302 or its lid, as known in the art. In the shown embodiment, the supply tank outlet 2322 includes a dry-break valve (not shown) that seals the supply tank 2302 when it is not installed in the device 100, and places the supply tank 2302 in fluid communication with the fluid distributor, pump, or other fluid deposition device when the supply tank 2302 is installed. Alternatively, the outlet 2322 may be omitted, and fluid can be drawn from the supply tank 2302 by a hose installed through the inlet 2320. These and other arrangements for supply tank inlets and outlets are known in the art, and other arrangements for these devices will be appreciated by persons of ordinary skill in the art in view of the present disclosure.

In the exemplary embodiment, the supply tank 2302 may be positioned below the recovery tank 2304, and includes a latch 2306 to hold the two tanks together. Any suitable kind of latch or latches may be used to connect the tanks. For example, in the shown embodiment, the latch 2306 comprises a platform 2308 having pins 2310 that engage corresponding holes 2312 in the supply tank 2302 to pivotally mount the platform 2308 to the supply tank 2302. A pair of hooks 2314 are mounted on the platform 2308 and positioned to engage corresponding tabs 2316 near the bottom of the recovery tank 2304. A spring 2318 is attached to the bottom of the platform 2308 to press against the supply tank 2302 and bias the platform into a forward-tilted position in which the hooks 2314 engage the tabs 2316. When the tanks are attached, the recovery tank 2304 covers the supply tank inlet 2320 to prevent it from accidentally opening and to provide a cleaner appearance. Portions of the supply and recovery tanks 2302, 2304 may envelop one another, and the tanks may have interlocking posts 2324 or other features to help align them for attachment and/or keep them aligned once attached. The user can depress the back of the platform 2308 to disengage the hooks 2314 and release the tanks from one another.

It will be understood that other embodiments of latches may be used to hold the tanks together in lieu of or in addition to the hooks 2314. Examples of other latches include snaps 2326, magnetic latches, adhesives, hook-and-loop fasteners, surfaces that engage by friction, threads or threaded fasteners, and so on. It will also be understood that the tanks may be held together in any other orientation, such as side-by-side, supply tank on top, fore-aft, and so on. In still other embodiments, the supply tank 2302 and recovery tank 2304 may be integrally formed with one another.

FIG. 24 illustrates an exemplary embodiment of a recovery tank 2304 useable with the cleaning device 100. The recovery tank 2304 may be adapted to separate fluid and/or debris from the working airflow entering the device from the cleaning head 102, and store such fluid and/or debris until the user is ready to clean or empty the device. The recovery tank 2304 may include a reservoir 2042, a cover 2406, a filter 2408, and a float 2410. These parts may be provided separately, or as one or more integrally-formed parts, as known in the art. A recovery tank inlet 2412 is provided through the reservoir wall or through the cover. The inlet 2412 is adapted to be placed in fluid communication with the cleaning head outlet to receive air the airflow generated by the vacuum source 108, along with any entrained debris and fluid. As noted above, the inlet 2412 may be downstream or upstream of the vacuum source 108. Any suitable hose or rigid conduit may be used to provide air to the recovery tank inlet 2412. For example, a flexible hose may extend from the cleaning head 102 to the handle 104, where it may be connected to a rigid pipe or half-pipe that extends to an opening through the handle recess 128 to abut the recovery tank inlet 2412 when it is mounted to the handle 104. A rubber seal or other gasket may be provide at this opening to provide an air-tight seal. As another example, a conduit may be integrally molded to the reservoir wall or placed inside the reservoir 2042.

In the illustrated embodiment, the recovery tank cover 2406 is installed inside the top of the reservoir 2402, where it rests on one or more travel stops 2413. A lip seal 2414 is provided to create a generally water-tight seal along the areas seal where the two parts meet. The seal 2414 may be formed by a separate part that is inserted into a slot along the edge of the cover 2406, by an overmolded part, or by any other suitable device or means. The cover 2406 also may include an air guide 2416 that surrounds the inlet 2412 and creates a channel 2417 that directs the incoming air around a center passage 2418 formed in the middle of the cover 2406. The air guide 2416 also may be sealed to the reservoir wall along its edge 2420, in which case it can help prevent fluid captured in the reservoir 2402 from escaping out of the inlet 2410 when the device is leaned back or tipped on its side. The air guide 2416 may extend any suitable distance around the center passage 2418. For example, it may extend about 180 degrees or about 270 degrees around the center passage 2418. The center passage 2418 forms an outlet from the recovery tank 2304. The center passage 2418 may be connected to the vacuum source 108 either directly or by way of one or more additional fluid and/or debris separation devices, such as a filter or the like.

The filter 2408 is attached to the bottom of the cover 2406 by bayonet fittings, snaps, screws, or other mechanisms, as known in the art. The filter 2408 comprises a cage-like structure to which a coarse or fine screen may be attached to prevent large objects from passing therethrough. Alternatively, the filter 2408 may simply comprise a float retainer comprising a simple open cage or other structure, or it may comprise a foam, pleated or other type of relatively fine filter medium.

The float 2410 is provided to seal the center passage 2418 (or any other kind of outlet that may be used with the recovery tank 2304) when required, in order to prevent large amounts of fluid and/or debris from exiting the recovery tank and possibly damaging the vacuum source 108 or other devices. For example, the float 2410 may comprise a buoyant device (such as a low-density material and/or buoyant chamber) that is sized so that it can move up and down within the center passage 2418 in response to the height and/or movement of fluid within the reservoir 2402, but still allow sufficient clearance between its sidewall and the center passage 2418 to allow air to pass therethrough during normal use. When the fluid reaches a predetermined level, it contacts and lifts the float 2410. When the float 2410 reaches a certain height, the top edge 2422 of the float 2410 seals against a corresponding edge 2424 of the center passage 2418 to prevent or inhibit fluid and/or air from passing therethrough. One or more seals may be provided at one or both of these edges to help seal the parts together under such circumstances. The float 2410 rise high enough to seal the center passage 2418 directly as a result of being pressed upwards by the fluid, and/or indirectly by being lifted high enough that the suction generated by the vacuum source 108 pulls the float 2410 upwards to the top of the center passage 2418. When the float seals the center passage 2418 the noise created by the vacuum source 108 may change enough to alert the user that the reservoir 2402 has become full or nearly full, as known in the art.

During use, the vacuum source 108 creates a moving airflow that picks up fluid and/or debris from the floor, and conveys it to the recovery tank 2402. The airflow enters the recovery tank inlet 2410, passes through the channel 2417 created by the air guide 2416, and into the reservoir 2402. Once in the reservoir 2402, the air may flow in a cyclonic, irregular or variable pattern before passing through the filter 2408, past the float 2410, and out through the central passage 2418. While the air is flowing through the reservoir 2402, entrained fluid and debris may precipitate out and fall into the reservoir for storage. To help promote such precipitation, the passage 2417 may have a cross-section that increases as it progresses further towards the reservoir 2402, which may help slow the airflow to allow precipitation of entrained fluid and debris. In addition, the airflow may rapidly slow after it exits the passage 2417. Although the airflow may move in a cyclonic manner within the reservoir 2402, which can assist with removing fluid and debris by centrifugal motion, it may be desirable to inhibit such cyclonic movement to potentially remove more fluid and debris.

It will be understood that any other suitable float, valve, or other closure device may be used instead of or in addition to the float 2410. For example, a valve door may be provided to close the center passage 2418 in response to movements of the device, such as during forward strokes or when the device is detected to be on its side or past a certain lean angle. Such a device may be electrically or mechanically operated.

Turning now to FIG. 25, the supply and recovery tank assembly 2300 may be installed on the device in any suitable manner. For example, the tank assembly 2300 may be installed by positioning the supply tank outlet 2322 into a corresponding opening 2502 in the handle recess 128, then leaning the tank assembly 2300 back into the recess 128 until a latch 2504 located on the recovery tank 2304 engages a corresponding tab 2506 on the handle 104. In such an embodiment, the latch 2504 may be located on a tank handle 2508 that is pivotally attached to the top of the recovery tank 2304 and serves the dual purposes of providing a latch 2504 to lock the tank assembly 2300 to the handle 104 and providing a handle 2508 to carry the tank assembly 2300. To this end, the handle 2508 may have one or more pivots 2510 that engage corresponding holes 2512 located on the recovery tank reservoir 2402 or cover 2406 to allow the handle 2508 to pivot. When the handle 2508 is folded down onto the recovery tank 2304, the latch 2504 is positioned to engage the tab 2506. A spring (not shown) may be provided to bias the handle 2508 upwards to cause the latch 2504 to engage the tab 2506, or such biasing force may simply be provided by mounting the handle 2508 such that is must be flexed downwards to fully seat the tank assembly 2300 and engage the latch 2504 with the tab 2506.

It will be understood that the handle 2508 may be omitted or other latching arrangements may be provided. For example, the latch may comprise a resiliently-biased sliding member on the handle 104 that engages a slot on the tank assembly 2300, and bosses or other structures may be provided on the tank assembly 2300 to replace the supply tank outlet 2322 as a hinge point for installing the tank assembly 2300. Other variations and embodiments of mounting arrangements will be readily apparent to persons of ordinary skill in the art in view of the present disclosure. Furthermore, as noted above, it also is not strictly required for either of the tanks to be removable from the handle or wherever else they may be mounted on the device. For example, the recovery tank 1102 may not be removable from the handle 104, in which case it may include a drain or other suitable outlet for removing fluid and/or debris. Similar arrangements may be made for a non-removable supply tank 2302.

Figure 26:
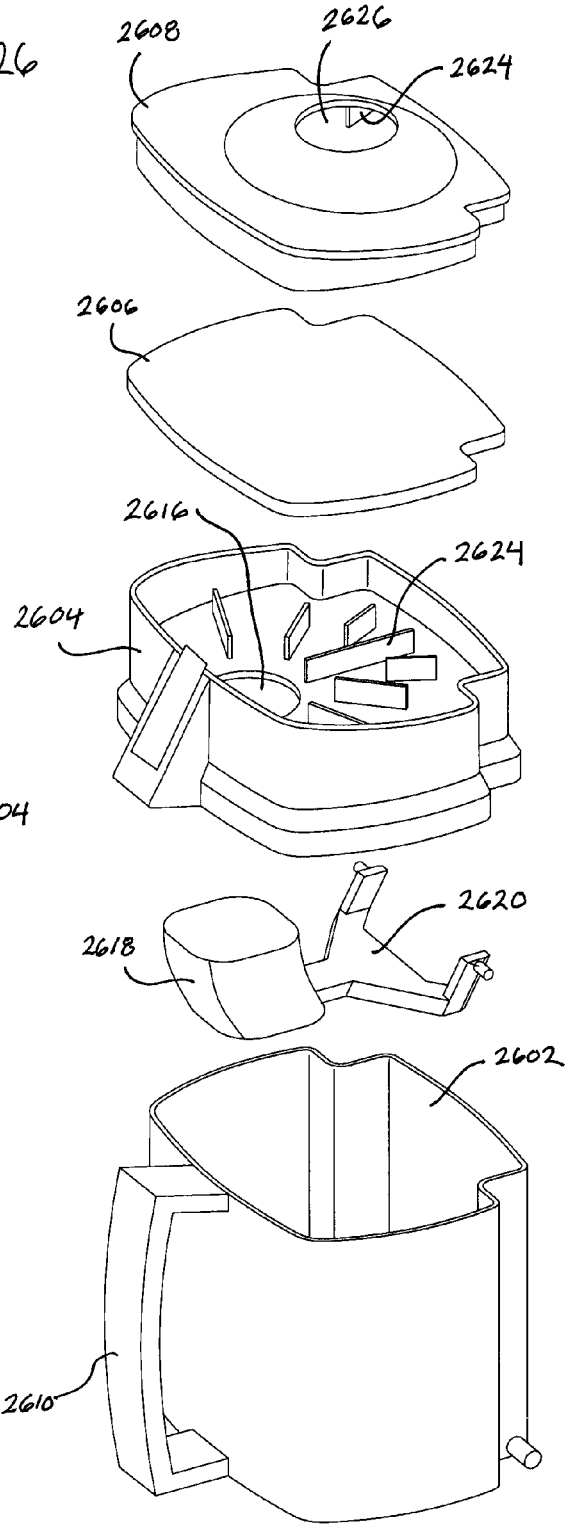
FIG. 26 is a front isometric exploded view of another exemplary embodiment of a recovery tank assembly.
Figure 27:
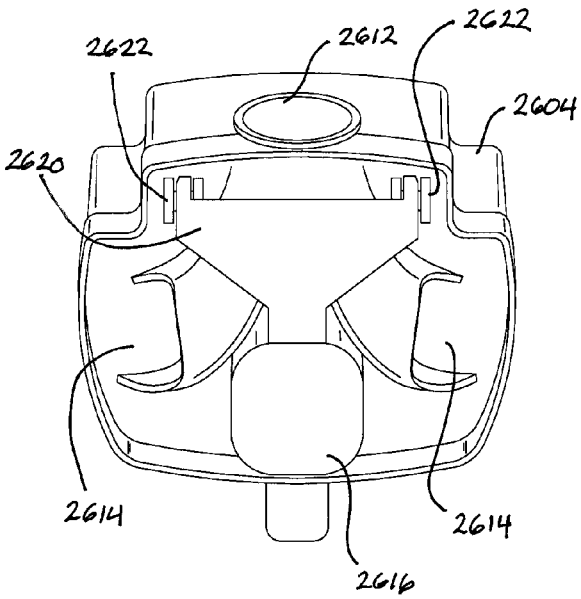
FIG. 27 is a bottom plan view of the lid shown in FIG. 26.

FIGS. 26 and 27 illustrate another exemplary embodiment of a recovery tank 2600 that may be used. This recovery tank 2600 includes a reservoir 2602, a lid 2604, a filter 2606, and a filter cover 2608. A handle 2610 is also provided on the reservoir 2602. The lid 2608 may include a bifurcated inlet passage that receives air from the cleaning head through a recovery tank inlet 2612 and splits the airflow into two or more streams by directing it through separate lid passages 2614. The two lid passages 2614 direct the air into the reservoir 2602 in two or more directions, which may be opposite each other or not. Dividing the incoming stream of air and entrained debris and fluid is expected to slow the fluid and assist with separating fluid and debris from the air. Dividing the stream also may facilitate separation of the air from the fluid and/or debris by adding random turbulence. The use of separate directions also may make the recovery tank 2600 less susceptible to splashing. To further enhance fluid separation, the passages 2614 may increase in cross-sectional area as they progress towards the reservoir 2602, which reduces the velocity of the incoming dirty airstream to facilitate separation of fluid and debris from the air. Additionally, the shape of the lid 2604 also may prevent flooding of the filter 2606 when the recovery tank 2600 is tilted from side to side during use.

After passing through the reservoir 2602, the air exits the reservoir 2602 through a lid opening 2616. A float 2616 may be provided in the reservoir 2602 to seal the lit opening 2616 when required to prevent excess water or debris from passing therethrough. The float 2618 may be mounted by a pivot arm 2620 that engages corresponding bosses 2622 on the lid 2604 or reservoir 2602. The pivot arm 2620 may be bridged, such as shown, to allow the float 2618 to pivot around the inlet passages 2614, or it may be nestled between the inlet passages 2614.

The air exiting through the lid outlet 2616 passes into a filter chamber formed between the lid 2604 and the filter cover 2608. The filter 2606 is retained in the filter chamber by one or more ribs 2624 formed on the lid 2604 and/or filter cover 2608. After passing through the filter 2606, the air exits the recovery tank 2600 through a cover outlet 2626. The filter 2606 may be adapted to filter the air and help prevent fluid and/or debris from being transported out of the reservoir 2602 and into the vacuum source 108. The 2606 may comprise Bulpren or other suitable filtration materials. In an exemplary embodiment, the filter 2602 is made of Bulpren having about 90 PPI and may have a thickness of about 1 centimeter (cm). Other porosities and/or thicknesses also may be used.

It will be understood that any suitable kind of vacuum source 108 may be used with embodiments of the cleaning device. For example, a conventional vacuum fan and motor may be provided to operate in a conventional way to draw dirt and/or fluid into the device. Such devices typically include an electric motor that is coupled to a fan to drive the fan at the same speed as the motor, but intermediate gearboxes, drive shafts, and other power transmission devices may be provided between the two. As noted above, the fan may be located upstream or downstream of a recovery tank or any other suitable vacuum filter, such as a porous bag or the like. Pre-motor filters and post-motor filters (not shown) may be provided upstream and downstream, respectively, of the vacuum source, as known in the art. In many instances, the air passing through a vacuum source fan may be used to cool the electric motor that drives the fan. In such instances, the fan may include a diffuser that redirects the airflow over, around or through the motor. This is particularly common where the vacuum source 108 is located downstream of the dirt receptacle, and relatively little dirt or water that could damage the electric motor remains the airstream.

Figure 28:
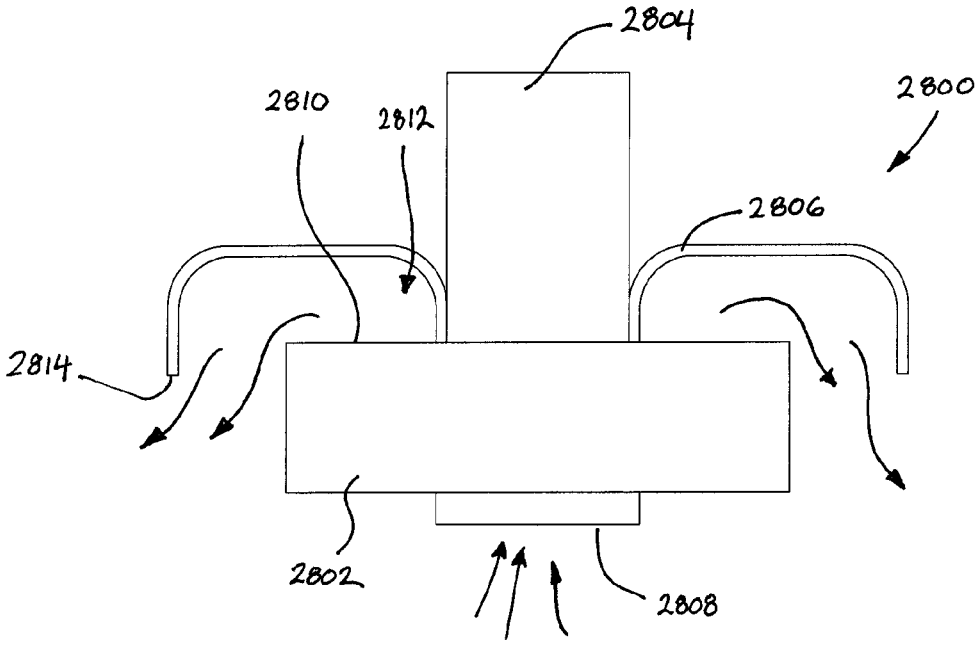
FIG. 28 is a schematic side view of an exemplary embodiment of a vacuum source and deflector assembly.
Figure 29:
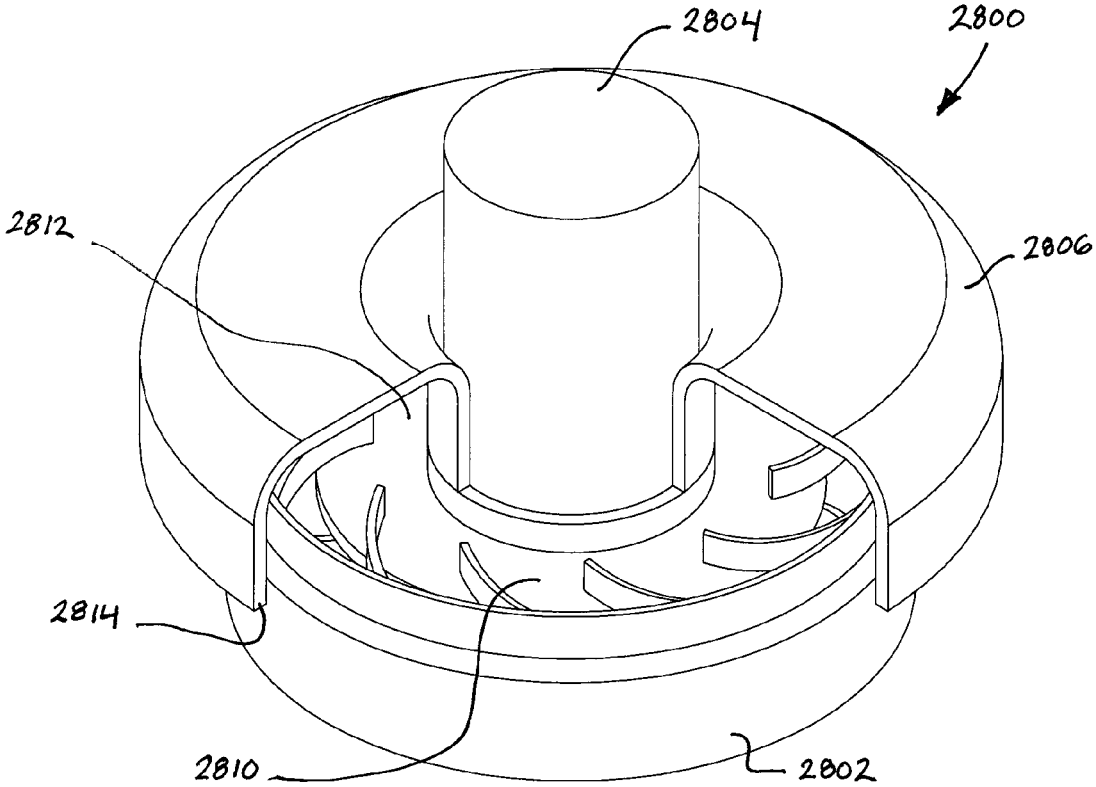
FIG. 29 is a partially cutaway isometric view of the vacuum source and deflector assembly of FIG. 28, with a quadrant of the deflector omitted to view the fan outlet.

While conventional vacuum sources having conventional motor-cooling arrangements may be suitable in some embodiments, it may be desirable in other embodiments to provide additional motor protection to help prevent fluids from collecting on the electric fan motor. FIGS. 28 and 29 illustrate an exemplary embodiment of a vacuum source 2800 that includes fan 2802, an electric motor 2804 coupled to the fan 2802 to drive it, and an exhaust deflector 2806 adapted to redirect air exiting the fan 2802 away from the motor 2804. When used, for example, with the embodiment of FIGS. 1 and 2, the vacuum source 2800 may located in the device handle 104 above the tank assembly 112, and provided with a fan inlet 2808 that is fluidly attached to the recovery tank outlet when the tank assembly 112 is mounted to the device 100. When so mounted, the motor 2804 is located above the fan 2802, which provides some protection from fluid that may enter the fan 2802, either during normal use or in the event the device 100 is tipped over and fluid passes into the fan 2802 by gravity or inertia. To provide additional protection against water damage, the deflector 2806 is mounted to redirect air exiting the fan outlet 2810 away from the motor 2804. For example, in the shown embodiment, the deflector 2806 comprises an annular structure that surrounds the motor 2804 and curves away from the motor 2804 and back towards the fan inlet 2808. In use, the deflector 2806 receives air exiting the fan outlet 2810, and redirects it as shown in FIG. 28.

In the illustrated exemplary embodiment, the deflector 2806 is generally shaped as a semi-toroid, having an inner opening 2812 generally surrounding the motor 2804 (or otherwise positioned between the motor 2804 and the fan 2802), and an outer perimeter 2814 extending radially beyond the outer edge of the fan 2802. The inner volume of the semi-toroidal shape is hollow, so that air exiting the fan 2802 is deflected along the inner volume, directed radially outward, and exhausted around the outer perimeter 2814 in a direction away from the motor 2804. Of course, other shapes or modifications of this shape may be used instead. For example, the deflector 2806 may not entirely surround the motor 2804, or it may be formed as part of a housing member that forms other parts of the device or performs other functions.

As explained above, embodiments of the cleaning device 100 may be provided with features to hold the handle 104 upright relative to the base 102, which may allow the device 100 to stand freely on its own. It is also envisioned that a stand may be provided to hold and/or store the cleaning device 100. Such a stand may be provided in addition to handle 104 locking features, or instead of them.

Figure 30:
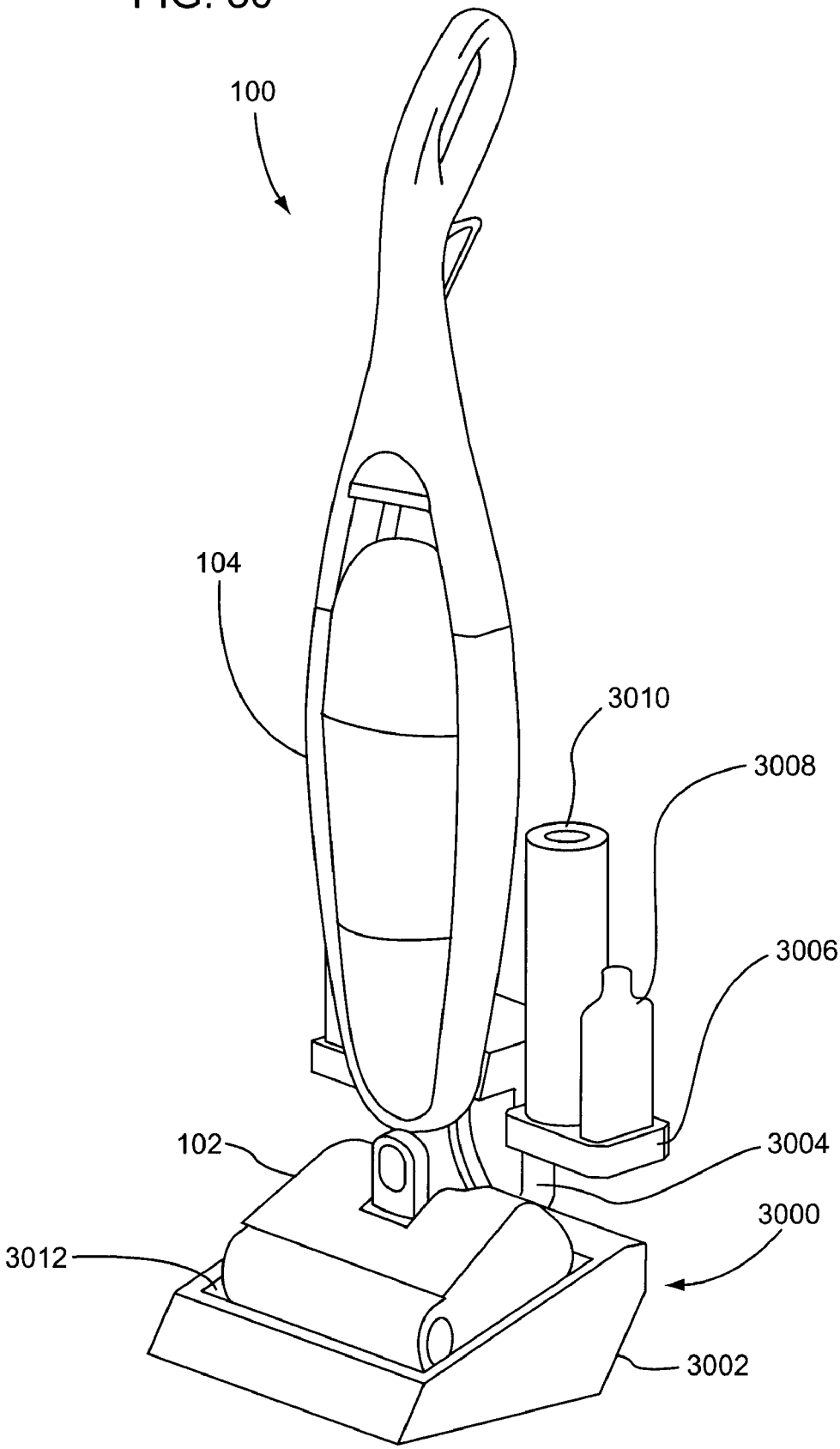
FIG. 30 is an isometric view of an exemplary embodiment of the cleaning device of FIG. 1 shown mounted on an exemplary embodiment of a stand.

Referring to FIG. 30, one exemplary embodiment of a stand 3000 comprises a base 3002 adapted to receive the cleaning head 102, and a post 3004 adjacent the handle 104. Either or both of the base 3002 and the post 3004 may include one or more hooks or other structures or features that hold the cleaning device 100 in place. For example, the post 3004 may include one or more upwardly-projecting protrusions that engage corresponding downwardly-facing receptacles on the handle 104 to hold the handle 104 in place, and the cleaning head 102 may rest in a cavity 3012 in the base 3002.

An accessory storage feature, such as a platform 3006, may be provided on the stand 3000. Such a storage feature may hold one or more cleaning fluid containers 3006, spare agitators 3010, replacement drive belts, vacuum filters or bags, and the like. If desired, the storage feature may include specially-adapted mounts or grips for particular devices, such as a post (not shown) for a spare agitator 3010 that conforms to the inner diameter of the agitator 3010. While the shown storage feature holds the stored devices on an open platform, it may instead hold one or more device in one or more enclosures.

Figure 31A:
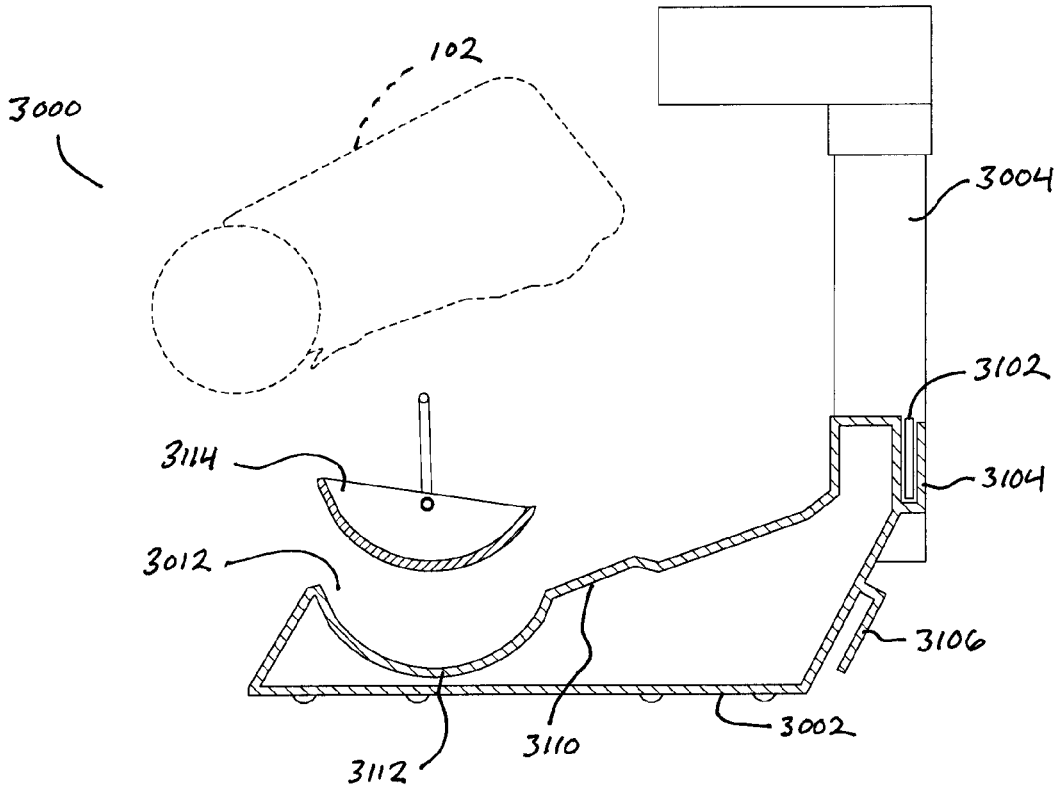
FIGS. 31A and 31B are cutaway side views of the stand of FIG. 30, showing the stand assembled two different exemplary configurations, and showing a cleaning head in phantom lines.
Figure 31B:
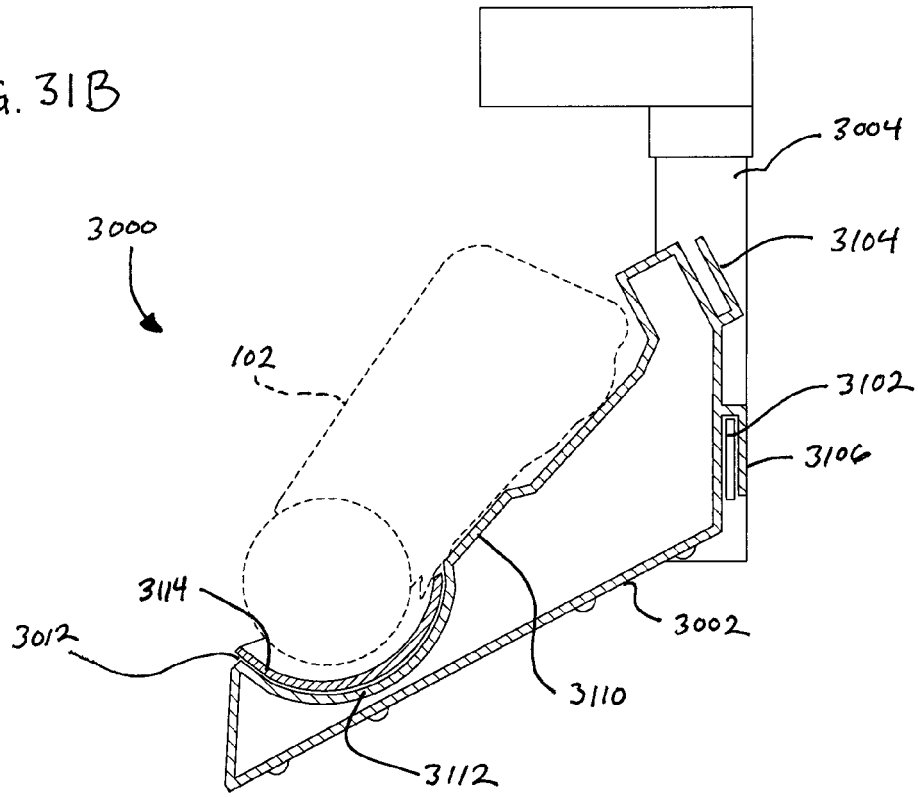

As shown in FIGS. 31A and 31B, the stand 3000 may be adapted to operate as a freestanding device, as shown in FIG. 31A, or as a wall-mounted device, as shown in FIG. 31B. For example, for floor use, the post 3004 may comprise tabs 3102 that slide downwards into upwardly-opening slots 3104 in the base 3002, and for wall use, the same tabs 3102 may be inserted into downwardly-opening slots 3106 in the base. This arrangement helps ensure that the base 3002 and post 3004 will not fall apart under their own weight when the base 3002 is rested on the floor for floor use or the post 3004 is mounted on the wall for wall use. The post 3004 may include screw holes, spikes, hooks or other features to facilitate mounting on a wall. In other embodiments, the base 3002 may also be mounted to a wall, and the post 3004 may also rest on the floor, or combinations of such arrangements may be used.

As shown in FIGS. 31A and 31B, the cavity 3012 may include structures 3110 that hold the agitator 110 out of contact with the base 3002 during storage to prevent the agitator 110 from becoming deformed by prolonged contact, and to help drain any fluid that may remain in the agitator 110 after use. The base 3002 also may include a drip tray to receive and store any fluid that may drip off of the device while it is stored. The drip tray 3112 may have a drain to facilitate emptying it, and it may have a separate reservoir, or may be adapted to be connected to a commonly available reservoir, such as a used water bottle, to allow it to be emptied without moving the base 3002 to a sink. The drip tray also may be a removable drip tray 3114, as shown, that fits into the recess 3012 below the agitator 110, or the entire recess 3012 may have a removable liner or be removable itself.

In other embodiments, the stand may simply include a horizontal lower surface that allows it to stand freely, and a vertical surface having mounting features that allows it to be wall-mounted. It will be understood that it is not strictly necessary for embodiments of a stand to be useable on a floor or a wall, and where such use is contemplated, it is not necessary in all embodiments to reconfigure the stand 300 for use its alternate use locations. In still other embodiments, the storage stand may also include a battery charging feature, such as a clip that holds a charging cord plug near the plug receptacle on the device to help the user install the plug into its receptacle after the device is mounted on the stand. In another embodiment, the stand and device may have electrical contacts that engage one another when the device is mounted. Such contacts may engage one another at all times while the device is on the stand, or only at the user's discretion. The stand also may include charging circuits, power cords, battery storage and/or charging compartments, and other features relating to charging batteries.

The embodiments described herein are not intended to limit the scope of the inventions recited in the appended claims. Furthermore, the claimed inventions may be practiced in any number of other ways, and, where suitable, in other contexts. For example, although many of the embodiments disclosed herein have been described with reference to floor cleaning devices, the principles herein are equally applicable to other types of devices. Indeed, various modifications of the embodiments of the present inventions, in addition to those described herein, will be apparent to those of ordinary skill in the art from the foregoing description and accompanying drawings. Such modifications are intended to fall within the scope of the following appended claims. Further, although some of the embodiments of the present invention have been described herein in the context of a particular implementation in a particular environment for a particular purpose, those of ordinary skill in the art will recognize that its usefulness is not limited thereto and that the embodiments of the present inventions can be beneficially implemented in any number of environments for any number of purposes. For example, while the embodiments often describe the use of an inlet slit to remove fluid from a roller and convey it to a recovery tank, such an inlet slit instead may be used to remove hair and fine particles from a vacuum cleaner brushroll and convey such debris to a filter, vacuum bag, or cyclone chamber. Accordingly, the claims set forth below should be construed broadly to encompass the full breath and spirit of the claimed inventions.

The invention claimed is:

1. A cleaning device comprising:

an elongated housing having a handgrip located at one end;

a cleaning head located at a second end of the housing and being adapted to be moved over a surface to be cleaned; the cleaning head comprising:

a rotary agitator adapted to rotate in a first rotational direction and contact the surface to be cleaned, a first inlet opening having a first cross-sectional area, and a second inlet opening having a second cross-sectional area, the second cross-sectional area being substantially less than the first cross-sectional area;

a dirt collection device associated with one of the elongated housing and the cleaning head;

a vacuum source associated with one of the elongated housing and the cleaning head, the vacuum source being adapted to generate a working airflow through the first inlet opening, the second inlet opening, and the dirt collection device;

a valve adapted to move between at least a first valve position in which the valve allows at least a portion of the working airflow to pass through the first inlet opening, and a second valve position in which the valve substantially prevents the working airflow from passing through the first inlet opening; and a valve actuator adapted to move the valve to the first valve position when the cleaning head is moved relative to the surface to be cleaned in a first direction and to the second valve position when the cleaning head is moved relative to the surface to be cleaned in a second direction.

2. The cleaning device of claim 1, wherein the elongated housing is pivotally attached to the cleaning head.

3. The cleaning device of claim 1, wherein the rotary agitator comprises a foam roller.

4. The cleaning device of claim 1, wherein the first inlet opening is adapted to remove debris at least from the surface to be cleaned, and the second inlet opening is located adjacent an outer surface of the rotary agitator and adapted to remove fluid from the rotary agitator.

5. The cleaning device of claim 1, wherein at least a portion of the second inlet opening contacts the outer surface of the rotary agitator.

6. The cleaning device of claim 1, wherein:

the cleaning head further comprises an agitator chamber at least partially surrounding the rotary agitator;

the first inlet opening is located at least partially within the agitator chamber at a first position with respect to the first rotational direction; and the second inlet opening is located at least partially within the agitator chamber at a second position with respect to the first rotation direction, the second position being beyond the first position with respect to the first rotational direction.

7. The cleaning device of claim 1, wherein the valve substantially prevents the working airflow from passing through the second inlet in the first valve position.

8. The cleaning device of claim 1, wherein the valve actuator is operated by contact with the surface being cleaned.

9. The cleaning device of claim 1, wherein the cleaning head further comprises a wheel, and the valve actuator is operated by the wheel.

10. The cleaning device of claim 1, wherein the dirt collection device is a recovery tank.

11. The cleaning device of claim 1, wherein the second cross-sectional area is equal to about 2% to about 80% of the first cross-sectional area.

12. The cleaning device of claim 1, wherein the second inlet opening is located above the first inlet opening.

13. A cleaning device comprising:

an elongated housing having a handgrip located at one end;

a cleaning head located at a second end of the housing and being adapted to be moved over a surface to be cleaned; the cleaning head comprising:

a rotary agitator adapted to rotate in a first rotational direction and contact the surface to be cleaned, an agitator chamber at least partially surrounding the rotary agitator a first inlet opening having a first cross-sectional area, a second inlet opening having a second cross-sectional area, the second cross-sectional area being substantially less than the first cross-sectional area, wherein the first inlet opening is located at least partially within the agitator chamber at a first position with respect to the first rotational direction, and the second inlet opening is located at least partially within the agitator chamber at a second position with respect to the first rotation direction, the second position being beyond the first position with respect to the first rotational direction, wherein the first inlet opening and the second inlet opening face the rotary agitator;

a dirt collection device associated with one of the elongated housing and the cleaning head; and a vacuum source associated with one of the elongated housing and the cleaning head, the vacuum source being adapted to generate a working airflow through the first inlet opening, the second inlet opening, and the dirt collection device.

* * * * *